US011946376B2

(12) United States Patent
Waters, Jr.

(10) Patent No.: US 11,946,376 B2
(45) Date of Patent: Apr. 2, 2024

(54) FLOOD PROTECTION FOR UNDERGROUND AIR VENTS

(71) Applicant: Floodbreak, L.L.C., Bellaire, TX (US)

(72) Inventor: Louis A. Waters, Jr., Bellaire, TX (US)

(73) Assignee: FLOODBREAK L.L.C., Bellaire, TX (US)

( * ) Notice: Subject to any disclaimer, the term of this patent is extended or adjusted under 35 U.S.C. 154(b) by 233 days.

(21) Appl. No.: 17/675,002

(22) Filed: Feb. 18, 2022

(65) Prior Publication Data

US 2022/0268158 A1 Aug. 25, 2022

Related U.S. Application Data

(60) Provisional application No. 63/152,102, filed on Feb. 22, 2021.

(51) Int. Cl.
*E21F 1/08* (2006.01)
*E21F 16/00* (2006.01)

(52) U.S. Cl.
CPC ..... *E21F 1/08* (2013.01); *E21F 16/00* (2013.01)

(58) Field of Classification Search
None
See application file for complete search history.

(56) References Cited

U.S. PATENT DOCUMENTS 706,526 A * 8/1902 Carlisle ..... E02B 5/08 169/DIG. 1
3,782,406 A * 1/1974 Siebold ..... F16K 31/18 137/411
3,858,603 A * 1/1975 Lenz ..... F16K 24/00 137/433
4,480,558 A * 11/1984 Russell ..... F23L 3/00 110/297
5,062,735 A * 11/1991 Gaudin ..... E02D 29/14 210/164
5,209,257 A * 5/1993 Baker, Jr. ..... E03F 5/08 137/433
5,401,114 A * 3/1995 Guggemos ..... E02D 29/14 137/364
6,016,828 A * 1/2000 Machledt ..... F16K 24/046 137/433

(Continued)

OTHER PUBLICATIONS

International Search Report and Written Opinion of ISA and Search Strategy.

*Primary Examiner* — Matthew W Jellett
(74) *Attorney, Agent, or Firm* — Tim L. Burgess

(57) ABSTRACT

An assembly that fits within a ventilation shaft open to atmosphere and leading from underground ventilation ducts such as to subways prevents surface waters from flooding the underground ducts while maintaining the ventilation. The assembly fits in the ventilation shaft and houses a buoyant float in a chamber surrounding a passageway in fluid communication with the ventilation shaft. A grate covers the passageway. An outside wall of the chamber adjacent the ventilation shaft is open at top to atmosphere and allows flooding water into the chamber, buoying the float upward in the chamber, elevating the passageway above the flooding water. The chamber suitably has means for drainage and admission of flush water to flush flood water debris from the chamber through the drainage.

22 Claims, 45 Drawing Sheets

(56) References Cited

U.S. PATENT DOCUMENTS

| | | | | |
|---|---|---|---|---|
| 6,050,207 | A * | 4/2000 | Mays | E02D 27/00 114/45 |
| 6,083,100 | A * | 7/2000 | Hardy | F24F 13/082 454/323 |
| 6,287,050 | B1 * | 9/2001 | Montgomery | F24F 11/76 52/573.1 |
| 6,347,487 | B1 * | 2/2002 | Davis | E04H 9/145 52/64 |
| 6,626,201 | B1 * | 9/2003 | Kim | E03F 5/042 137/202 |
| 6,848,465 | B1 * | 2/2005 | Ledbetter | F16K 24/044 137/433 |
| 6,851,225 | B1 * | 2/2005 | Haar | E02D 29/1409 404/26 |
| 7,270,498 | B1 * | 9/2007 | Albanese | E06B 9/04 52/302.1 |
| 7,600,944 | B1 * | 10/2009 | Keating | E04H 9/145 52/302.1 |
| 8,033,753 | B2 * | 10/2011 | Waters, Jr. | E21F 1/08 405/87 |
| 8,375,664 | B2 * | 2/2013 | Gower, Sr. | E04B 1/7076 52/302.1 |
| 9,752,342 | B2 * | 9/2017 | Waters, Jr. | E05F 1/02 |
| 11,060,754 | B2 * | 7/2021 | Bertini | F24F 13/02 |
| 2007/0215212 | A1 * | 9/2007 | Demeniuk | E03F 5/042 137/362 |
| 2012/0163917 | A1 * | 6/2012 | Waters, Jr. | E02B 3/102 405/114 |
| 2014/0241804 | A1 * | 8/2014 | Petrillo | F24F 13/14 405/80 |
| 2018/0051452 | A1 * | 2/2018 | Biebel | F16K 3/02 |
| 2023/0257989 | A1 * | 8/2023 | Aronstein | E04G 23/065 52/122.1 |

* cited by examiner

FLOOD PROTECTION FOR UNDERGROUND AIR VENTS

CROSS REFERENCE TO RELATED APPLICATION

This application claims the benefit of U.S. Provisional Patent Application 63/152,102 filed Feb. 22, 2021.

STATEMENT REGARDING FEDERALLY SPONSORED RESEARCH AND DEVELOPMENT

Not applicable

BACKGROUND OF THE DISCLOSURE

Technical Field

This invention relates to blocking flooding water from entering underground ventilation passages.

Background Art

Surface storm waters entering and flooding underground tunnels and chambers through ventilation ducts connecting the underground chambers or tunnels to air at ground surface affect without limitation, underground transportation tunnels for road vehicles, trains, and subways, and underground chambers, such as associated with a complex of connecting tunnels and shafts, for example as used for such things as underground hydroelectric-power plants, or with underground utilities which require ventilation, such as underground transformer rooms.

In a typical subway ventilation arrangement, ventilation ducts or shafts are incorporated into subway systems near stations to exhaust stale air pushed out as a train nears a station and to pull in fresh outside air as a train leaves a station, also reducing the "piston effect" of air being forced through the tunnels at high speeds by moving trains. Typically, a ventilation duct communicates from an underground tunnel and terminates in a ventilation shaft structure below grade level that opens to the atmosphere at grade level such as a sidewalk or street where the opening is covered by a subway grating.

Subways have systems for handling water. When it rains, water runs down stairwells, onto platforms and thence onto tracks, and some gets in the ventilation systems through the surface grates. Drains beneath the tracks pipe water to underground sumps in pump rooms next to the subway tracks. Pumps push the water up to pressure relief manholes open to the atmosphere at street level; from there the water drains under gravity flow into city storm sewers. The problem is that in heavy rains, storm sewers are overwhelmed and flush water back into the streets, flooding the streets with water and inundating sidewalks. Water pours down through subway grates into the ventilation system thence into the tunnels and onto the tracks. The pumping system can only return water to the flooded street; from there the water reenters the flood pool pouring into the ventilation system, defeating the pumping system as a means of controlling subway flooding. The problem is especially acute in coastal cities like New York and Lower Manhattan, which is low-lying, vulnerable to storm surges and dotted with grade-level grates, stairwells and other points of entry for running water into the subways.

Passive (i.e., self closing) systems have been developed to block flooding water from entering underground ventilation passages through sidewalk or street gratings covering ventilation passages. Examples are U.S. Pat. No. 8,033,753 by the same inventor as the inventor of the present invention, and U.S. Pat. No. 9,004,814 assigned to the New York City Transit Authority. These passive systems when fully operated stop flooding of underground ventilation passages but also close off ventilation. Even after heavy rains cease and drains remove street flooding, remaining pools of water above gratings covering underground ventilation passages prevents underground operation of trains because ventilation remains closed until pooled water is removed.

A purpose of the present invention is to block flooding water from entering underground ventilation passages and at the same time allow ventilation to underground passages to continue.

BRIEF DESCRIPTION OF THE DRAWINGS

In the following detailed description of exemplary embodiments, reference is to the accompanying drawings, which form a part hereof and in which are shown by way of illustration non-limiting embodiments by which the invention may be practiced. Certain features of the invention are shown in exaggerated scale or in somewhat schematic form and in some drawings some details of elements shown in other drawings are omitted in the interest of clarity and conciseness. Referring to the drawings:

FIGS. 1-13 depict four sided vertical rectilinear exemplary embodiments within the scope of the invention for installation in a vertical rectilinear ventilation shaft. FIGS. 14-28 depict circular vertical exemplary embodiments within the scope of the invention for installation in a ventilation shaft having a circular inner wall. The reference numerals in FIGS. 14-28 that indicate elements functioning like the elements in the embodiments in FIGS. 1-13 carry the same number as in FIGS. 1-13, increased by 100. For example, reference numeral 14 in FIGS. 1-13 is numeral 114 in FIGS. 14-28.

FIGS. 1-13, 29-43 and 44-58 depict vertical rectilinear embodiments of the invention. Rectilinear ventilation shafts in which rectilinear supports may be suspended may take a number of interior cross-sectional configurations such as triangular, quadrilateral, pentagonal, hexagonal, octagonal etc. but a common configuration is quadrilateral, i.e., four-sided, and that configuration is what is, without limitation, depicted as exemplary embodiments of the support, the chamber and the float in FIGS. 1-13 and 29-58. Since the exemplary embodiments are quadrilateral and some drawing figures are viewed from different directions or angles, orientation for the quadrilateral drawing figures is for convenience explained using four compass directions as an aid. Reference is made to FIG. 29 as a token compass. To the reader's left is "west." To the reader's right is "east." At the top between west and east is "north." To the bottom between west and east is "south." Thus, the top left corner is a northwest corner and the bottom right corner is a southeast corner. As a quadrilateral, the exemplary embodiments in FIGS. 1-13 and 29-58 can be turned so any of its four sides faces one of the four directions, so it is to be understood that the mention of a side as being south or north is only for convenience in describing the orientation of a figure and is not a feature of the invention.

FIG. 1 is a perspective sectional view of an exemplary embodiment of a four-sided rectilinear support viewed from the south with the "south" wall removed to see the interior. The rectilinear support is vertically suspended within a ventilation shaft from an inset ledge at a top of the shaft, showing outer and inner walls of the support with a floor at the bottom of the support and elements connected to the support. The space between the outer and inner walls above the floor is a chamber in which a buoyant float is housed (the float is not shown in FIG. 1). A grating affixed to the float is not shown. The chamber can receive water entering from the top of the outer wall open to the atmosphere.

FIG. 2 is a bottom view of the support within the ventilation shaft of FIG. 1, looking upward through the ventilation shaft into the support and showing the interior of the inner walls of the support, which define a ventilation passageway having top and bottom openings for fluid communication between the ventilation shaft and the atmospheric opening, the top opening being covered by a main grating.

FIG. 3 is a top perspective view from the north of the support of FIG. 1 within the ventilation shaft, the support housing a float and in this view being uncovered by the main grating, and showing the top opening of the ventilation passageway.

FIG. 4 is a top perspective view from the south of the main grating of FIG. 2 depicting diagonally opposite liftable gratings separate from the main grating and connected to the top of the outer wall of the support of FIG. 1, a first liftable grating in the southeast corner giving access to a handle for operating a drain in the floor of the support viewed in FIGS. 1 and 2, and a second liftable grating in the northwest corner providing access to a flush port for admission of flush water to remove debris from the chamber.

FIG. 5 is a vertical sectional view from the south of the support of FIG. 1 suspended within the ventilation shaft from a top of the shaft, showing the second liftable grating of FIG. 4 lifted and providing access to a hollow tube having an upper end adjacent the flush port, the tube extending into the chamber of the support above the floor of the chamber for directing flush water into the chamber for drainage though a drain located in the floor of the chamber.

FIG. 6 is a top plan view of the support of FIG. 1 covered by a main grating affixed to the top of the float and the liftable gratings of FIG. 4, indicating the direction of a sectional view for FIG. 7. In this view, using the compass of FIG. 29, north is to the viewer's left, south is to the viewer's right, east is at the top and west is at the bottom.

FIG. 7 is a vertical sectional view of the apparatus of FIG. 6 taken along the line 7-7 of FIG. 6, showing the float of FIG. 3 suspended from the attached main grating of FIG. 6 and housed within the chamber of the support below ground level, and showing the ventilation passageway of FIG. 2.

FIG. 8 is the same vertical sectional view as FIG. 7 but showing the float of FIG. 3 with affixed main grating elevated in the chamber above ground level, showing the ventilation passageway of FIG. 2 and indicating the location of the elements depicted in FIGS. 9 and 10.

FIG. 9 is a detail of a projection on the inner surface of the float.

FIG. 10 is a detail of a stop for cooperation with the projection of FIG. 9 to prevent elevation of the float and attached main grating out of the chamber, also showing a gasket affixed to an upper extent of the inner wall of the support of FIG. 1.

FIG. 11 is a perspective vertical sectional view of the apparatus of FIGS. 1-10 along the same FIG. 6 sectional lines producing the view in FIG. 7, showing the float with affixed main grating elevated in the chamber above ground level and showing the ventilation passageway of FIG. 2.

FIG. 12 is a perspective view from the northwest showing the float with affixed main grating elevated above ground level.

FIG. 13 is a vertical sectional view from just inside the south wall of the ventilation shaft (compare FIG. 1) showing the float of FIG. 3 with affixed main grating, rise of surface water in the chamber of the support elevating the float and the affixed main grating above ground surface water, preventing surface water from flowing through the main grating into the ventilation passageway and ultimately into the underground ventilation duct while maintaining atmospheric ventilation to the underground ventilation duct through the passageway of FIG. 2.

FIG. 14 is a top plan view of a circular support suspended in a vertical ventilation shaft within a vertical circular inner wall of the shaft with a circular float attached to a grating and an interior ventilation passageway for airflow between atmosphere and ventilation duct.

FIG. 15 is the same top plan view as FIG. 14 but with the grating removed to better reveal the circular float housed in a chamber between circular outer and inner walls of the support and the interior ventilation passage for airflow between atmosphere and an underground ventilation duct.

FIG. 16 is a perspective bottom view of the exemplary embodiment of FIG. 14 looking upward through the support and depicting the interior of the inner wall of the support defining a ventilation passageway having top and bottom openings for fluid communication between an underground ventilation duct and atmospheric opening, the top opening being spanned by a grating.

FIG. 17 is the top view of FIG. 14 indicating the direction of a sectional view for FIG. 18.

FIG. 18 is a vertical sectional view of the exemplary embodiment of FIG. 14 suspended in a vertical shaft with the float of FIGS. 14, 15 suspended from the attached grating of FIG. 17 and housed within a chamber of the support, providing airflow between an underground ventilation duct through the grating to atmosphere.

FIG. 19 is the same vertical sectional view as FIG. 18 but showing the float of FIGS. 14, 15 with affixed grating elevated in the chamber and illustrating the ventilation passageway of FIGS. 14 through 18 still providing airflow between an underground ventilation duct through the grating to atmosphere, and indicating the location of the elements depicted in FIGS. 20 and 21.

FIG. 20 is a detail of a projection on the inner surface of the circular float.

FIG. 21 is a detail of a stop for cooperation with the projection of FIG. 20 to prevent elevation of the float and attached grating out of the chamber, also showing a gasket affixed to an upper extent of the inner wall of the support of FIGS. 14, 15.

FIG. 22 is the top plan view of FIG. 15 showing the location of enlargements shown in FIGS. 23 and 25.

FIG. 23 is a detail of a portion of the outer wall of the support showing a notch or recess in the outer surface of the float below which a drain and drain handle is visible.

FIG. 24 is perspective elevational view of the drain shown in FIG. 23.

FIG. 25 is a detail from FIG. 22 showing vertical guide strips on the outer wall of the support.

FIG. 26 is a perspective vertical section of the exemplary embodiment of FIGS. 14-25 in which the float and attached grating are elevated in the support chamber above ground level showing the ventilation passageway of FIGS. 14 through 18 providing airflow between an underground ventilation duct through the grating to atmosphere.

FIG. 27 is a perspective view showing the float with affixed grating elevated above ground level.

FIG. 28 is a vertical sectional view showing the float with affixed grating, rise of surface water in the chamber of the support elevating the float and the affixed grating above ground surface water, preventing surface water from flowing through the grating into the underground ventilation duct while maintaining atmospheric ventilation to the underground ventilation duct through the ventilation passageway of FIGS. 14 through 18.

FIG. 29 is a top plan view of an exemplary embodiment of a four-sided rectilinear support vertically suspended within a ventilation shaft. FIG. 29 indicates the direction of sectional views for FIGS. 30, 32 and 36.

FIG. 30 is a vertical sectional view of an exemplary embodiment of the invention taken along the line 30-30 of FIG. 29.

FIG. 31 is a detail enlargement of the encircled portion of the embodiment of FIG. 30.

FIG. 32 is a vertical sectional view of an exemplary embodiment of the invention taken along the line 32-32 of FIG. 29.

FIG. 33 is a top cross-sectional view taken along the line 33-33 of FIG. 32.

FIG. 34 is a perspective vertical sectional view from a bottom angle of the apparatus of FIGS. 29-33 sectioned along the same sectional lines as FIG. 30.

FIG. 35 is a detail enlargement of the encircled portion of the embodiment of FIG. 34 depicting a fixture for affixing a grate portion adjacent a top opening of a ventilation passageway of a support suspended in a ventilation shaft.

FIG. 36 is a vertical section along the line 36-36 in FIG. 29 revealing a drain in an exemplary embodiment of the invention.

FIG. 37 is a perspective view of an interior (inside) of the outer wall of an exemplary embodiment of the invention providing a perspective view of the drain of FIG. 36.

FIG. 38 is a vertical section of the embodiments of FIGS. 29-37 in the same view as FIG. 32 but showing the float and attached grating elevated in the support and a separate grate adjacent a top opening of a ventilation passageway in a support suspended in a ventilation shaft.

FIG. 39 is a perspective of the vertical section of FIG. 38 sectioned along the same sectional lines as FIG. 32.

FIG. 40 is a perspective view from the northeast of a support for suspension in a ventilation shaft.

FIG. 41 is a perspective view from the northeast of a float and attached portions of a grating elevated from the support.

FIG. 42 is cutaway of the northeast corner of the support of FIG. 41.

FIG. 43 is a depiction of the support of FIG. 41 suspended in a ventilation shaft cutaway in the same northeast corner.

FIG. 44 is a top plan view like FIG. 29 of an exemplary embodiment of a four-sided rectilinear support vertically suspended within a ventilation shaft but differing from FIG. 29 in that no grating covers the float. FIG. 29 indicates the direction of sectional views for FIGS. 45, 47 and 49.

FIG. 45 is a vertical sectional view taken along the line 45-45 of FIG. 44 of an exemplary embodiment of the invention, similar to the view of FIG. 30 but differing from FIG. 30 in that no grating is affixed to the float.

FIG. 46 is a detail enlargement of the encircled portion of the embodiment of FIG. 45, similar to the view of FIG. 31 but differing from FIG. 31 in that no grating is affixed to the float.

FIG. 47 is a vertical sectional view taken along the line 47-47 of FIG. 44 of an exemplary embodiment of the invention, similar to FIG. 32 but differing from FIG. 32 in that no grating is affixed to the float.

FIG. 48 is a perspective sectional view of the vertical sectional view of FIG. 47.

FIG. 49 is a vertical sectional view of the exemplary embodiment of FIGS. 44-48 taken along the line 49-49 of FIG. 44, revealing a drain.

FIG. 50 is a vertical sectional view of an exemplary embodiment in which a gasket is affixed to a recess in the inner surface of the float below a companion member projection plate to a stop instead as in FIGS. 1-49 to an upper extent of the exterior of the inner wall of the support.

FIG. 51 is a detail enlargement of the gasket indicated by the encircled area in FIG. 50.

FIG. 52 is a bottom perspective view of the embodiments of FIGS. 50-51. FIGS. 50-52 are the only drawings showing the gasket placement alternative to placement at an upper extent of the exterior of the inner wall of the support. FIG. 53 et seq. as do FIGS. 1-49 place the gasket at the upper extent of the exterior of the inner wall of the support.

FIG. 53 is a vertical section of the embodiments of FIGS. 44-49 similar to FIG. 38 but differing from FIG. 38 in that no grating is affixed to the float, and showing a grate adjacent a top opening of the support.

FIG. 54 is a perspective of the vertical section of FIG. 53.

FIG. 55 is a perspective view from the northeast of a support for suspension in a ventilation shaft, similar to the view of FIG. 40 but differing from FIG. 40 in that no grating is affixed to the float.

FIG. 56 is a perspective view of a float elevated from the support, similar to the view of FIG. 41 but differing from FIG. 41 in that no grating is affixed to the float.

FIG. 57 is cutaway of the northeast corner of the support of FIG. 55, similar to the view of FIG. 42 but differing from FIG. 42 in that no grating is affixed to the float.

FIG. 58 is a depiction of the support of FIG. 55 suspended in a ventilation shaft cutaway in the same corner, similar to the view of FIG. 43, but differing from FIG. 43 in that no grating is affixed to the float.

DETAILED DESCRIPTION OF EMBODIMENTS

Figure 1:
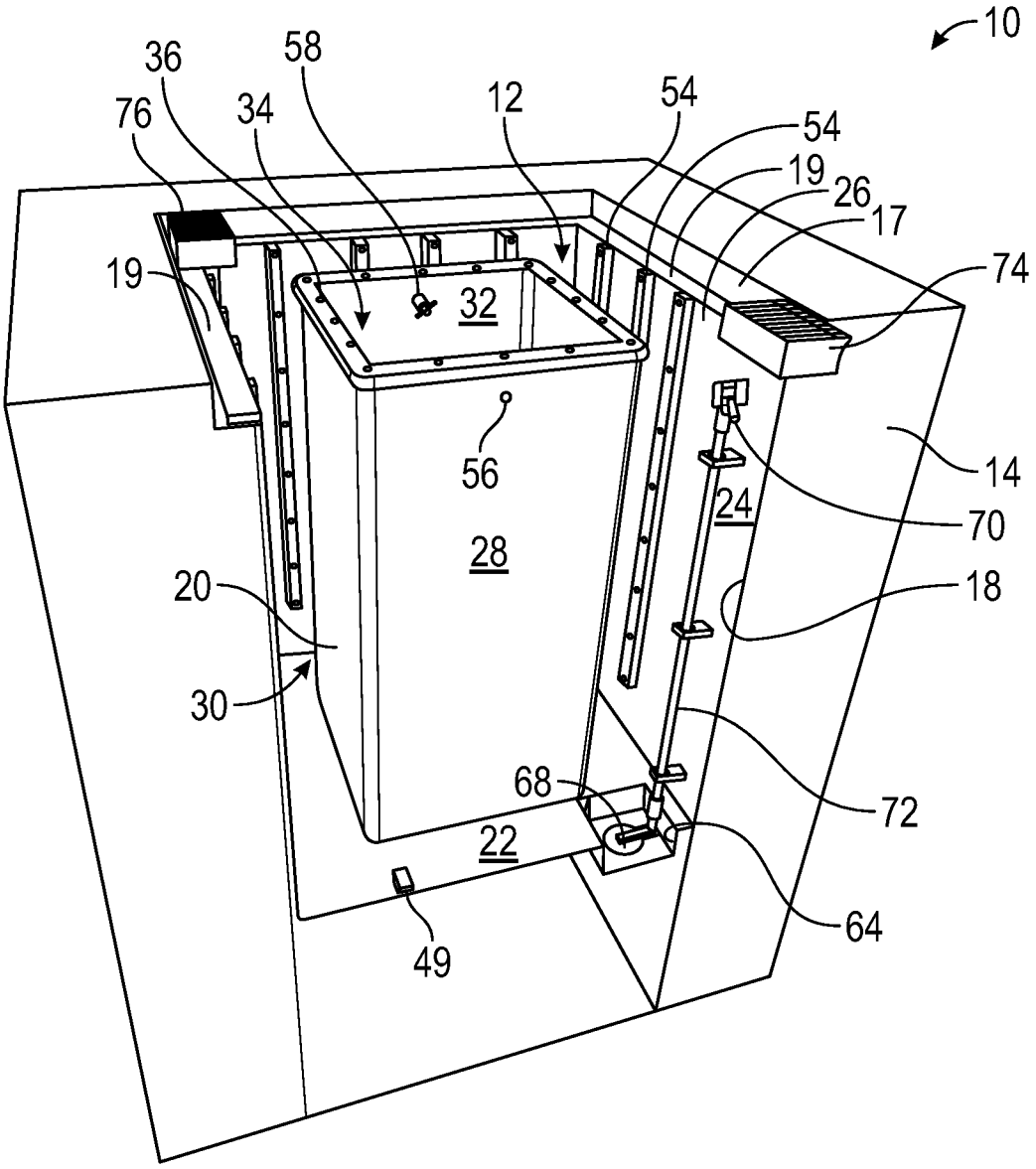
FIGS. 1-28 relate to apparatus in which a grating covering a ventilation passageway is affixed to a float that surrounds the ventilation passageway. The float resides in a chamber formed by a support that is suspended in a ventilation shaft that fluidly communicates with an underground ventilation duct. The float and the attached grating are raised above ground level by ground surface water entering the chamber, blocking surface waters from entering the ventilation passageway.

Specific details described herein, including what is stated in the Abstract, are in every case a non-limiting description and exemplification of embodiments representing concrete ways in which the concepts of the invention may be practiced. This serves to teach one skilled in the art to employ the present invention in virtually any appropriately detailed system, structure or manner consistent with those concepts. Reference throughout this specification to "an exemplary embodiment" means that a particular feature, structure, or characteristic described in connection with the embodiment is included in at least one exemplary embodiment of the present invention. Thus, the appearances of the phrase "in an exemplary embodiment" or similar expression in various places throughout this specification are not necessarily all referring to the same embodiment. Further, the particular features, structures, or characteristics may be combined in any suitable manner in one or more embodiments. Various changes and alternatives to the specific described embodiments and the details of those embodiments may be made within the scope of the invention. One or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

The various directions such as "upper," "vertical", "horizontal," "length," "laterally", "distal" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify. The terms "horizontal" or "horizontally" include but are not limited to literal horizontal and generally mean not out of level with respect to grade to a degree that will materially adversely affect the function of the element described as horizontal. Similarly, the terms "vertical" or "upright" include but are not limited to literal vertical and generally mean substantially up and down with respect to grade to a degree that will not materially adversely affect the function of the element described as vertical or upright.

As used herein, the terms "comprises," "comprising," "includes," "including," "has," "having" or any other variation thereof, are intended to cover a non-exclusive inclusion. For example, apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. That is, unless otherwise indicated, the term "or" is generally intended to mean "and/or". For example, a condition A or B is satisfied by any one of the following: A is true (or present) and B is false (or not present), A is false (or not present) and B is true (or present), and both A and B are true (or present).

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one." As used in the description herein, the meaning of "in" includes "in" and "on" unless the context clearly dictates otherwise. In addition, as used herein, the phrase "connection to" or "connected to" means joined to, either directly or through intermediate components.

Described herein are exemplary embodiments of apparatus for preventing downward flow of ground surface water into an underground ventilation duct fluidly communicating through a ventilation shaft to an atmospheric opening of the shaft while maintaining atmospheric ventilation to the underground ventilation duct. The exemplary embodiments have a support for suspension within the ventilation shaft from a top of the shaft. The support has a vertical outer wall adjacent the shaft and a vertical inner wall spaced from the outer wall with a floor at the bottom of the support between the outer and inner walls. The floor connects a bottom of the outer wall and a bottom of the inner wall of the support. The interior (inside) of the outer wall has a top opening to the atmosphere. Space between the interior of the outer wall and an exterior (outside) of the inner wall defines a vertical chamber over the floor for receipt of ground surface water entering from the top opening of the outer wall. The inner wall has an interior (inside) defining a ventilation passageway having top and bottom openings for fluid communication between the underground ventilation duct and the atmospheric opening via the ventilation shaft. A grating covers the ventilation passageway, allowing fluid communication between atmosphere and the ventilation passageway.

A buoyant float is housed within the chamber and has inner and outer surfaces respectively adjacent the exterior (outside) of the inner wall and the interior (inside) of the outer wall of the support. The float is sufficiently spaced above the floor of the support that ground surface water entering the chamber from the top opening of the outer wall can flow under the float and buoy the float upwardly in the chamber. Rise of water in the chamber elevates the float above ground, blocking ground surface water from entering the ventilation passageway through the grating, the ventilation passageway of the support remaining open to atmosphere.

In exemplary embodiments, one or more stops are located on the support, the float having a companion member projection for each stop which the stop can contact to prevent rise of the float out of the chamber. In an exemplary embodiment the one of more stops is/are located proximate an upper extent of the exterior of the inner wall of the support, and the companion member projection is located proximate the bottom inner surface of the float.

In exemplary embodiments, a gasket is affixed either proximate the inner surface of the float below a companion member projection for a stop or to an upper extent of the exterior of the inner wall of the support to sealingly contact the inner surface of the float and prevent water entering the chamber from the opening at the top of the outer wall from escaping from the chamber.

In exemplary embodiments such as depicted in FIGS. 1-28, the grating is unitary and affixed atop the float, spanning the top opening of the interior of the inner wall of the support, and rises with the float when the float is elevated in the chamber by surface water entering the chamber.

In exemplary embodiments such as depicted in FIGS. 29-43, the grating is bipartite, one portion covering an area inside the float over the ventilation passageway not rising when the float is elevated in the chamber by surface water entering the chamber, another portion covering the float and extending laterally outside the float and rising with the float when the float is elevated in the chamber by surface water entering the chamber. The exemplary embodiments of FIGS. 29-43 don't require the buoyant float to lift the entire heavy grating, reducing the weight the float has to raise, allowing a reduction in float size, which allows a larger ventilation passageway airflow area. The portions of the grating outside the float allow water to enter the float chamber from the top of the outer wall.

In exemplary embodiments such as depicted in FIGS. 43-58, the grating covers only the top opening of the interior of the inner wall of the support and does not rise with the float when the float is elevated in the chamber by surface water entering the chamber. Entirely eliminating grating on the float further reduces the weight the float has to lift, permitting a further reduction in float size, which allows an even larger ventilation passageway airflow area, which is an important goal.

In an exemplary embodiment, at least one of the exterior (outside) of the inner wall and the interior (inside) of the outer wall of the support is fitted with vertical guide strips for guiding the float vertically upward in the chamber.

In an exemplary embodiment, the top of the ventilation shaft has an inset ledge and the outer wall of the support has transverse flanges at an upper extent thereof for laying over the top of the inset ledge to hang the support in the shaft. In an exemplary embodiment in which a grating is affixed to the float, the grating has edges that extend onto the ledge to rest on the flanges to suspend the float sufficiently spaced above the floor of the support that ground surface water entering the chamber from the top opening of the outer wall can flow under the float and buoy the float upwardly in the chamber. In an exemplary embodiment in which no grating is affixed to the float, one or more projections either on the floor of the float chamber or on the inside of the outer wall above the floor or depending from a bottom of the float may be used to space the float sufficiently above the floor that surface water entering the chamber from can flow under the float and buoy the float upwardly in the float chamber.

In an exemplary embodiment, a drain is in the floor of the support. In an exemplary embodiment, the drain is configured to allow a controlled flow of water from the chamber. An example is a weep drain. In another exemplary embodiment, the float has a vertical recess along the height of the outer surface of the float facing the interior of the outer wall and a drain is located in the floor of the support at a bottom of the vertical recess. The drain comprises an aperture and a plug remotely moveable to open or close the drain by actuation of a handle connected to the plug, the handle being accessible from a top of the vertical recessed of the float. In an exemplary embodiment, the grating is a main grating affixed to the top of the float and a liftable grating separate from the main grating is connected to the top of the outer wall of the support, on lifting providing access to the drain handle. In another exemplary embodiment, the grating has portions covering areas both inside and outside the float, one grating portion covering an area inside the float over said ventilation passageway not rising when the float is elevated in the chamber by surface water entering the chamber, another grating portion covering the float and extending laterally outside the float and rising with the float when the float is elevated in the chamber by surface water entering the chamber. In this latter embodiment, a liftable grating is connected to the top of the outer wall of the support, on lifting providing access to the drain handle. In another exemplary embodiment in which the grating protecting the ventilation passageway is not attached to the float, other grating is provided to protect the top opening of the outer wall into which surface water enters the chamber. A liftable grating separate from grating covering said top opening of the outer wall is connected to said top of the outer wall of said support over the vertical recess above the drain, on lifting providing access to the drain handle.

In an exemplary embodiment, the float has a recess in a second vertical portion along the height of the outer surface of the float. The second recess is spaced from the vertical recess over a drain. The top of this second recess is a flush port for admission of flush water to remove debris from the chamber through the drain. In an exemplary embodiment, a vertical hollow tube extends into the chamber housed within the second vertical recess. The tube has an upper end adjacent a top of the second vertical recess for connection of the tube upper end to a flush water system to direct flush water into the chamber for drainage though a drain located in said floor. In an exemplary embodiment, the grating is a main grating affixed to the top of the float and another liftable grating separate from the main grating and connected to the top of the outer wall of the support over the second recess is liftable to provide access to the flush port. In another exemplary embodiment, in which the grating has portions covering areas both inside and outside the float, one grating portion covering an area inside the float over the vertical passageway not rising when the float is elevated in the chamber by surface water entering the chamber, another grating portion covering the float and extending laterally outside the float and rising with the float when the float is elevated in the chamber by surface water entering the chamber, a liftable grating is connected to the top of the outer wall of the support over the flush port, on lifting providing access to the flush port.

Referring now to the drawings for a more detailed explanation of exemplary embodiments of the invention, FIGS. 1-13 and 29-59 depict embodiments in which the ventilation shaft, the support, the chamber and the float are rectilinear. FIGS. 14-28 depict embodiments in which the ventilation shaft, the support, the chamber and the float are circular.

Figure 2:
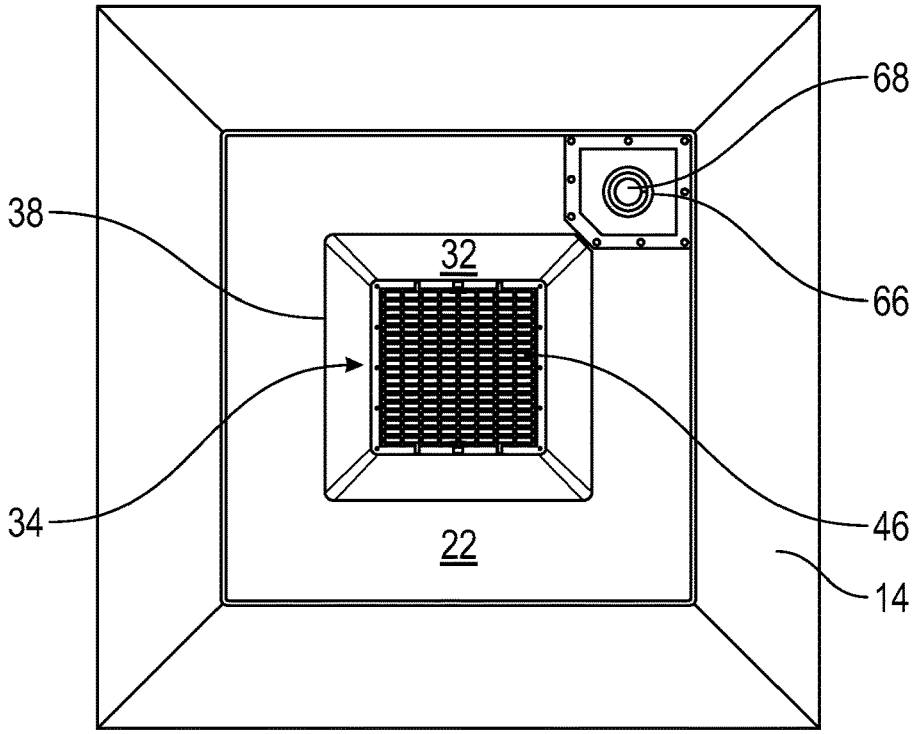

Referring now to FIGS. 1 and 2, reference numeral 10 in FIG. 1 indicates apparatus for preventing downward flow of ground surface water into an underground ventilation duct fluidly communicating through a ventilation shaft to an atmospheric opening of the shaft while maintaining atmospheric ventilation to the underground ventilation duct. Apparatus 10 comprises a rectilinear support 12 in the form of a four-sided box for vertical suspension within a vertical rectilinear quadrilateral ventilation shaft 14 from a top 16 of shaft 14. Support box 12 has a rectilinear vertical outer wall 18 adjacent vertical ventilation shaft 14 and a rectilinear vertical inner wall 20 spaced from outer wall 18, with a bottom floor 22 connecting a bottom of the outer wall 18 and a bottom of the inner wall 20 of the support. Support box 12 is open at the top.

In FIG. 1, the outer wall 18 and the adjacent wall of ventilation shaft 14 facing the reader are removed for a perspective view of the interior of support 12. For directional reference, the removed wall is the south outer wall 18, the west outer wall is to the reader's left, the east outer wall 18 is to the reader's right and the north outer wall is opposite the removed south outer wall 18. Element 74, described later, is in the southeastern corner. Element 76, described later, is in the northwestern corner The top of the ventilation shaft 14 has an inset ledge 17. Outer wall 18 of support 12 has transverse flanges 19 at an upper extent thereof. Flanges 19 rest on ledge 17 to hang support 12 in shaft 14. The interior (inside) 24 of outer wall 18 of support 12 has a top opening 26 to the atmosphere. Space between the interior (inside) 24 of outer wall 18 and the exterior (outside) 28 of inner wall 20 defines a rectilinear four-sided vertical chamber 30 for receipt of ground surface water entering from the top opening 26 of outer wall 18. Inner wall 20 has a rectilinear vertical interior (inside) 32 defining a ventilation passageway 34 having a top opening 36 to the atmosphere and a bottom opening 38 (e.g., FIG. 2) to ventilation shaft 14 for fluid communication through the ventilation shaft 14 to the underground ventilation duct and the atmospheric opening 36. Floor 22 connecting a bottom of outer wall 18 and a bottom of inner wall 20 of box 12 surrounds ventilation passageway 34, as depicted in FIG. 2. Support box 12 is lowered into place using lifting lugs 35 on the interior (inside) 32 of inner wall 20 (see FIGS. 7 and 11). Vertical guiding strips 54, described below, are on all four of the interiors of outer walls 18.

Figure 3:
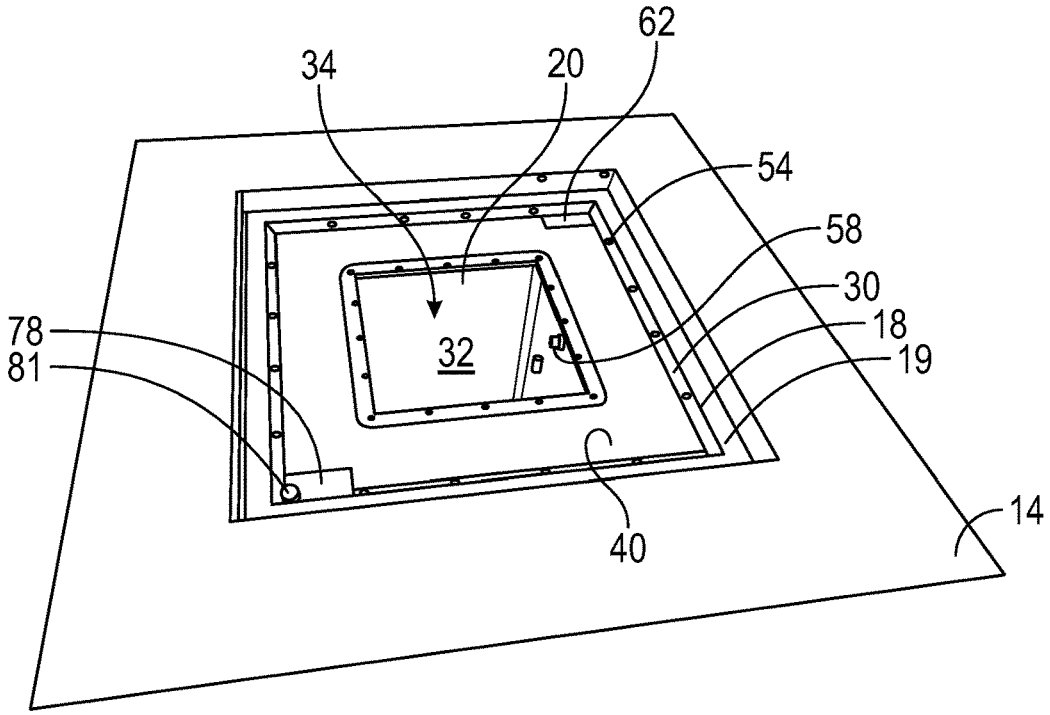
Figure 6:
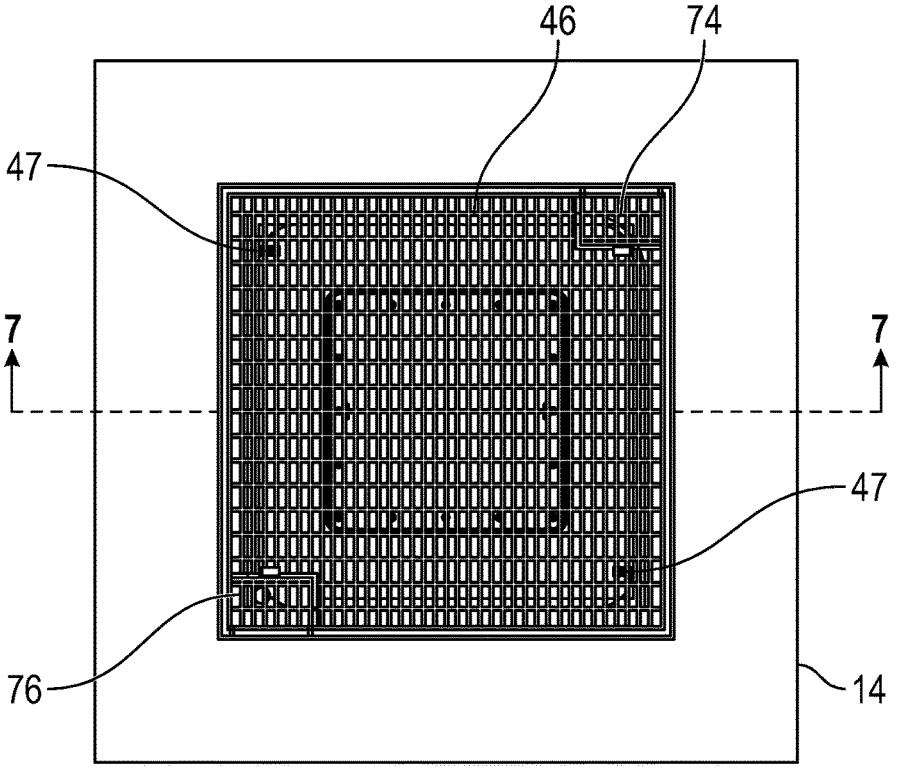
Figure 7:
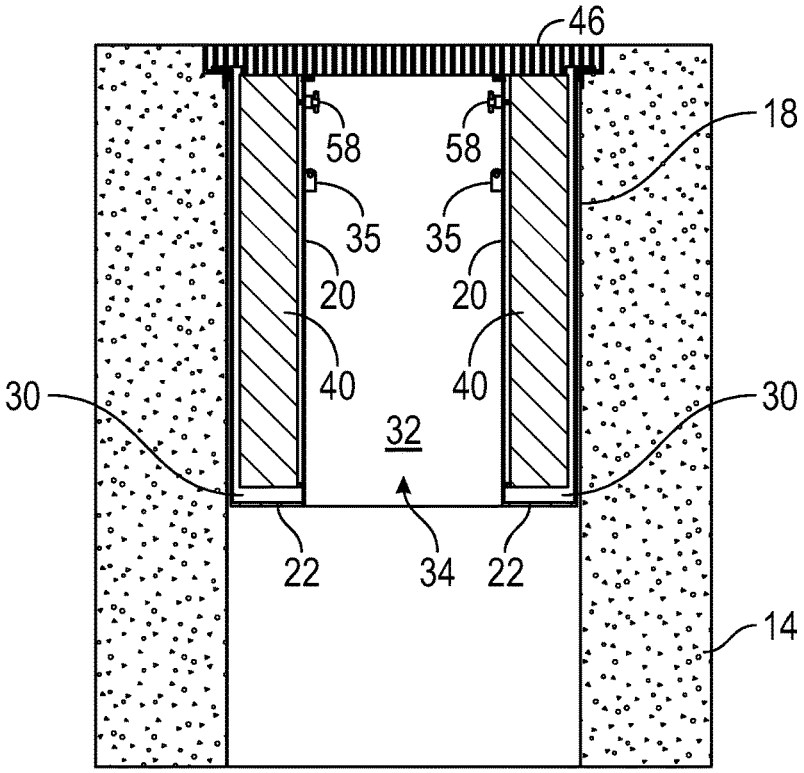
Figure 8:
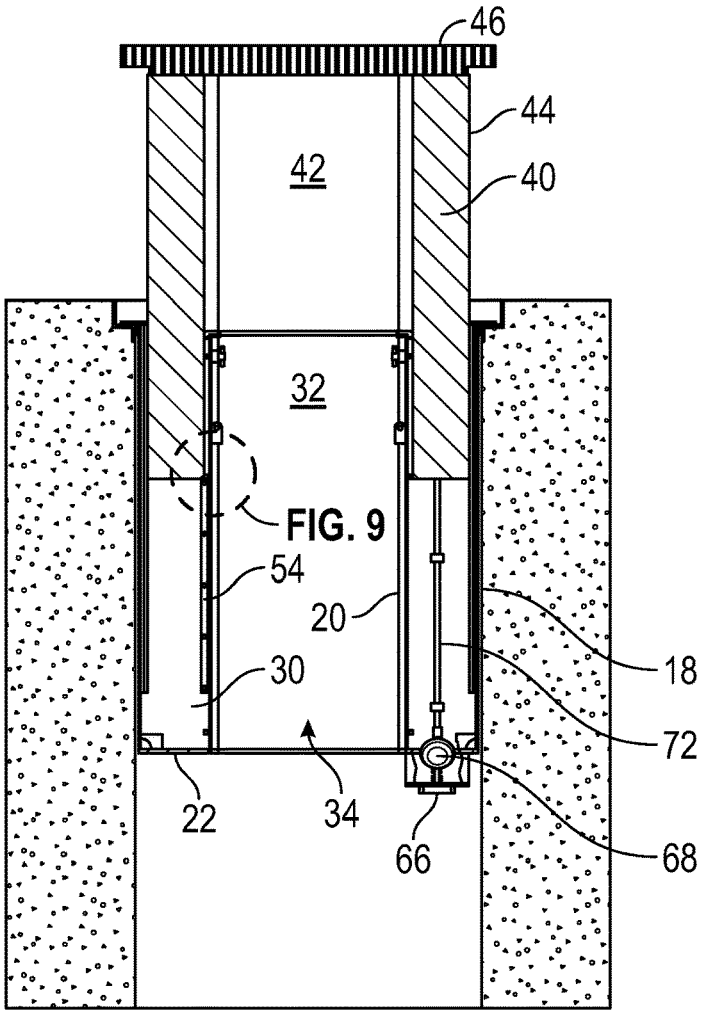
Figure 11:
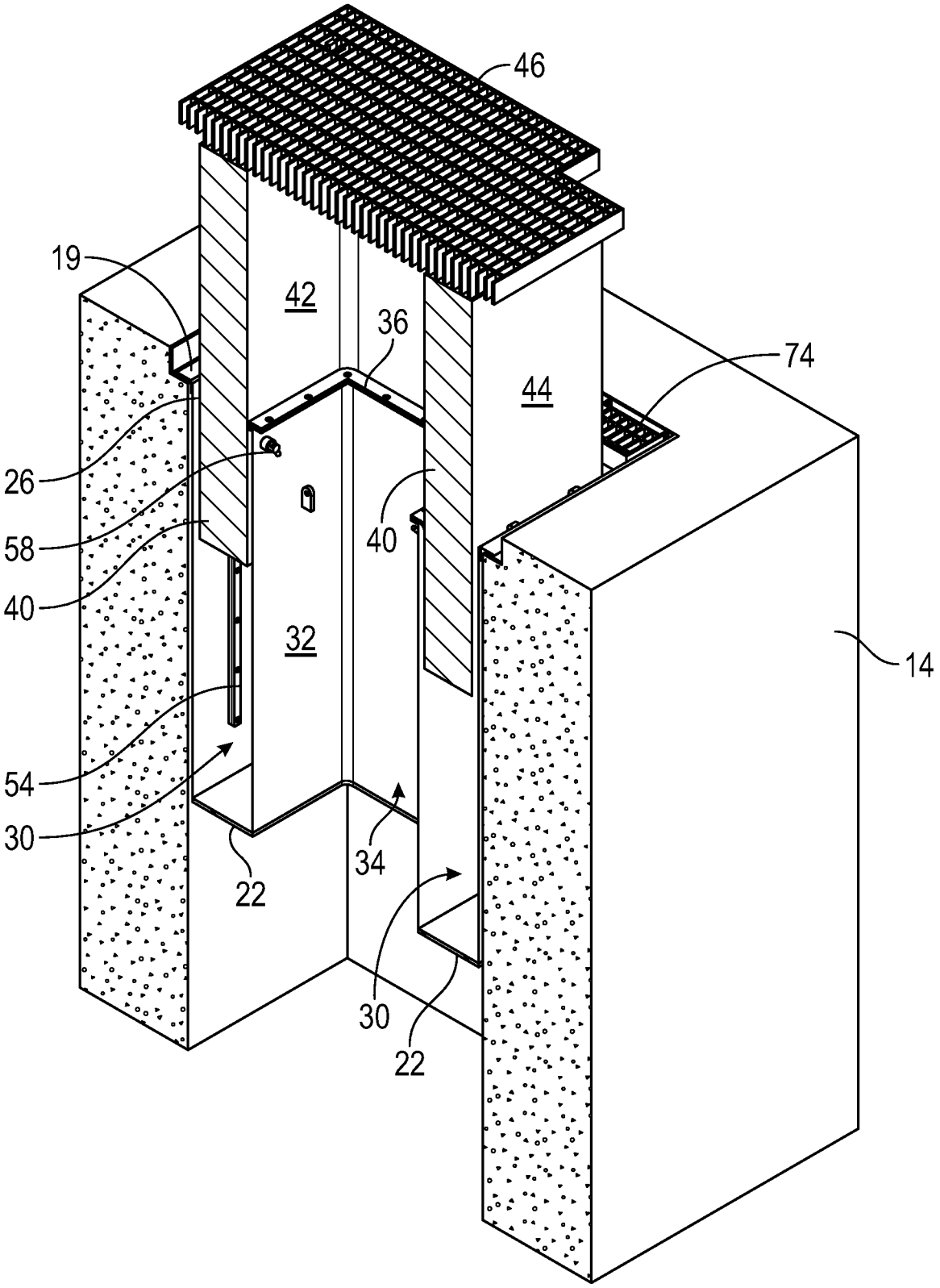
Figure 13:
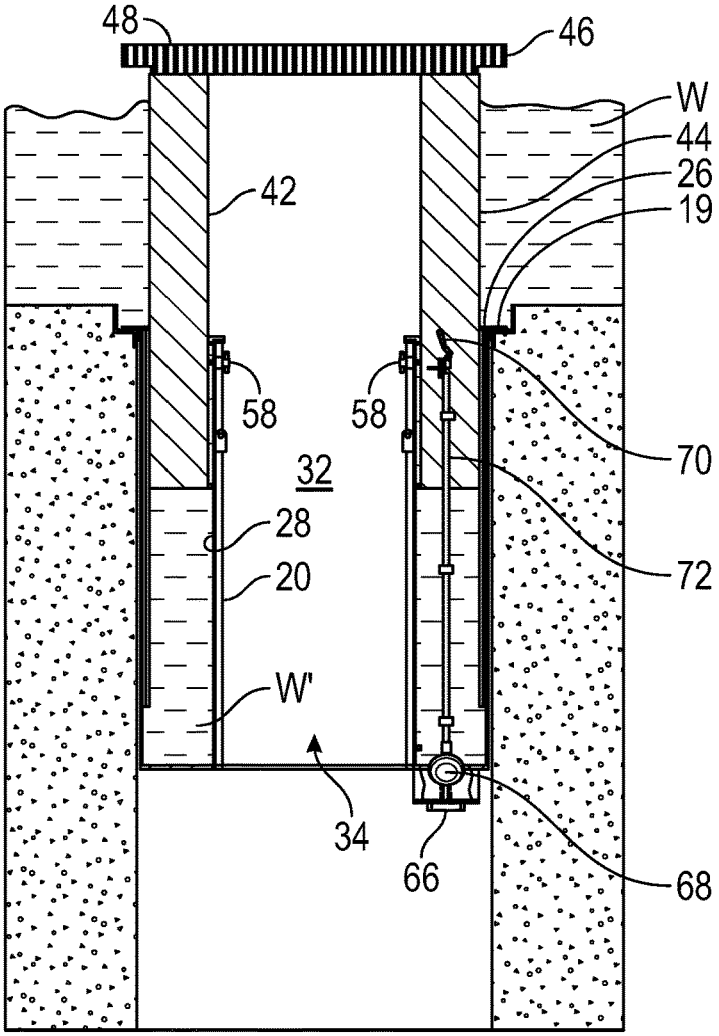

Referring to FIG. 3, a rectilinear four-sided buoyant float 40 is vertically housed within rectilinear chamber 30. In FIG. 6, the side of support 12 at the bottom is the west side. A vertical sectional view along the lines 7-7 of FIG. 6 looks to the east inner wall 20 of support 12, as seen in FIGS. 7 and 8. The vertical section of FIG. 6 along the lines 7-7 bisects float 40 into a north segment on the reader's left and a south segment on the reader's right (FIGS. 7 and 8). The interior of the inner wall 20 is between the north and south float segments 40. FIG. 11 provides a perspective of that sectional view. In FIG. 8 the float 40 is raised and elements of drain 64 in the southeast corner of support 12 are viewed except handle 70 (obscured by the lower part of the south segment of float 40). FIG. 13 provides the reader with X-ray vision to see through the lower part of the south segment of float 40 so all of drain 64 including handle 70 is viewed. Referring to FIGS. 11 and 13, float 40 has a vertical inner surface 42 adjacent the exterior (outside) 28 of inner wall 20 and a vertical outer surface 44 adjacent the interior (inside) 24 of outer wall 18.

Referring to FIGS. 2, 4-8, and 11-13, a main grating 46 is affixed atop float 40 by fasteners 47 (FIG. 6). Main grating 46 allows fluid communication between the atmospheric opening 36 of main grating 46 and ventilation passageway 34 of support box 12. In an exemplary embodiment, see FIG. 7, grating 46 extends over the flanges 19 of outer wall 18 on ledge 17 of shaft 14 and suspends float 40 sufficiently spaced above floor 22 that surface water W (FIG. 13) entering chamber 30 from the top opening 26 of outer wall 18 can flow under float 40 and buoy float 40 upwardly in chamber 30. As depicted in FIG. 13, rise of water W' in chamber 30 buoys float 40 upward in chamber 30, elevating float 40 and affixed main grating 46 above the surface water W, blocking surface water from entering the ventilation passageway 34 through grating 46. FIGS. 8, 11, 12 and 13 depict float 40 and affixed main grating 46 in an elevated position. Accordingly, apparatus 12 works to prevent ponding surface water from pouring into ventilation shaft 14 while at the same time maintaining ventilation passageway 34 above the water and open to atmosphere, providing uninterrupted ventilation through ventilation shaft 14 to underground ventilation duct.

Figure 9:
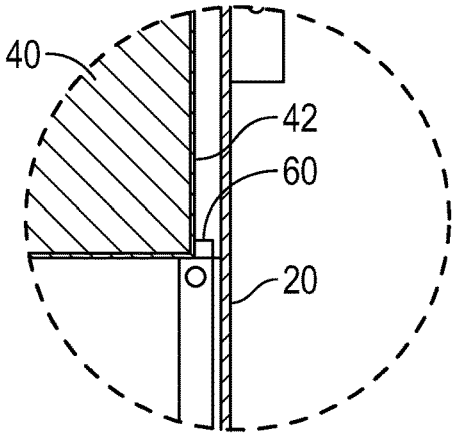
Figure 10:
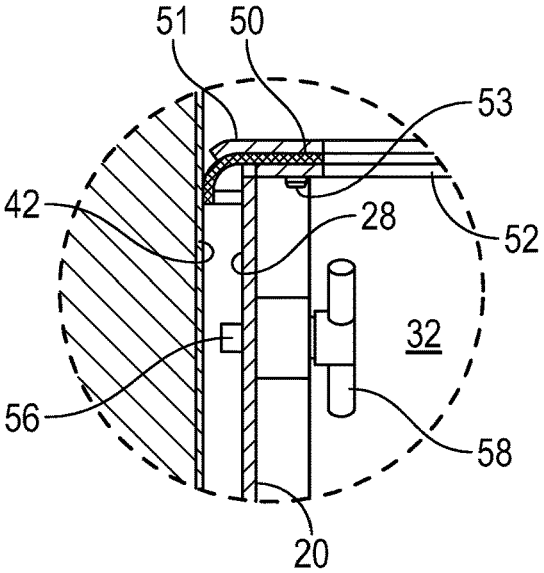

Referring to FIG. 10, in an exemplary embodiment, an upper extent 52 of inner wall 20 of support box 12 has a gasket 50 affixed to it. Gasket 50 extends over exterior (outside) 28 of inner wall 20 sealingly against an inner surface 42 of float 40 to prevent water W' that has entered chamber 30 from the top opening 26 of outer wall 18 from escaping chamber 30 at such upper extent 52. In the embodiments of FIGS. 1-13, gasket 50 is on all sides of inner wall 20 held in place by holder 51 secured by fasteners 53. In an alternative embodiment, gasket 50 may be affixed to a recess in the inner surface 42 of float 40 below companion member projection 60, as discussed below in connection with FIGS. 49-51.

As best seen in FIGS. 1, 3 and 11, the interior (inside) 24 of outer wall 18 of box 12 is fitted with vertical guiding strips 54, suitably high abrasion and wear resistant ultra-high molecular weight polyethylene strips, for guiding float 40 vertically upward in chamber 30. Alternatively, guiding strips 54 may be placed on the exterior (outside) 28 of inner wall 20.

As best seen in FIG. 10, a stop 56 is located on the exterior (outside) 28 of inner wall 20 of support box 12. In FIG. 10, stop 56 is the end of a stopper screw 58 adjustably extending through inner wall 20. As shown by the indications of stopper screw 58 in FIGS. 1, 3, 7, 8, 11 and 13, more than one stop 56 may be located on outside 28 of inner wall 20. Referring to FIG. 9, the inner surface 42 of float 40 has a companion member plate projection 60 for each stop 56 which each stop 56 can contact to prevent rise of float 40 out of chamber 30. Stopper screw 58 is a release mechanism allowing withdrawal of stop 56 from chamber 30 so float 40 can be removed from chamber 30 for maintenance or other service. Other suitable release mechanisms may be used instead, such as a plunger or cam.

Figure 4:
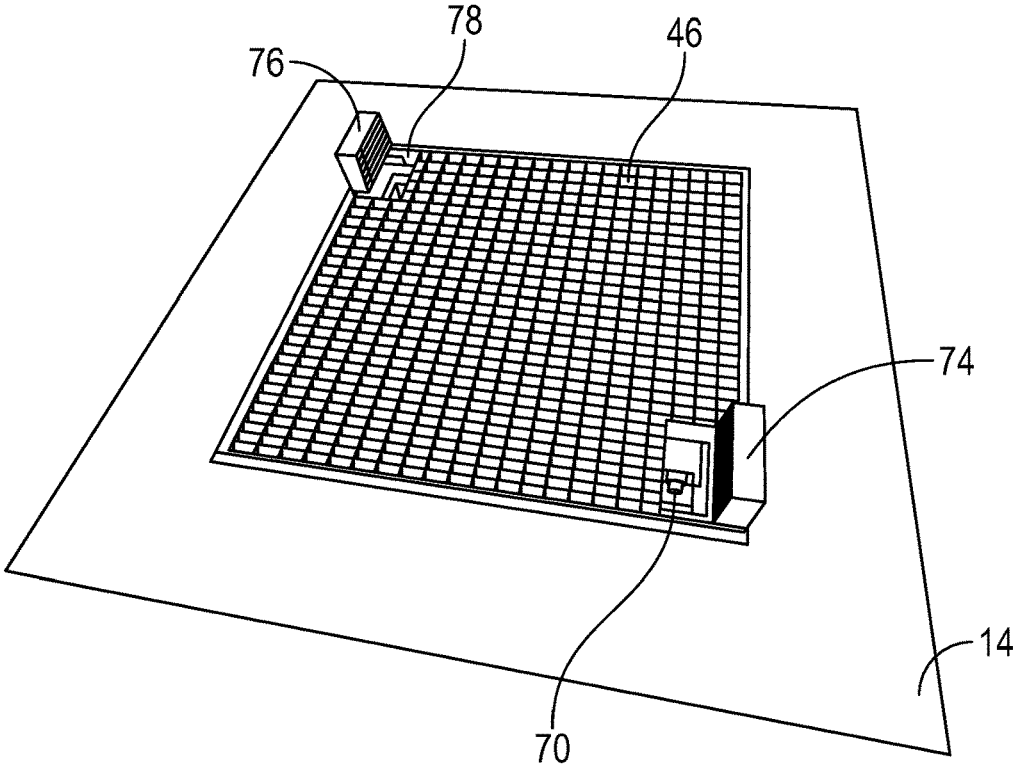

In FIG. 3, the side closest to the reader is the north side. Referring to FIG. 3, float 40 is relieved as a vertical recess 62 along the height of float 40 facing the inside 24 of the east outer wall 18. Referring additionally to FIGS. 1 and 2, a drain 64 is located in floor 22 of support box 12 at a bottom of vertical recess 62. Drain 64 comprises an aperture 66 and a plug 68 remotely moveable to open or close aperture 66 by actuation of a handle 70 linked by a rod 72 connected to plug 68. Handle 70 is accessible at a top of vertical recess 62. A liftable grating 74 separate from main grating 46 is pivotally connected to the top of outer wall 18 of support box 12 above the vertical recess 62. Lifting liftable grating 74 provides access to handle 70 (FIG. 4). As seen in FIG. 11, the separation of main grating 46 from liftable grating 74 is evident when float 40 rises in chamber 30 raising main grating 46 while liftable grating 74 does not rise. Plug 68 of drain 64 is shown open in FIGS. 8 and 13 to illustrate the plug but the reader will understand that plug 68 is closed in all situations when water is not being drained from chamber 30. Plug 68 is depicted closed in FIG. 1.

Figure 5:
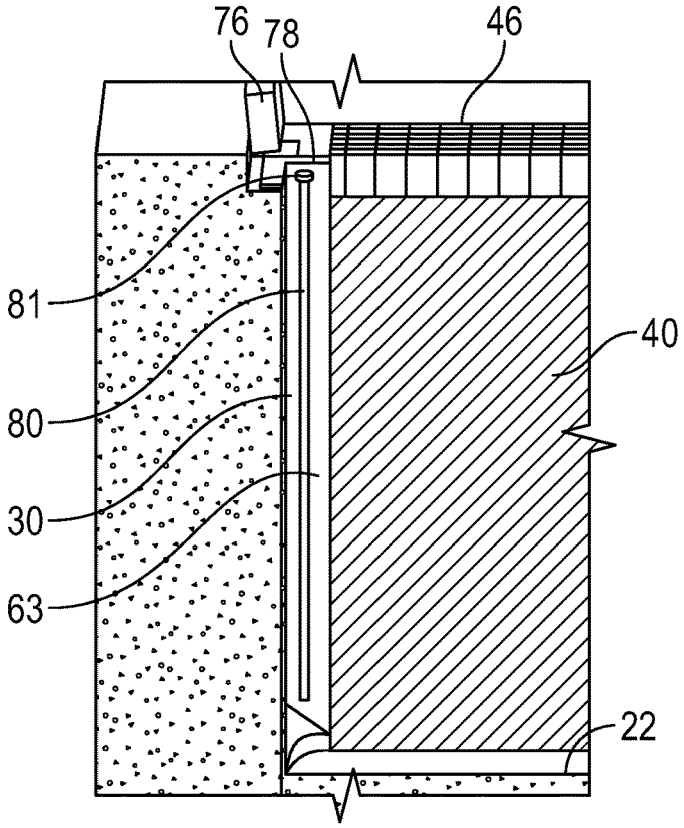
Figure 12:
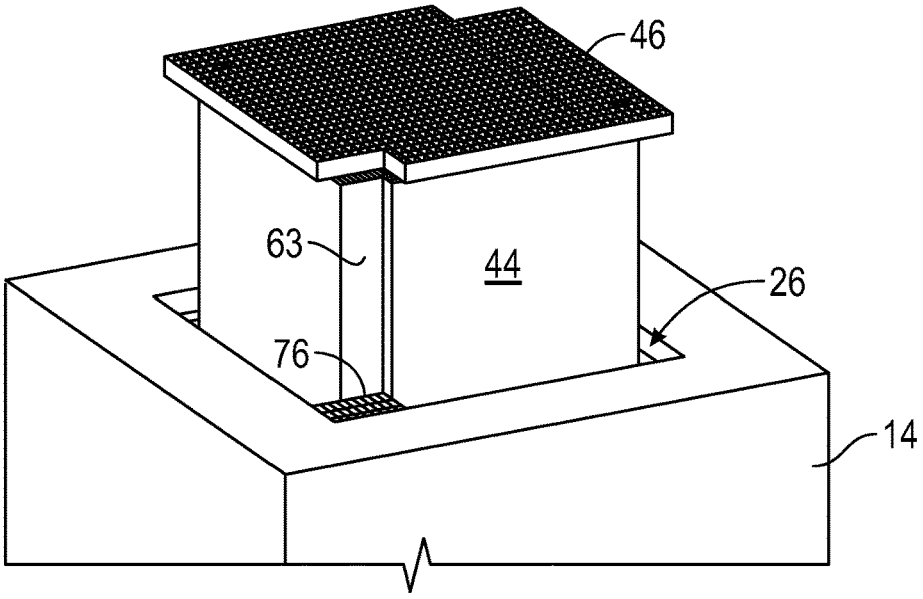

Surface water admitted into chamber 30 may carry debris. After surface water has receded and water in chamber 30 has been drained using drain 64, the debris may be removed to avoid interference with rise of float 40 in chamber 30. Referring to FIGS. 3, 5 and 12, float 40 has a vertical recess 63 along the height of the float facing the inside 24 of the west outer wall 18 and spaced from the recess over drain 64. Referring to FIGS. 1, 3, 4 and 5 a second liftable grating 76 separate from main grating 46 and pivotally connected to the top of west outer wall 18 of support box 12 is liftable to provide access to a flush port 78 at the top of vertical recess 63 for admission of flush water to flush debris from chamber 30 with drain 64 open. A hollow tube 80 has an upper end 81 adjacent flush port 78 and extends along vertical recess 63 of float 40 into chamber 30 above floor 22 for connection of upper end 81 to a flush water system to direct flush water into chamber 30 for drainage though drain 64 located in floor 22. FIG. 12 is a perspective viewed from the west and north sides of the support 12 showing liftable grate 76 covering the flush port 78 in the northwest corner of support 12, and like FIG. 11, showing that liftable grating 76 is separate from main grating 46, not rising when main grating is elevated atop a risen float 40.

Referring now to FIGS. 14-28, exemplary embodiments are described in which a ventilation shaft has a circular inner wall, and the support, the chamber and the float are circular. Like the exemplary embodiments of FIGS. 1-13, the exemplary embodiments of FIGS. 14-28 depict apparatus, here indicated generally by reference numeral 100, for preventing downward flow of ground surface water into an underground ventilation duct fluidly communicating through a ventilation shaft 114 to an atmospheric opening of the shaft while maintaining atmospheric ventilation to the underground ventilation duct.

Figure 14:
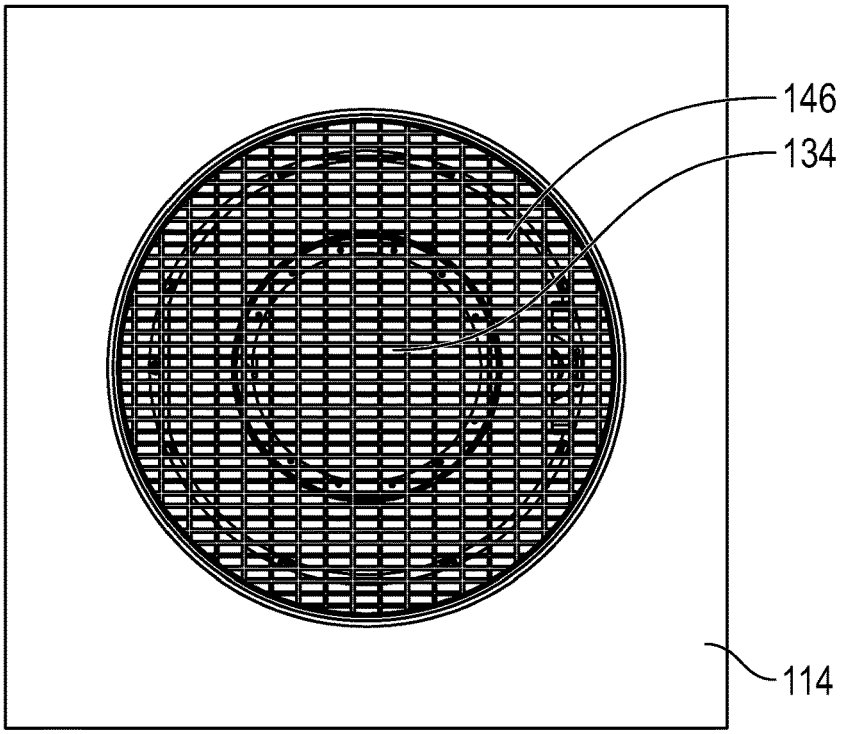
Figure 15:
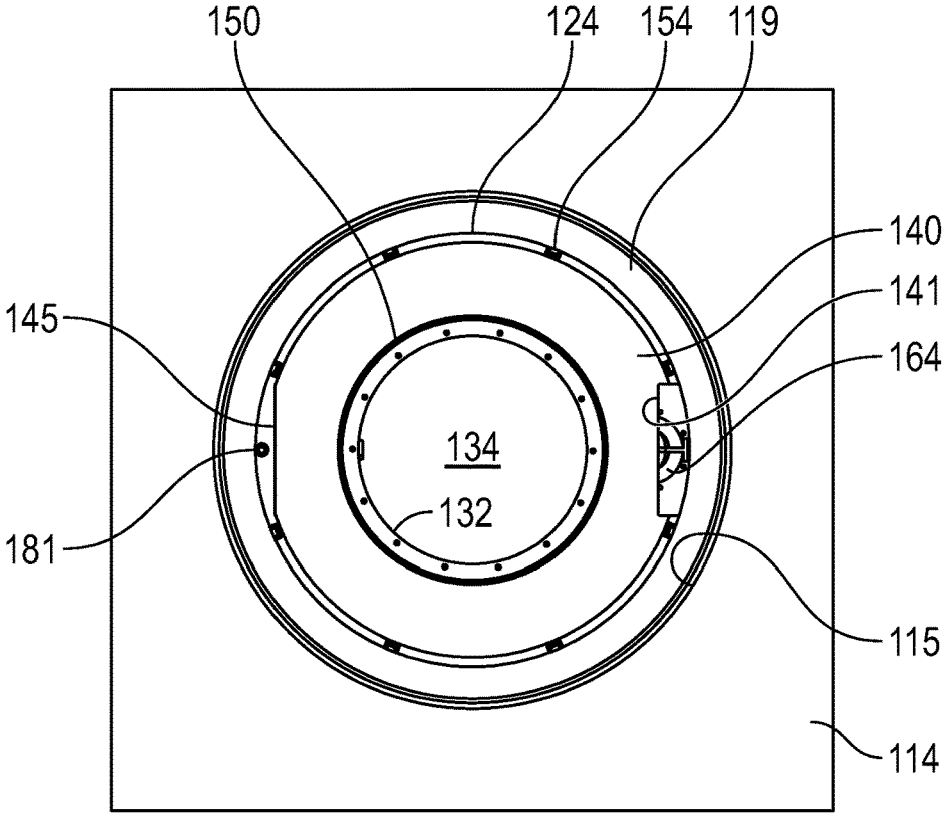
Figure 16:
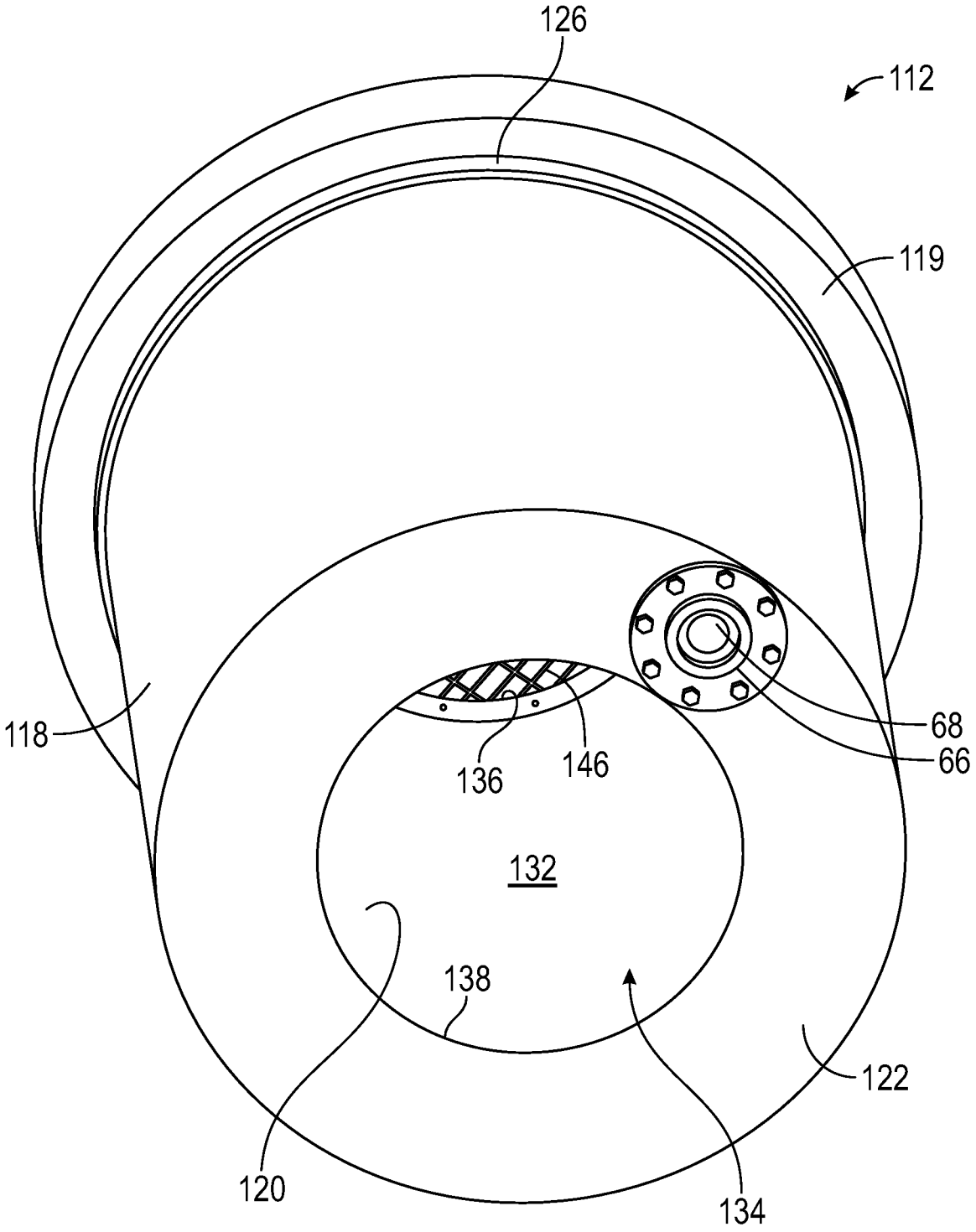
Figure 17:
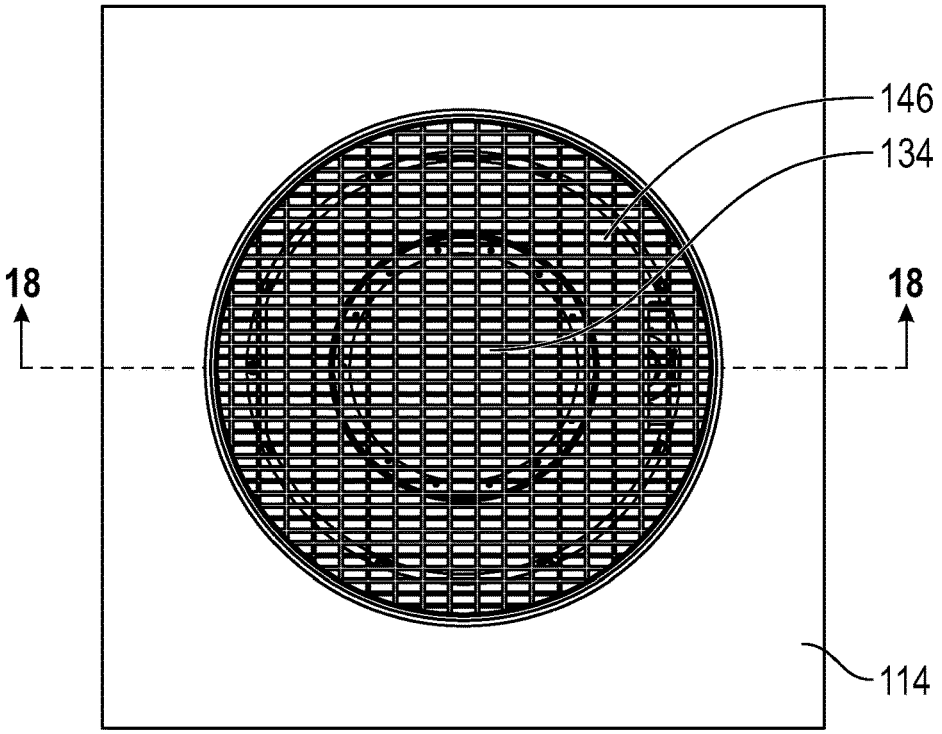
Figure 18:
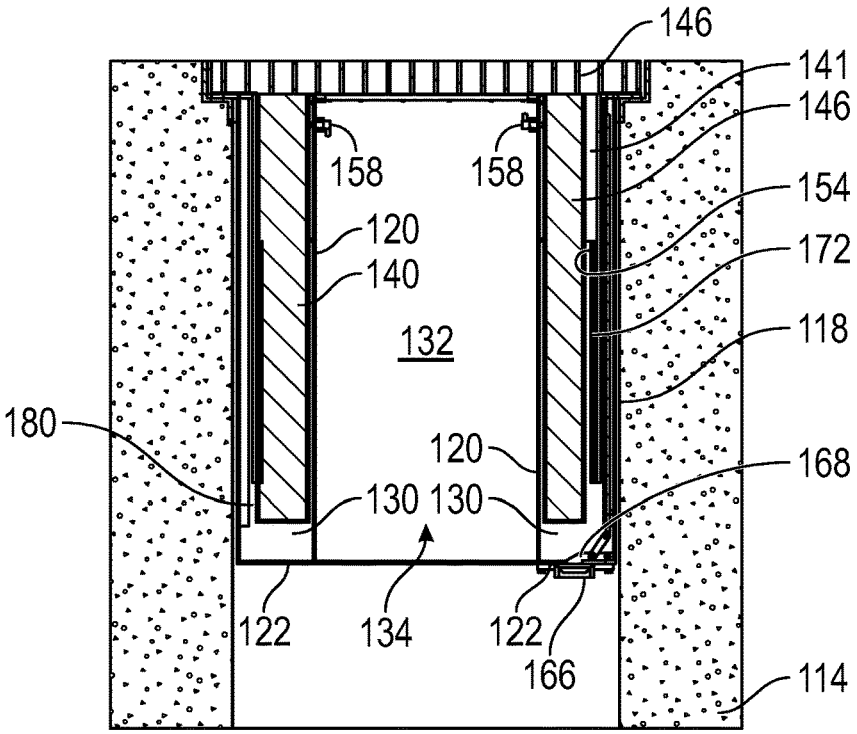

Referring first to FIGS. 14-16, a vertical circular support 112 is depicted for vertical suspension from a top 116 of a vertical ventilation shaft 114 within a vertical circular inner wall 115 of shaft 114. The top of the shaft 114 has an inset ledge 117. Support 112 has a vertical circular outer wall 118 adjacent the inner wall 115 of shaft 114. Outer wall 118 has transverse flanges 119 at an upper extent thereof and the flanges 119 rest on ledge 117 to hang support 112 in shaft 114. Support 112 has a vertical circular inner wall 120 spaced from outer wall 118, with a bottom floor 122 between outer wall 118 and inner wall 120 of support 112. The interior (inside) 124 of outer wall 118 has a top 126 opening to the atmosphere. A space between the interior (inside) 124 of the outer wall 118 and an exterior (outside) 128 of inner wall 120 above floor 122 defines a vertical annular chamber 130 for receipt of surface water W entering from the top opening of outer wall 118. The inner wall 120 of support 112 has a circular interior (inside) 132 defining a ventilation passageway 134 having a top opening 136 and a bottom opening 138 for fluid communication through the ventilation shaft 114 between the underground ventilation duct and the atmospheric opening.

Referring now also to FIGS. 18, 19, and 26-28, a circular buoyant float 140 is vertically housed within circular chamber 130. Float 140 has an inner surface 142 adjacent the outside 128 of inner wall 120 and an outer surface 144 adjacent the inside 124 of outer wall 118 of support 112. Referring to FIGS. 14, 16-19 and 26-28, a grating 146 is affixed atop float 140. The depth of floor 122 in chamber 130 and the height of float 140 are such that with grating 146 affixed to float 140, float 140 is sufficiently spaced above floor 122 that surface water W entering chamber 130 from the top 126 opening of outer wall 118 can flow under float 140 and buoy float 140 upwardly in chamber 130.

Figure 28:
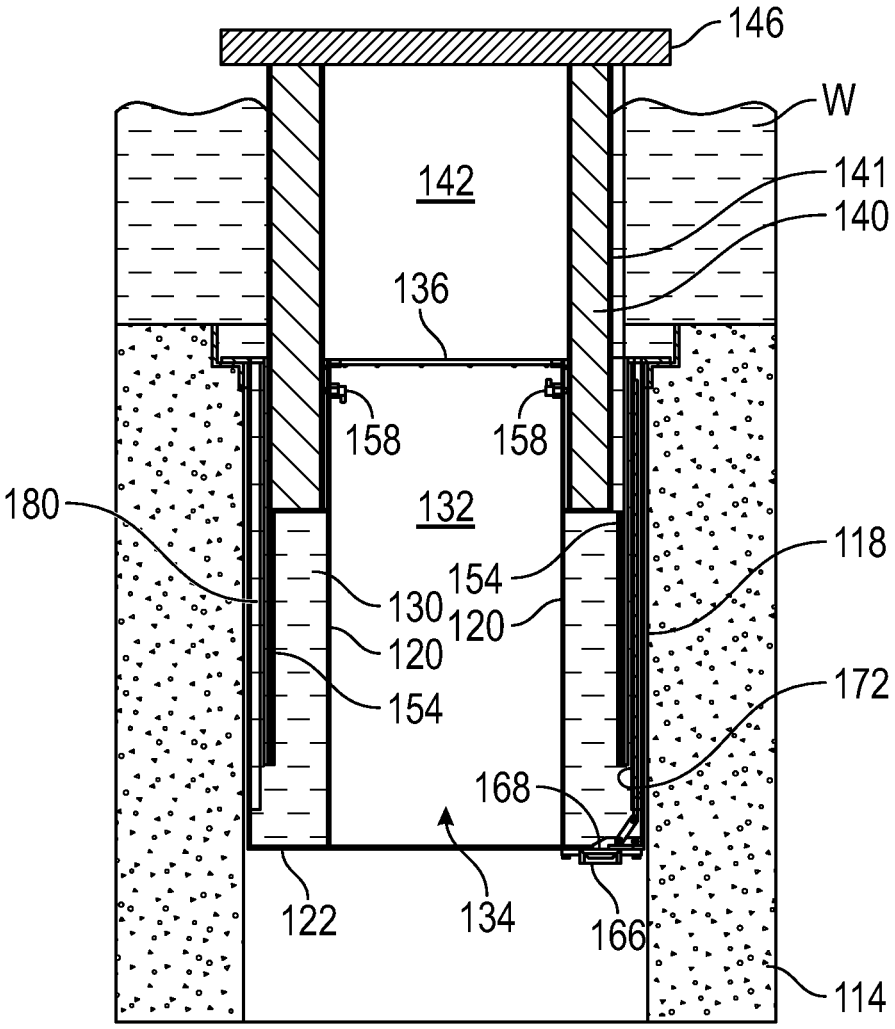

Grating 146 affixed atop float 140 allows fluid communication between the atmospheric opening and passage 134 of support 112. When sidewalk or other pavement above ventilation shaft 114 is flooded with surface water W, water W' enters chamber 130 from the top opening 126 of outer wall 118. As depicted in FIG. 28, rise of water W' in chamber 130 buoys float 140 upward in chamber 130, elevating float 140 and grating 146 above the surface water W, thereby preventing surface water W from flowing through grating 146 into an underground ventilation duct while maintaining atmospheric ventilation to the underground ventilation duct through ventilation passageway 134 of support 112. FIGS. 19 and 26-28 depict float 140 and affixed grating 146 in an elevated position Referring to FIG. 21, in an exemplary embodiment, inner wall 120 of support 112 has a gasket 150 affixed to an upper extent 152 thereof. Gasket 150 extends over outside 128 of inner wall 120 sealingly against inner surface 142 of float 140 to prevent water W' entering chamber 30 from the opening at the top 126 of outer wall 118 from escaping chamber 130 at such upper extent 152. In an alternative embodiment, gasket 50 may be affixed to a recess in the inner surface 142 of float 140.

As best seen in FIGS. 15, 22, 23 and 25, the inside 124 of outer wall 118 of support 112 is fitted with vertical guiding plates 154 for guiding float 140 vertically upward in chamber 130. Alternatively, guiding plates 154 may be placed on the outside 128 of inner wall 120.

Figure 19:
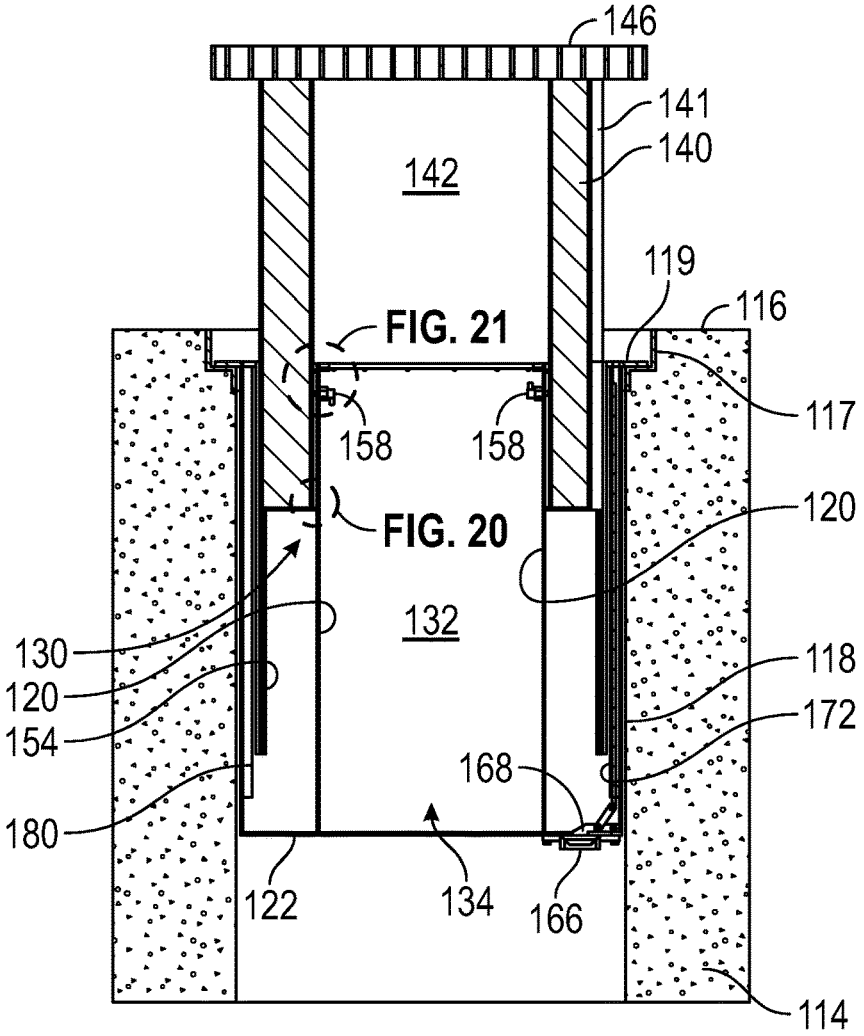
Figure 20:
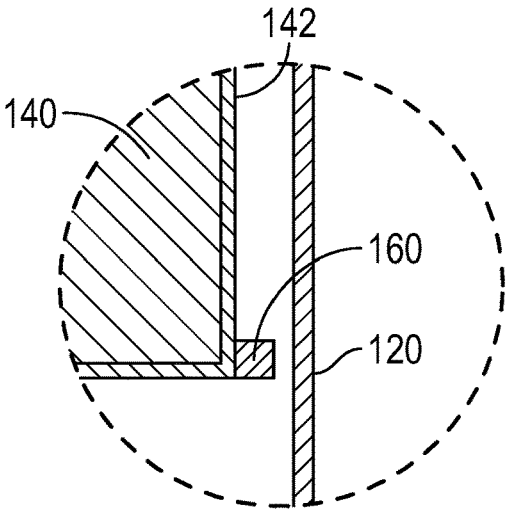
Figure 21:
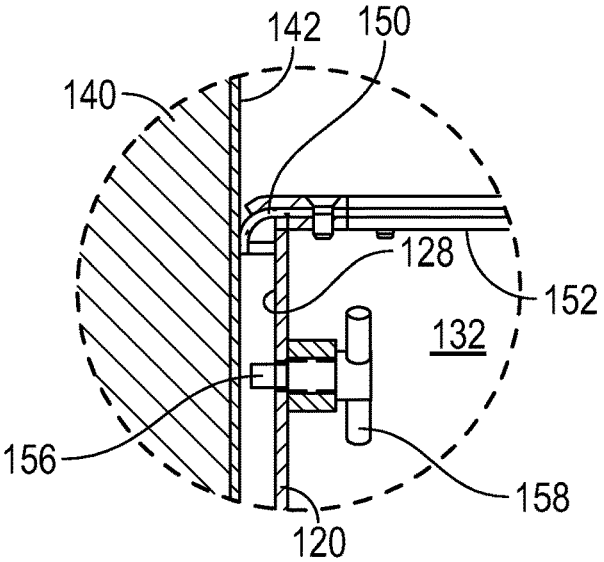

As best seen in FIG. 21, a stop 156 is located on outside 128 of inner wall 120 of support 112. In FIG. 21, stop 156 is the end of a stopper screw 158 adjustably extending through inner wall 120. As shown in FIGS. 18, 19, 26 and 28, more than one stop 156 may be located on outside 128 of inner wall 120. Referring to FIG. 20, the inner surface 142 of float 140 has a companion member projection 160 for each stop 156 which each stop 156 can contact to prevent rise of float 140 out of chamber 130.

Referring to FIGS. 15, 22, 23, and 27, the outer surface 144 of float 140 has a notch 141 along its vertical height. Referring to FIGS. 15, 16, 18, 19, 26 and 28, drain 164 is located beneath notch 141 in floor 122. Drain 164 comprises an aperture 166 and a plug 168 remotely moveable to open or close aperture 166 by actuation of a handle 170 linked by a rod 172 connected to plug 168, handle 170 being accessible from a top of notch 141. Rod 172 is received at least in part in notch 141 and prevents rotation of float 140 in chamber 130.

Figure 22:
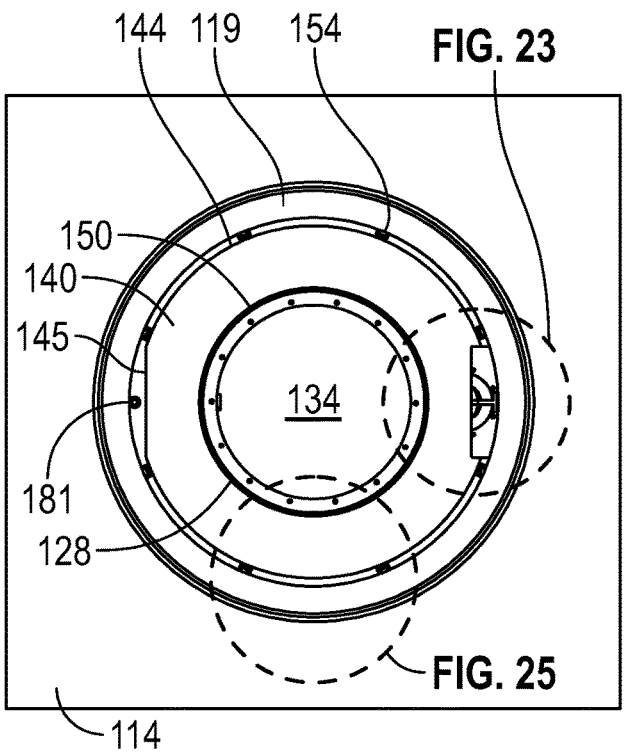
Figure 24:
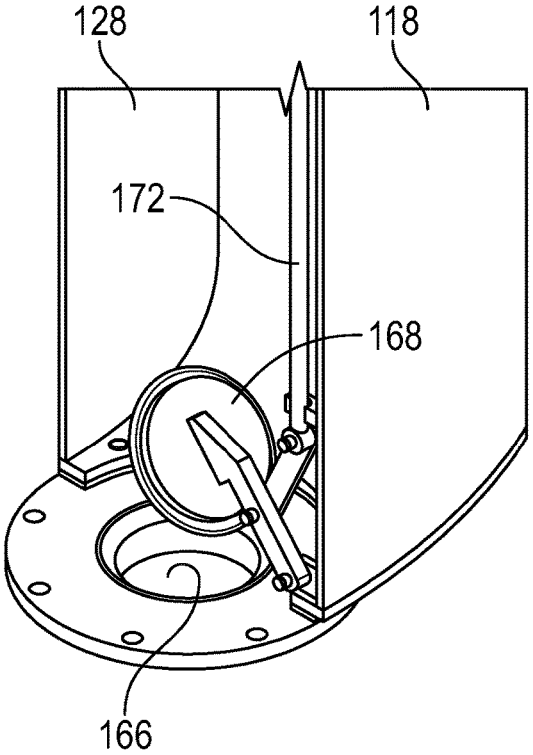
Figure 23:
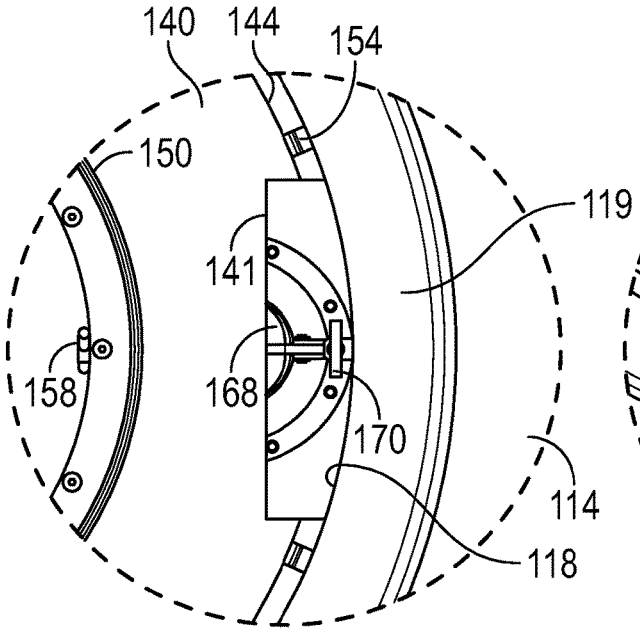
Figure 25:
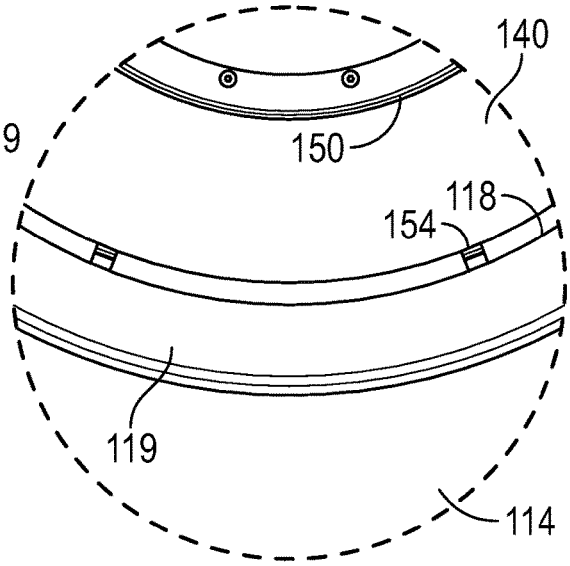
Figure 26:
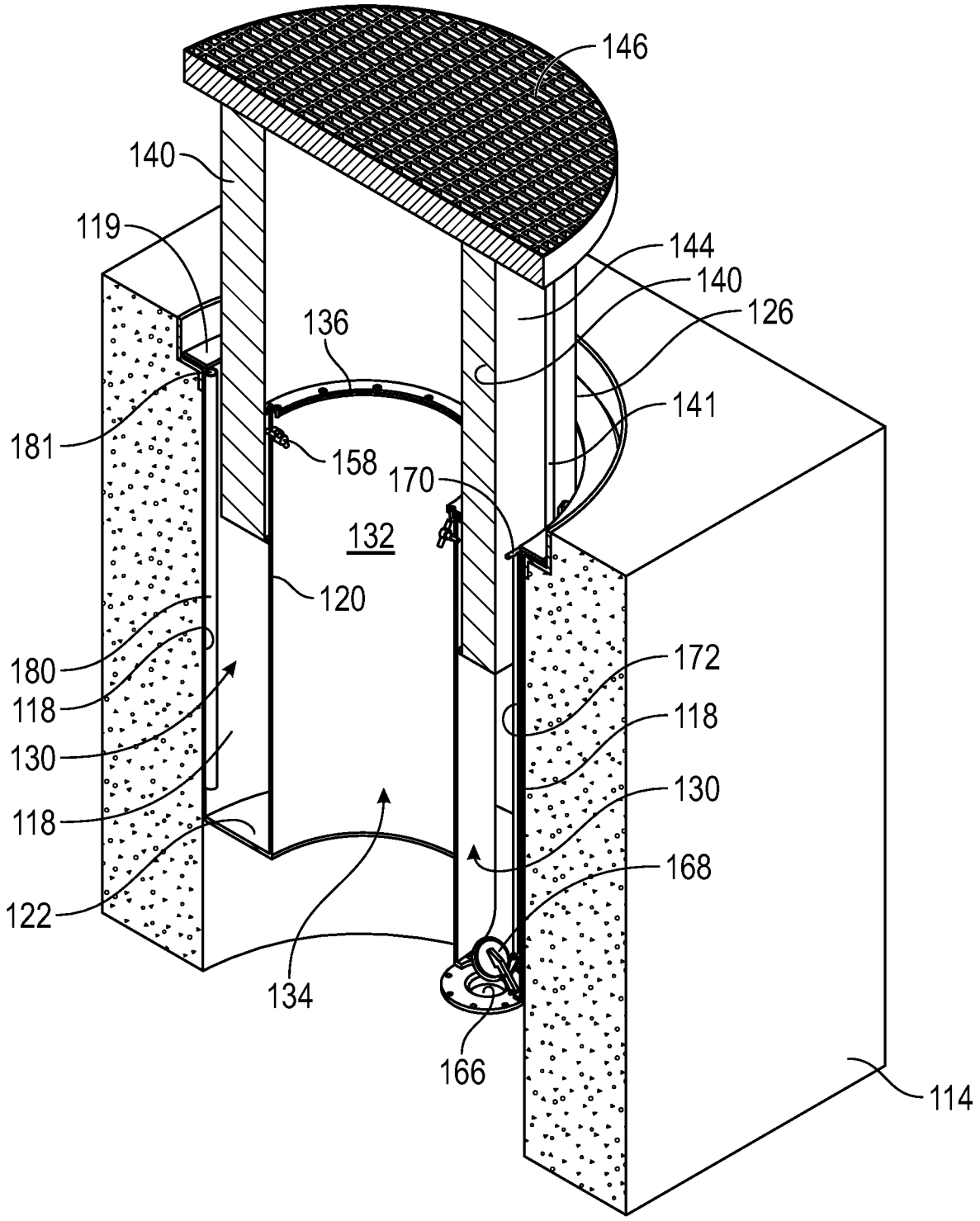
Figure 27:
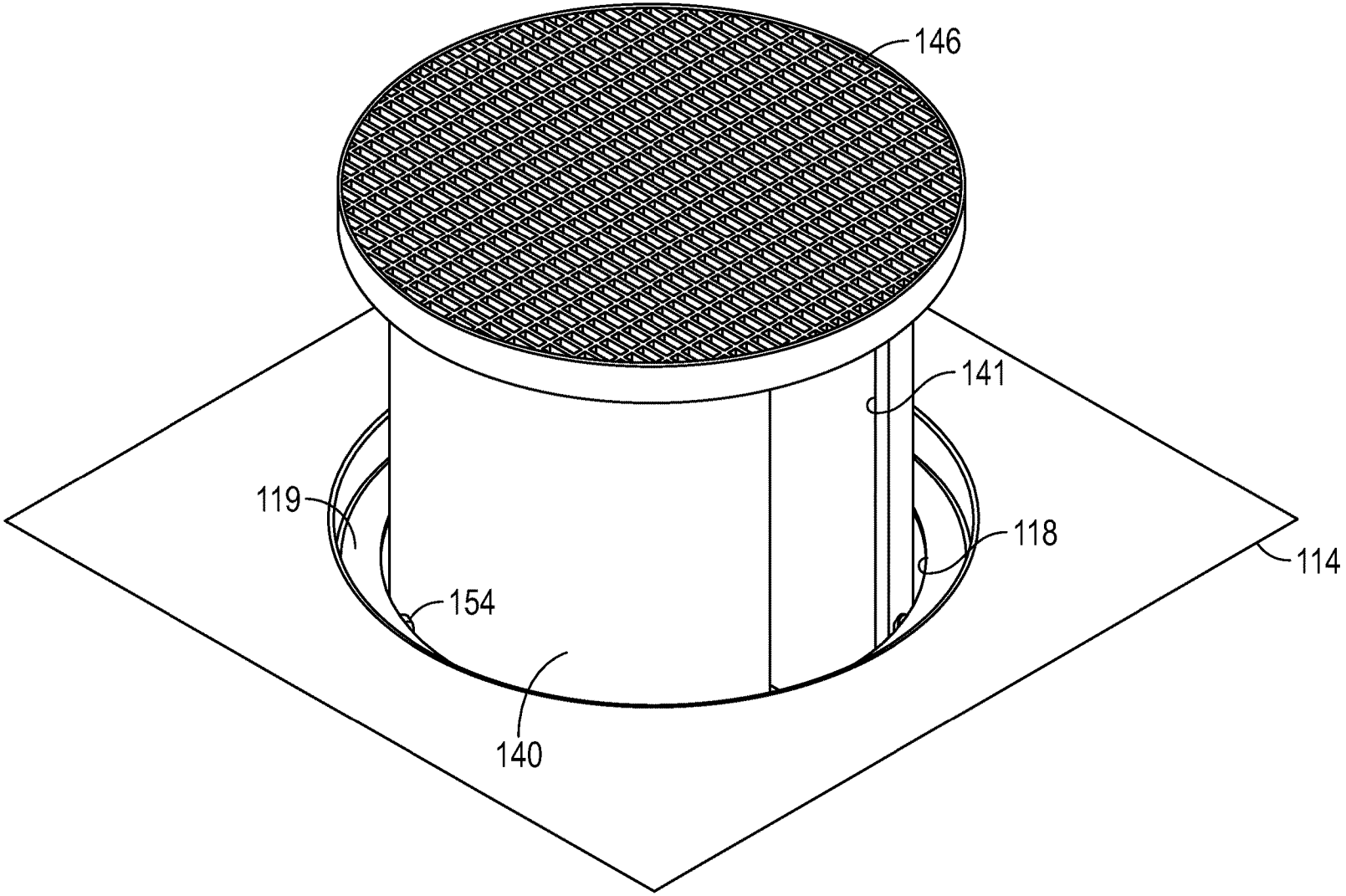

Referring to FIGS. 15 and 22, outer surface 144 of float 140 has a vertical planar portion 145 within which a secant connects two points on the circular outer surface of the float, such portion 145 of outer surface 144 of float 140 being located on the circumference of the outer surface 144 of float 140 distal from notch 141 on the outer surface 144 of float 140. The top of such vertical planar portion 145 is a flush port providing access to a hollow tube 180 having an upper end 181 adjacent the flush port for connection of upper end 181 to a flush water system to direct flush water into chamber 130. As best seen in FIGS. 19, 26 and 28, tube 180 extends into chamber 130 above floor 122 sending flush water to the bottom of chamber 130 to remove debris from chamber 130 for drainage though drain 164 located in floor 122.

Referring now to FIGS. 29-43, exemplary embodiments are depicted that don't require the buoyant float to lift the entire heavy grating as in the embodiments of FIGS. 1-28. The grating is bipartite, a portion of the grating covering the ventilation passageway being affixed adjacent the top opening of the interior of the inner wall of the support and not rising when the float is elevated in the chamber by surface water entering the chamber. Another portion of the grating is affixed to the float as in the embodiments of FIGS. 1-28 and rises with the float. This elimination of the part of the grating that the float lifts reduces the weight the float has to raise, allowing a reduction in float size, which allows a larger ventilation passageway airflow area. When the float is resident in the chamber, the grating affixed adjacent the top opening of the interior of the inner wall of the support and the grating attached to the float present the appearance of a single grating unit.

Figure 29:
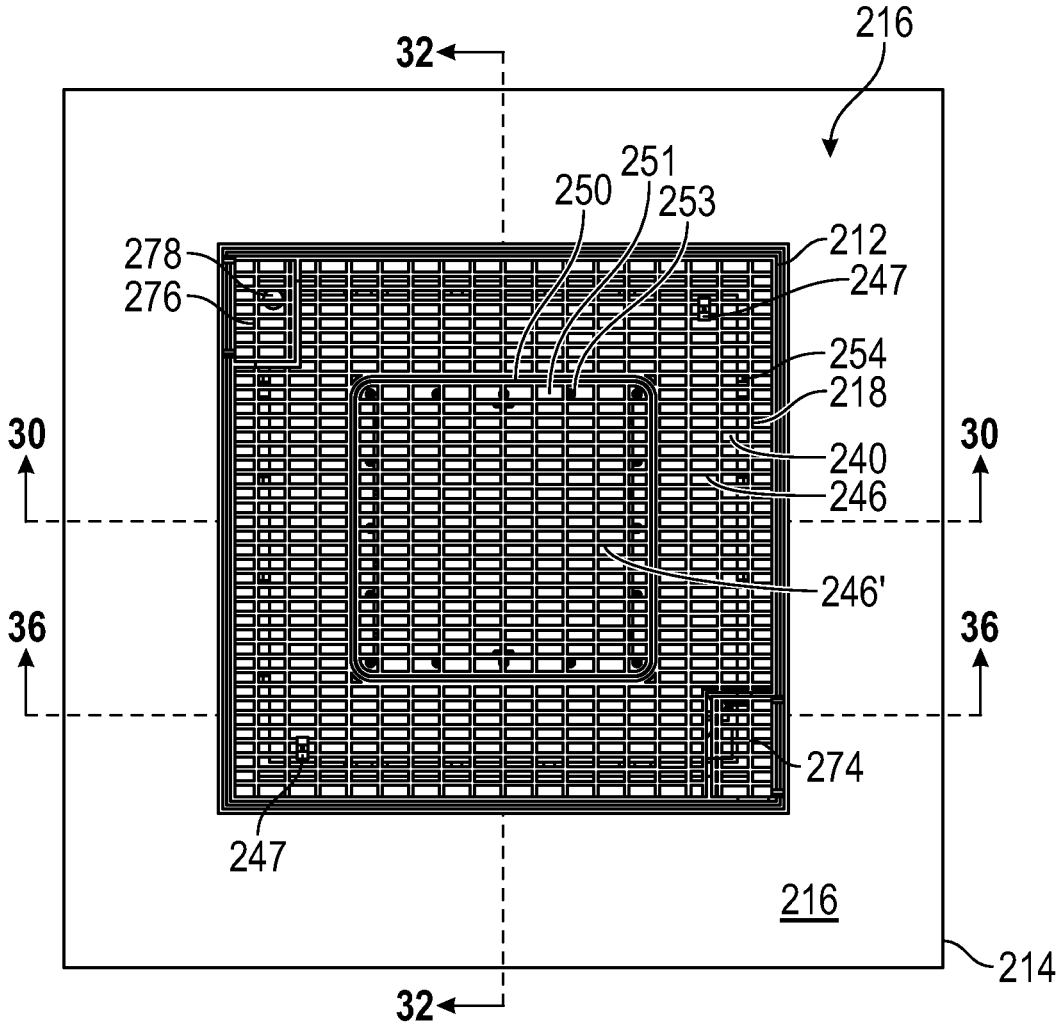
FIGS. 29-43 relate to apparatus similar to that of FIGS. 1-13 but in which only some of the grating is affixed to the float, not the portion of the grating covering the ventilation passageway. Reference numbers in FIGS. 29-43 that indicate elements functioning like the elements in the embodiments in FIGS. 1-13 carry the same number as in FIGS. 1-13 increased by 200. For example, reference numeral 14 in FIGS. 1-13 is numeral 214 in FIGS. 29-42.
Figure 39:
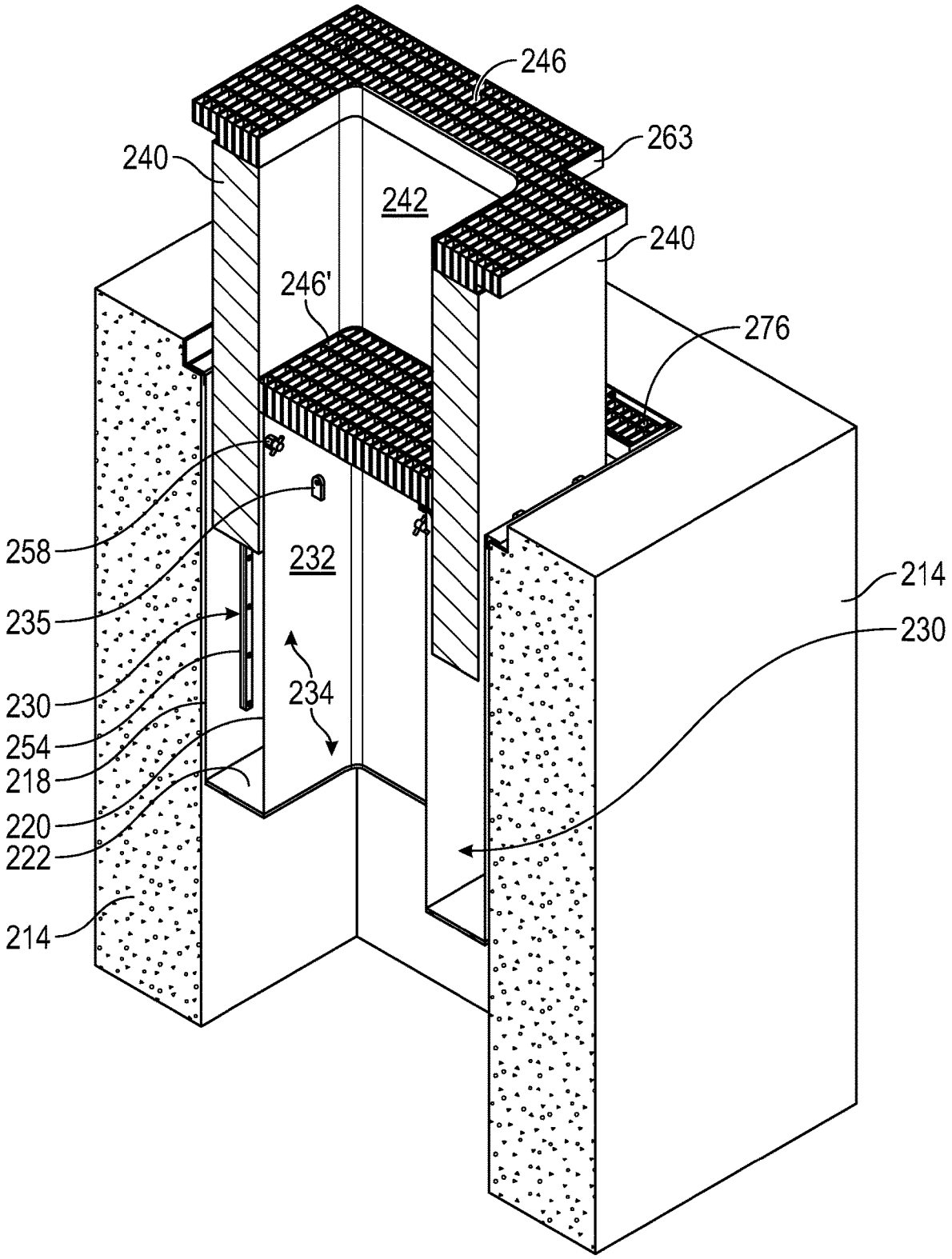
Figure 40:
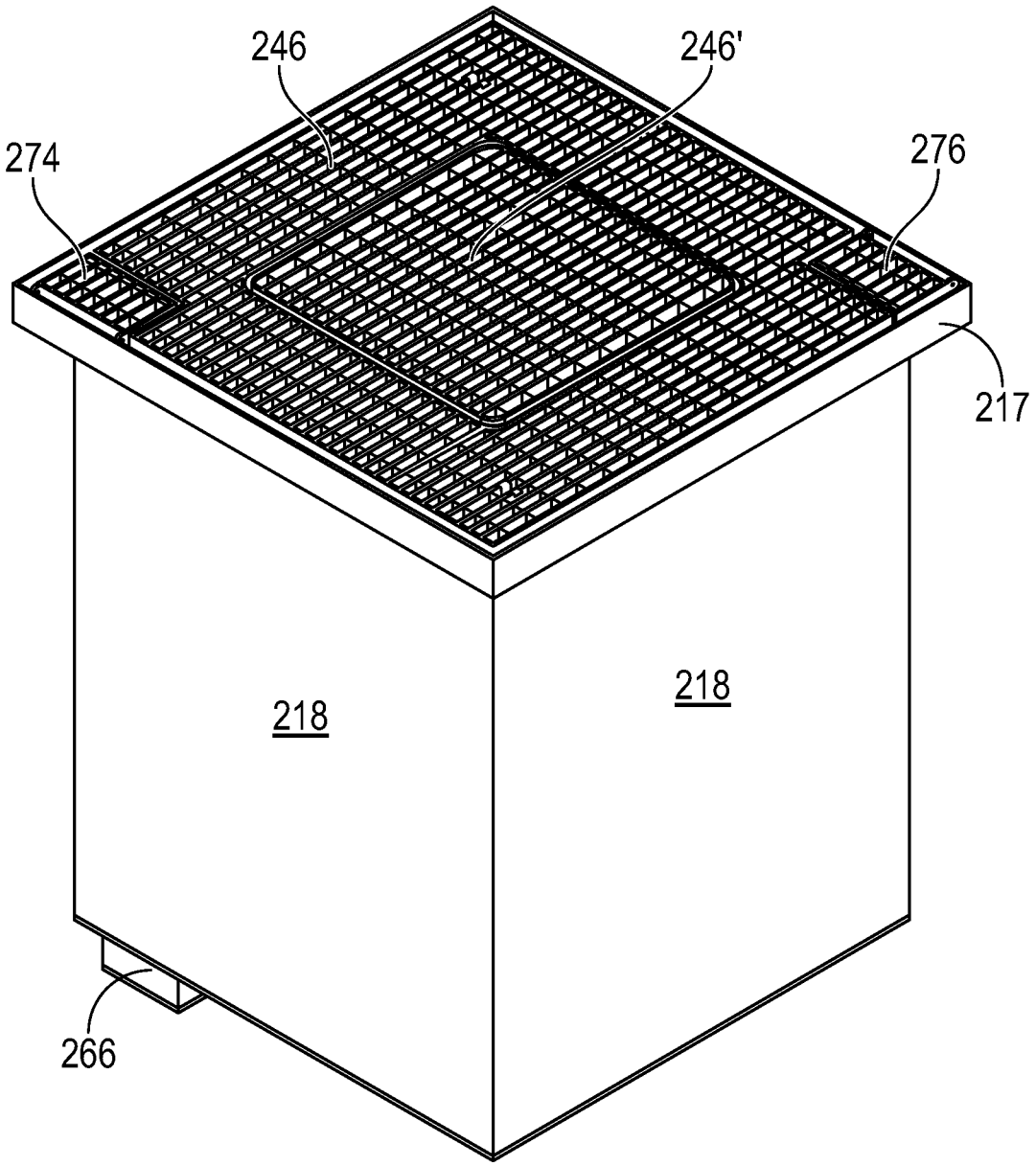
Figure 41:
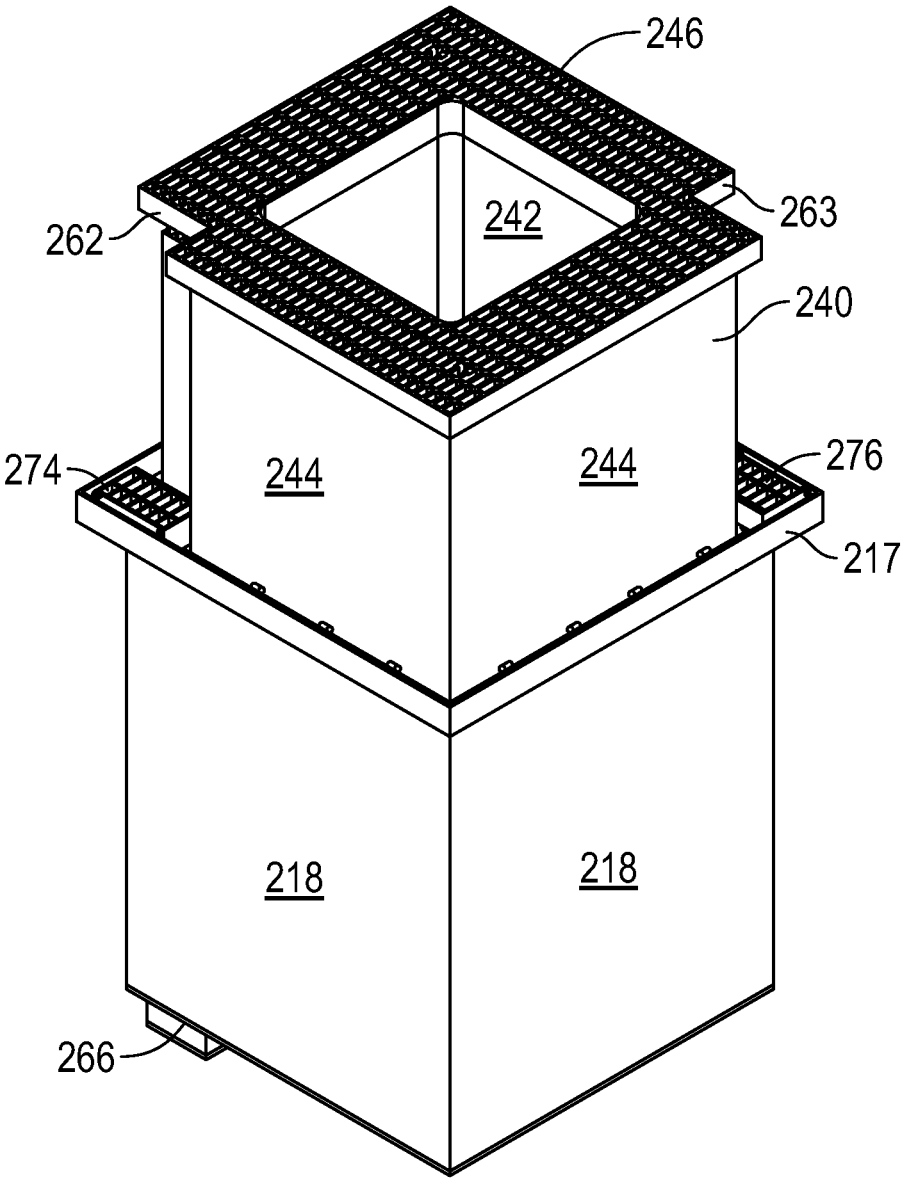
Figure 42:
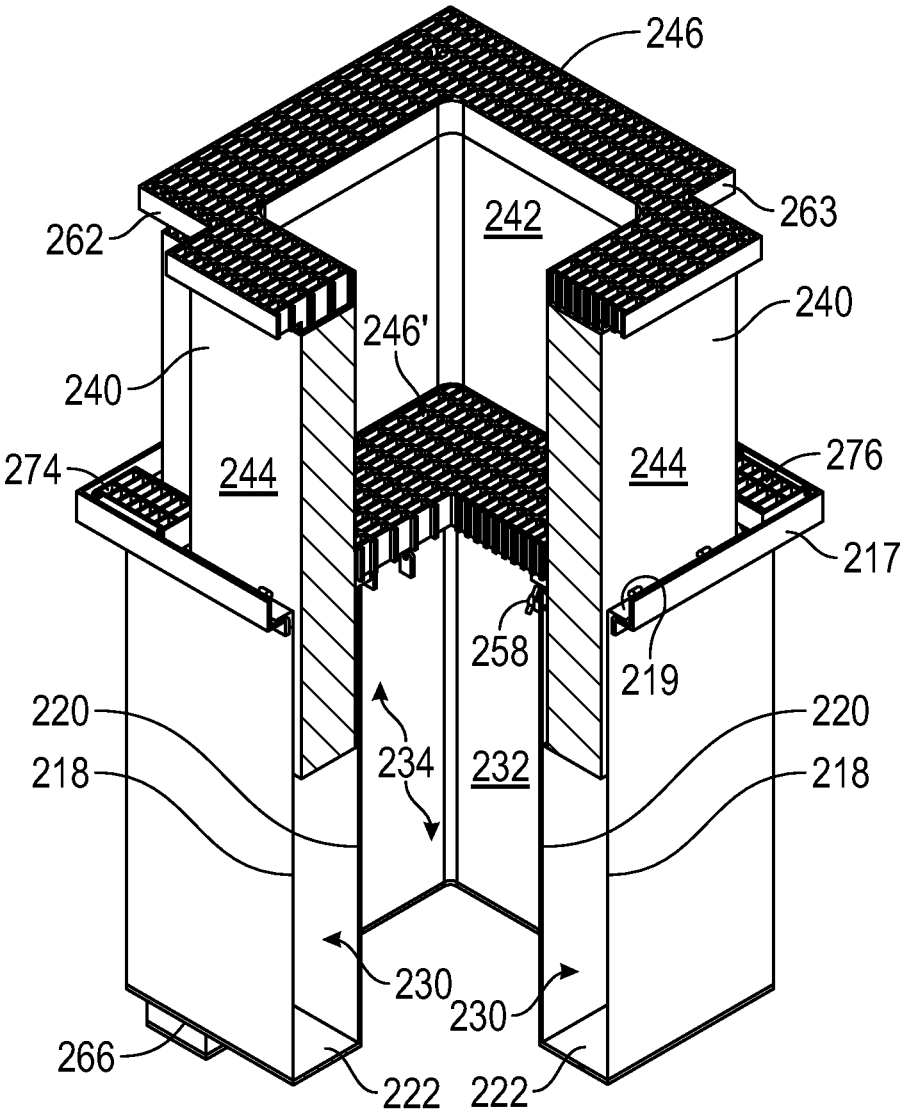
Figure 43:
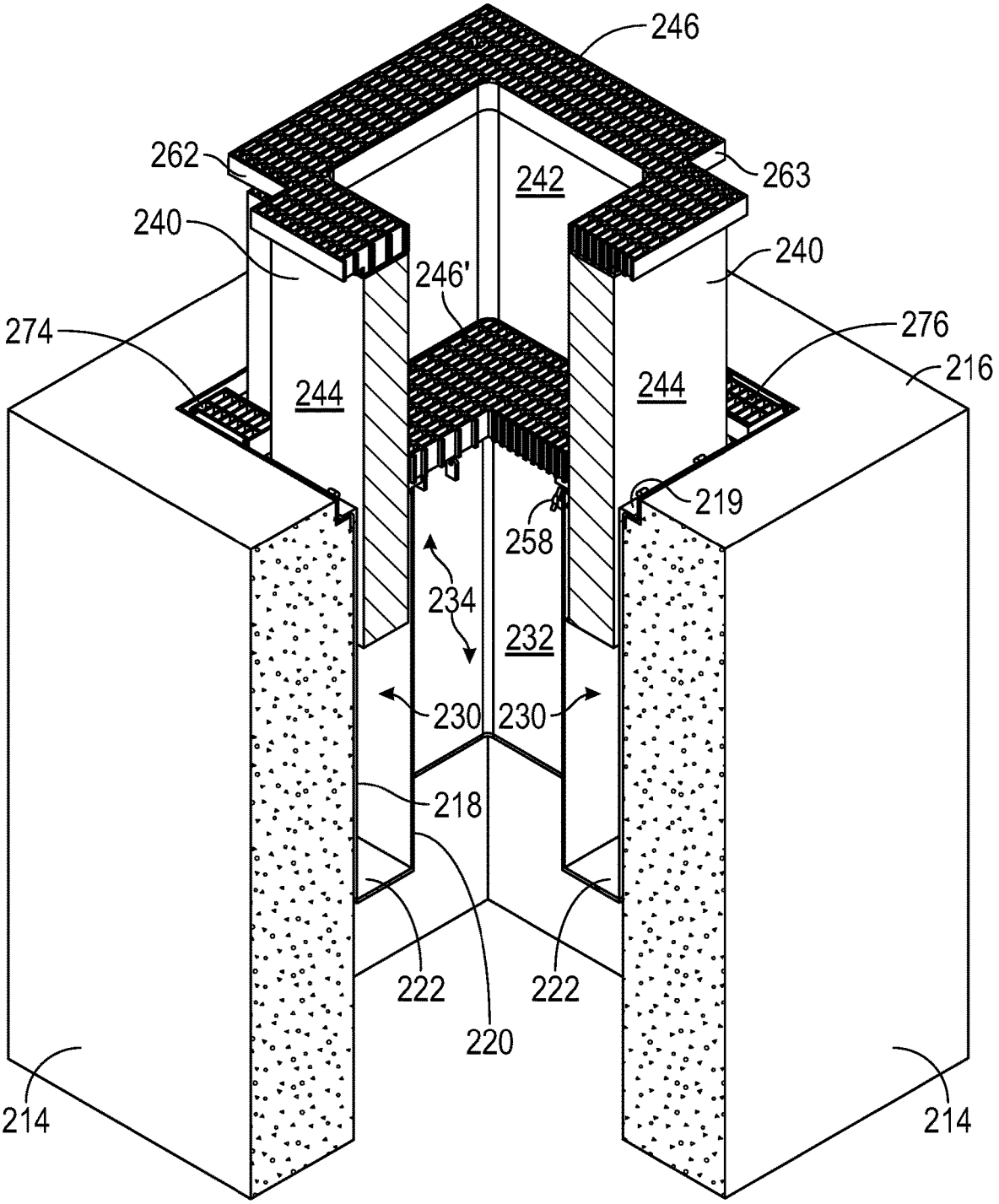
Figure 44:
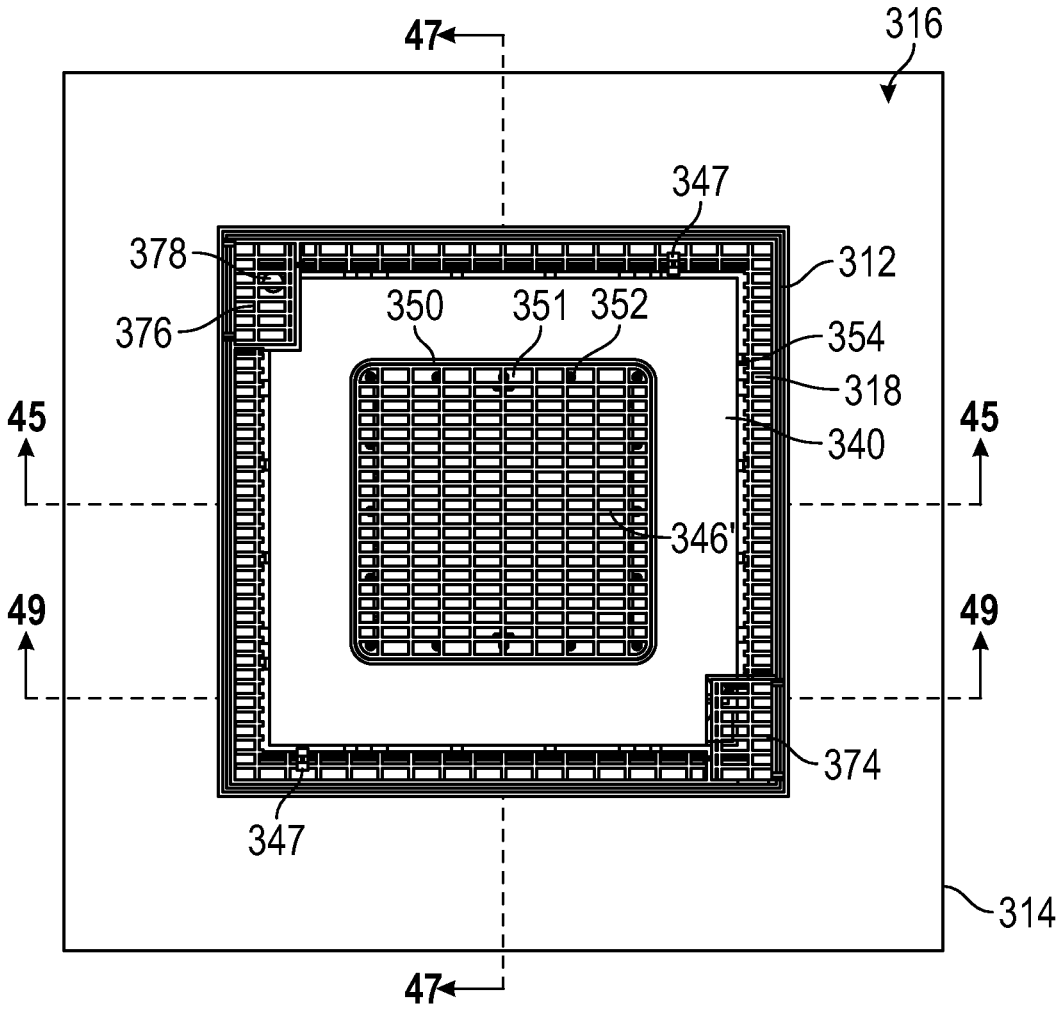
FIGS. 44-58 relate to apparatus similar to that of FIGS. 1-13 and 29-43 but in which no portion of the grating is affixed to the float, the grating covering only the ventilation passageway. Reference numbers in FIGS. 44-58 that indicate elements functioning like the elements in the embodiments in FIGS. 1-13 carry the same number as in FIGS. 1-13 increased by 300. For example, reference numeral 14 in FIGS. 1-13 is numeral 314 in FIGS. 44-58.

FIGS. 29-43 depict an embodiment in which, as in the exemplary embodiment of FIGS. 1-13, the ventilation shaft, the support, the chamber and the float are rectilinear and four-sided or quadrilateral (rectilinear float 240 is seen to be four-sided in, e.g., FIG. 44 where the grating over the float is absent and in FIGS. 40-42). In FIG. 29, reference numeral 210 indicates apparatus for preventing downward flow of ground surface water into an underground ventilation duct fluidly communicating through a ventilation shaft to an atmospheric opening of the shaft while maintaining atmospheric ventilation to the underground ventilation duct. FIG. 29 is a top plan view of an exemplary embodiment of a four-sided rectilinear support 212 in the form of a four-sided box vertically suspended within a vertical rectilinear four-sided ventilation shaft 214 from a top 216 of shaft 214. As explained above for the limited purpose of orientation of the views of drawings, to the reader's left is "west," to the reader's right is "east," at the top between west and east is "north," and to the bottom between west and east is "south." Thus the top left corner is a northwest corner and the bottom right corner is a southeast corner.

Figure 30:
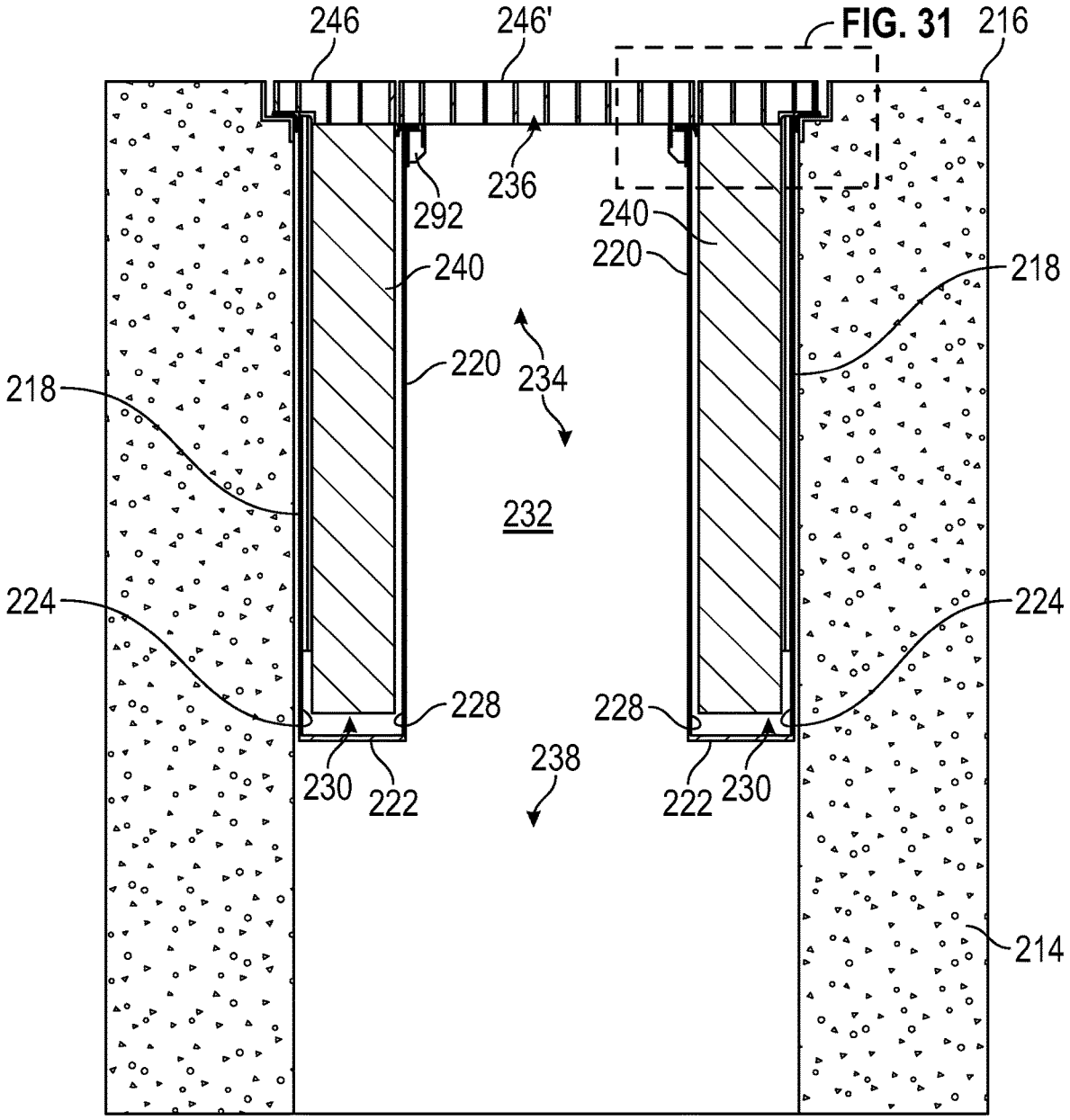
Figure 32:
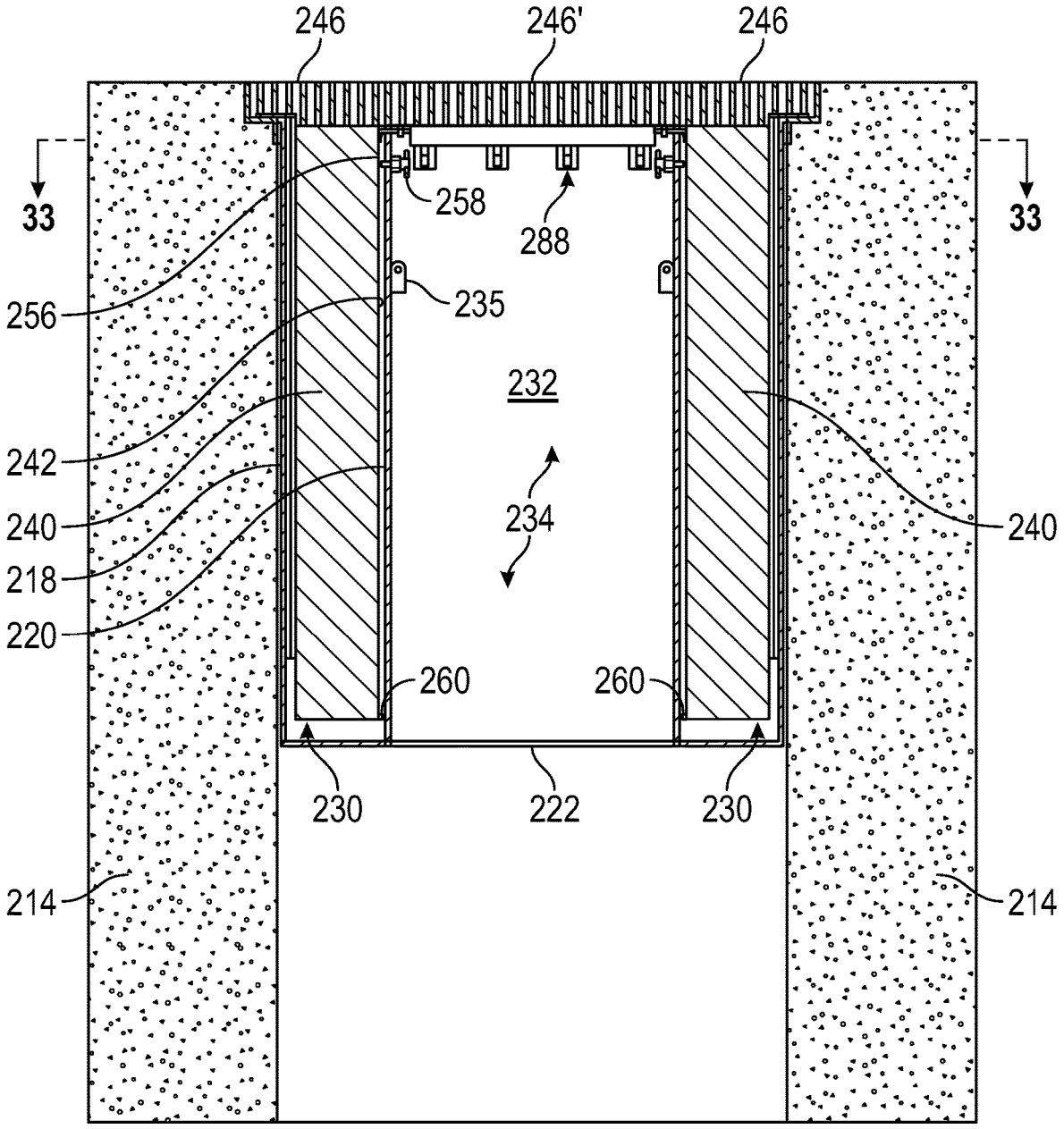
Figure 36:
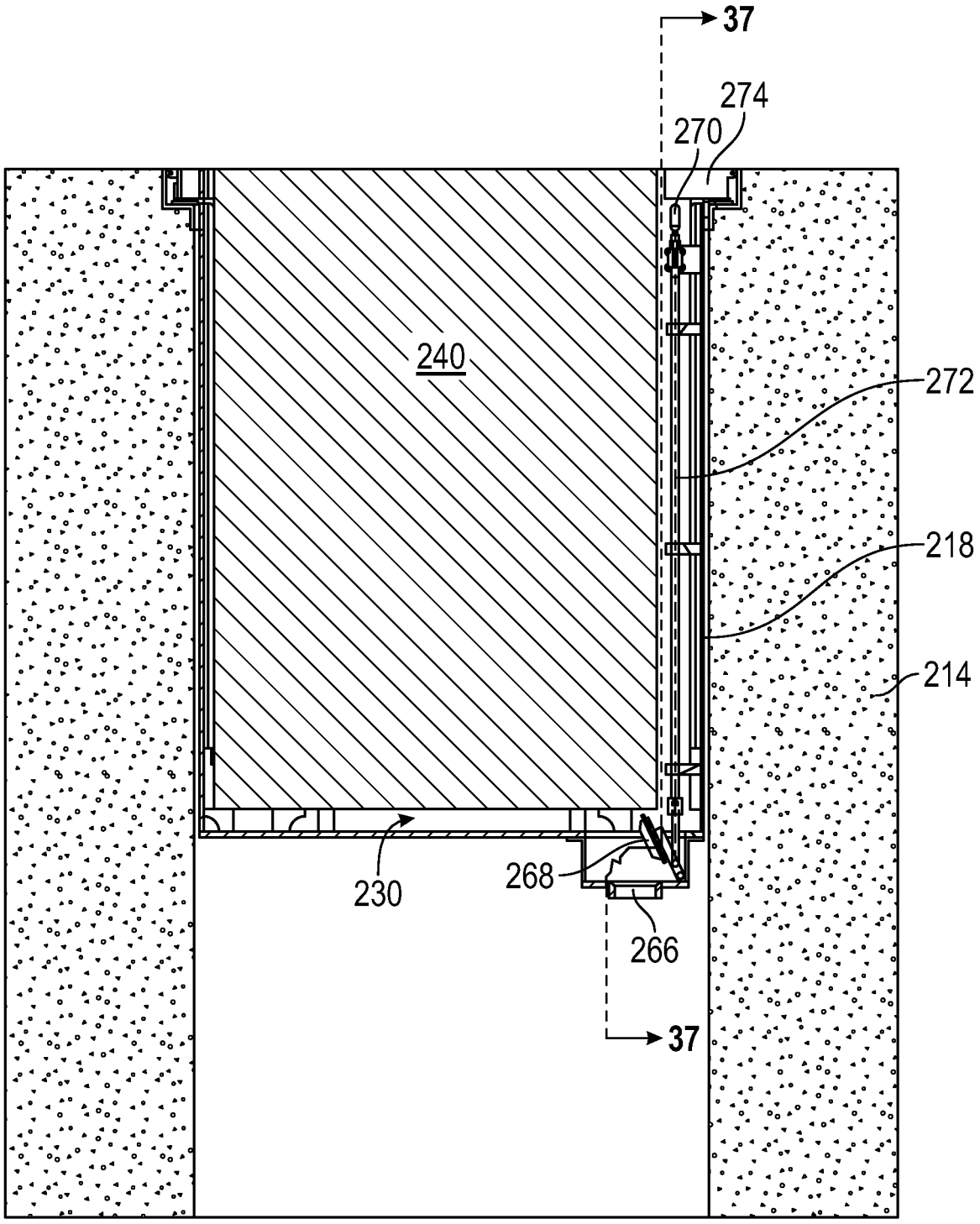

FIG. 29 indicates the direction of vertical sectional views for FIGS. 30, 32 and 36. The sectional line 30-30 looks north from the middle of support 212. The sectional line 32-32 looks west from the middle of support 212. The sectional line 36-36 looks north from a sectional line cutting into the south side of float 40.

Figure 31:
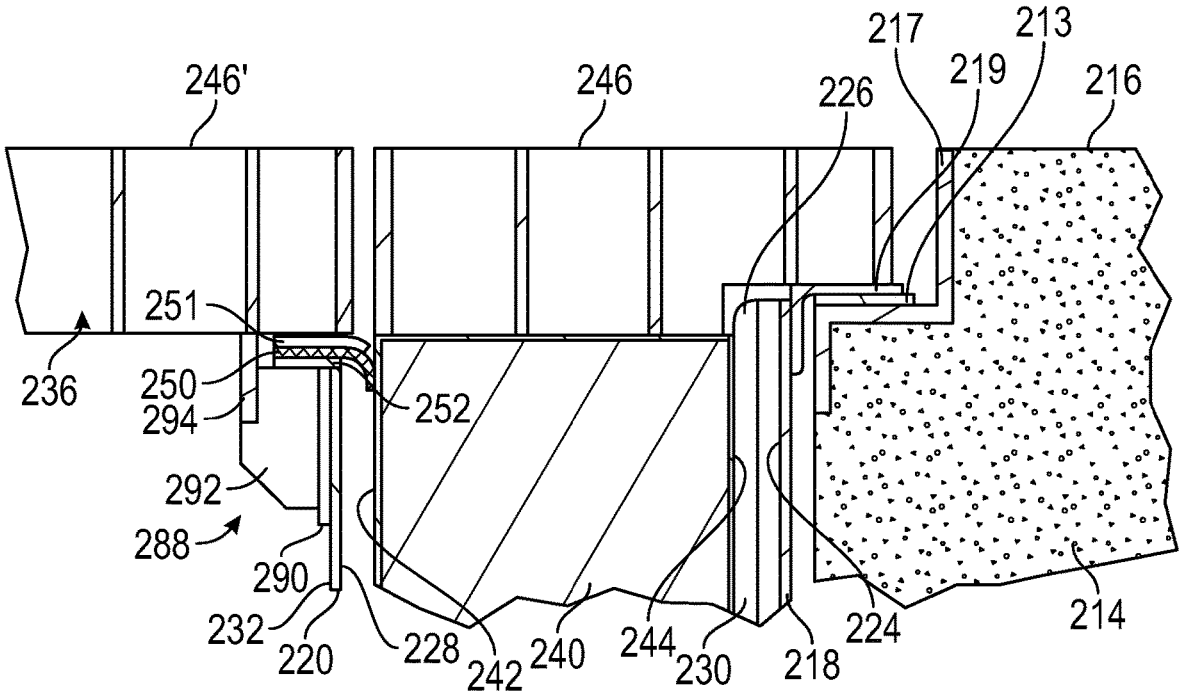

Referring to FIG. 31, a detail enlargement of the encircled portion of FIG. 30, the top 216 of ventilation shaft 214 has an inset ledge 217. Outer wall 218 of support 212 has transverse flanges 219 at an upper extent thereof. Flanges 219 rest on ledge 217 to hang support 212 in shaft 214. An elastomeric spacer 213 separates flanges 219 from ledge 217 preventing electrolytic corrosion. The interior (inside) 224 of outer wall 218 has a top opening 226 to the atmosphere through openings in grating 246 attached to float 240.

Referring to FIG. 30 as well as FIG. 31, support box 212 has a rectilinear vertical outer wall 218 adjacent vertical shaft 214 and a rectilinear vertical inner wall 220 spaced from outer wall 218, with a bottom floor 222 connecting a bottom of the outer wall 218 and a bottom of the inner wall 220 of support box 212. Space between the interior (inside) 224 of outer wall 218 and the exterior (outside) 228 of inner wall 220 defines a rectilinear vertical four-sided chamber 230 for receipt of ground surface water entering from the top opening 226 of outer wall 218. Four-sided float 240 is vertically housed in chamber 230. The vertical sectional along the lines 30-30 looks north producing FIG. 30, and bisects chamber 230 and the housed four-sided float 240 and shows the east segment of float 240 (on the readers right) and the west segment of float 240 (on the readers left), and to their rear reveals the north interior (inside) 232 of the inner wall 220 of support box 212. Rectilinear vertical interior (inside) 232 of the inner wall 220 defines a four-sided ventilation passageway 234 having a top opening 236 to the atmosphere through openings in grating portion 246' and a bottom opening 238 to ventilation shaft 214 for fluid communication through the ventilation shaft 214 to the underground ventilation duct and the atmospheric opening 236. Floor 222 connecting the bottom of outer wall 218 and the bottom of inner wall 220 of box 212 surrounds bottom opening 238 of ventilation passageway 234. Grating 246' is unconnected to grating 246 on float 240. Float 240 has a vertical inner surface 242 adjacent the exterior (outside) 228 of inner wall 220 and a vertical outer surface 244 adjacent the interior (inside) 224 of outer wall 218.

Figure 38:
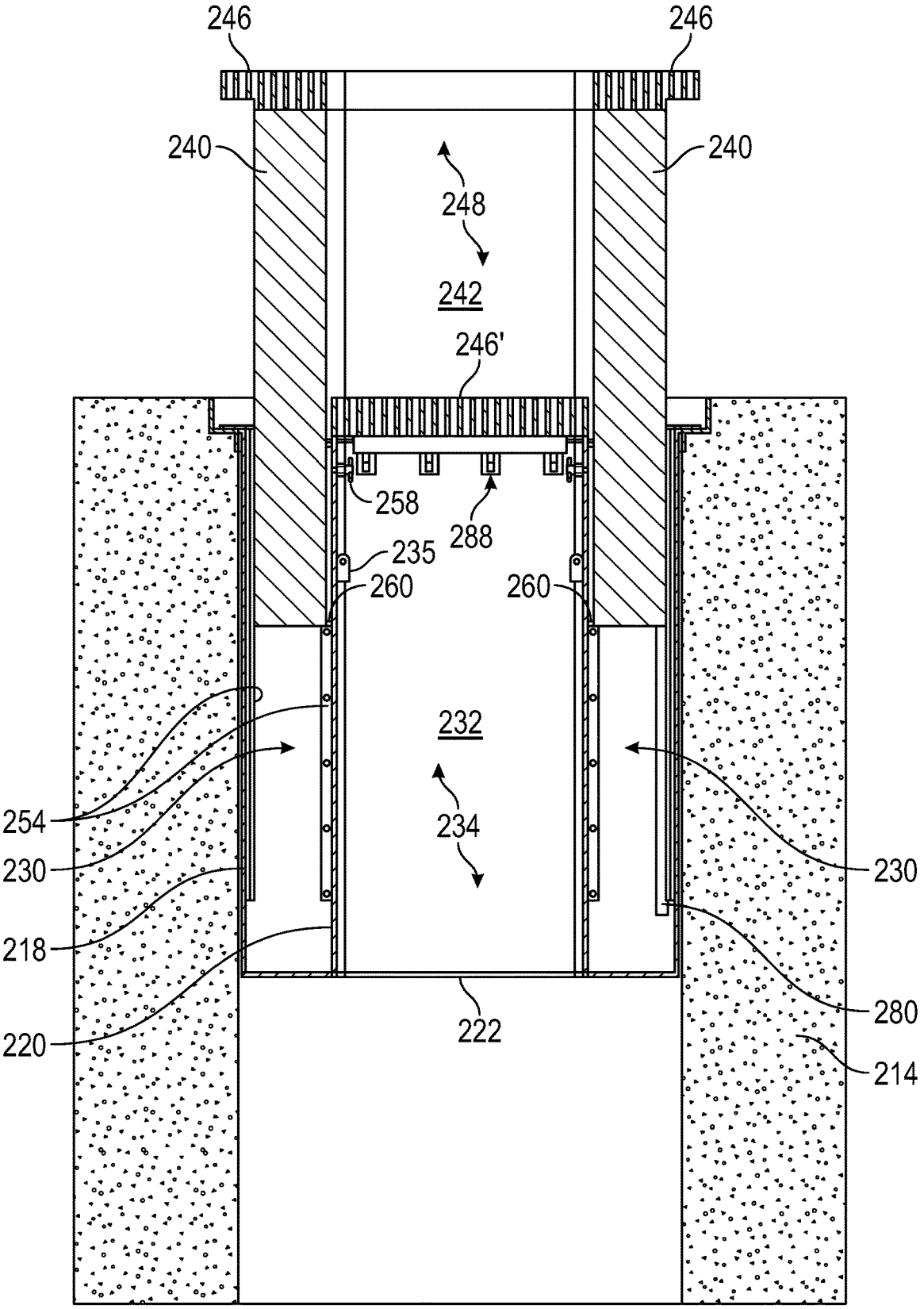

Referring to FIG. 32 the vertical sectional along the north-south lines 32-32 looking west produces FIG. 32 which bisects the four-sided float 240, so FIG. 32 shows the south part of chamber 230 and float 240 (on the readers left) and the north part of chamber 230 and float 240 (on the readers right), and to their rear reveals the west interior (inner) side 232 of the inner wall 220 of support box 212. FIGS. 38 and 39 similarly are sectioned along the same north-south lines 32-32 looking west.

Figure 34:
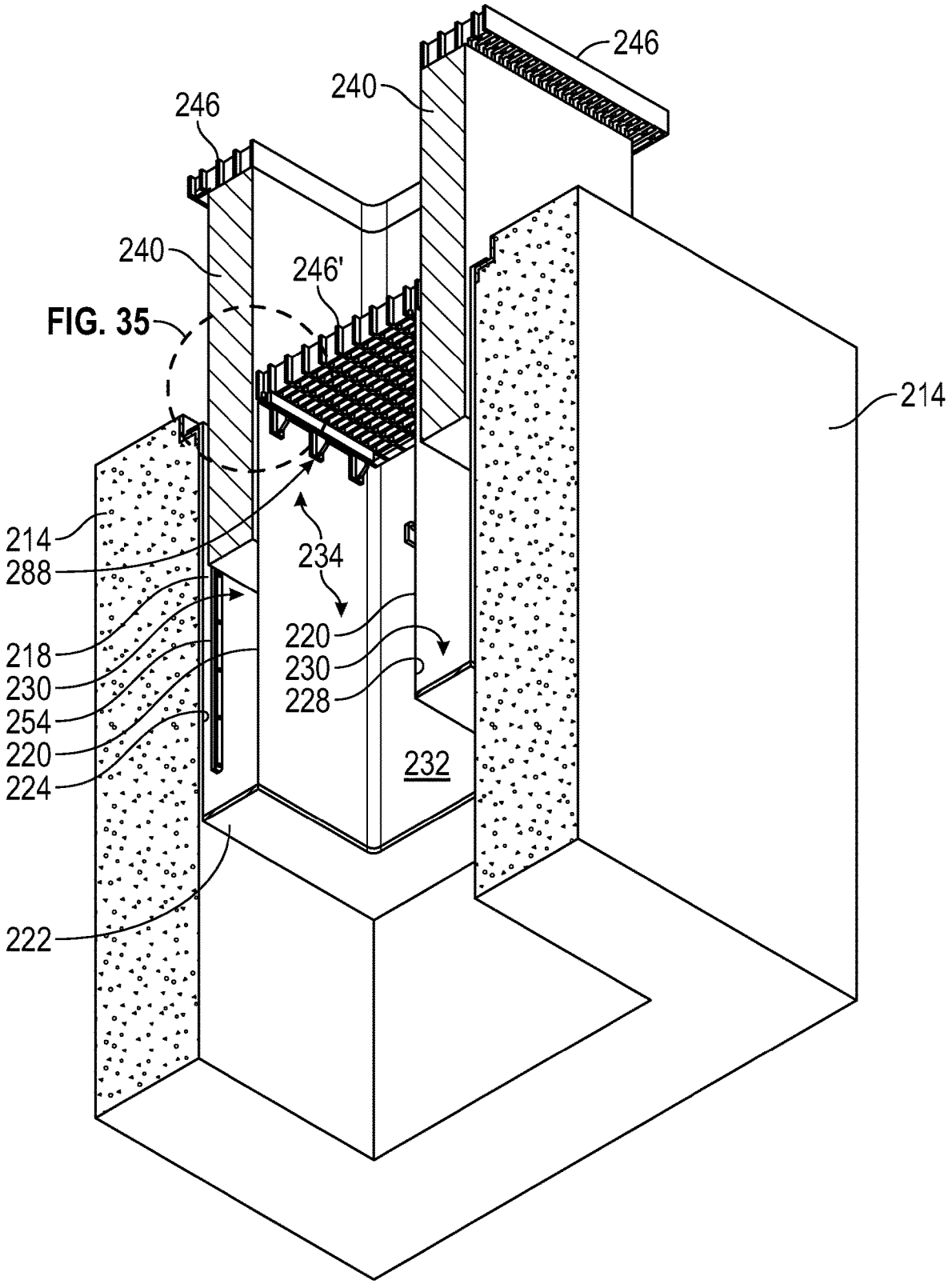
Figure 35:
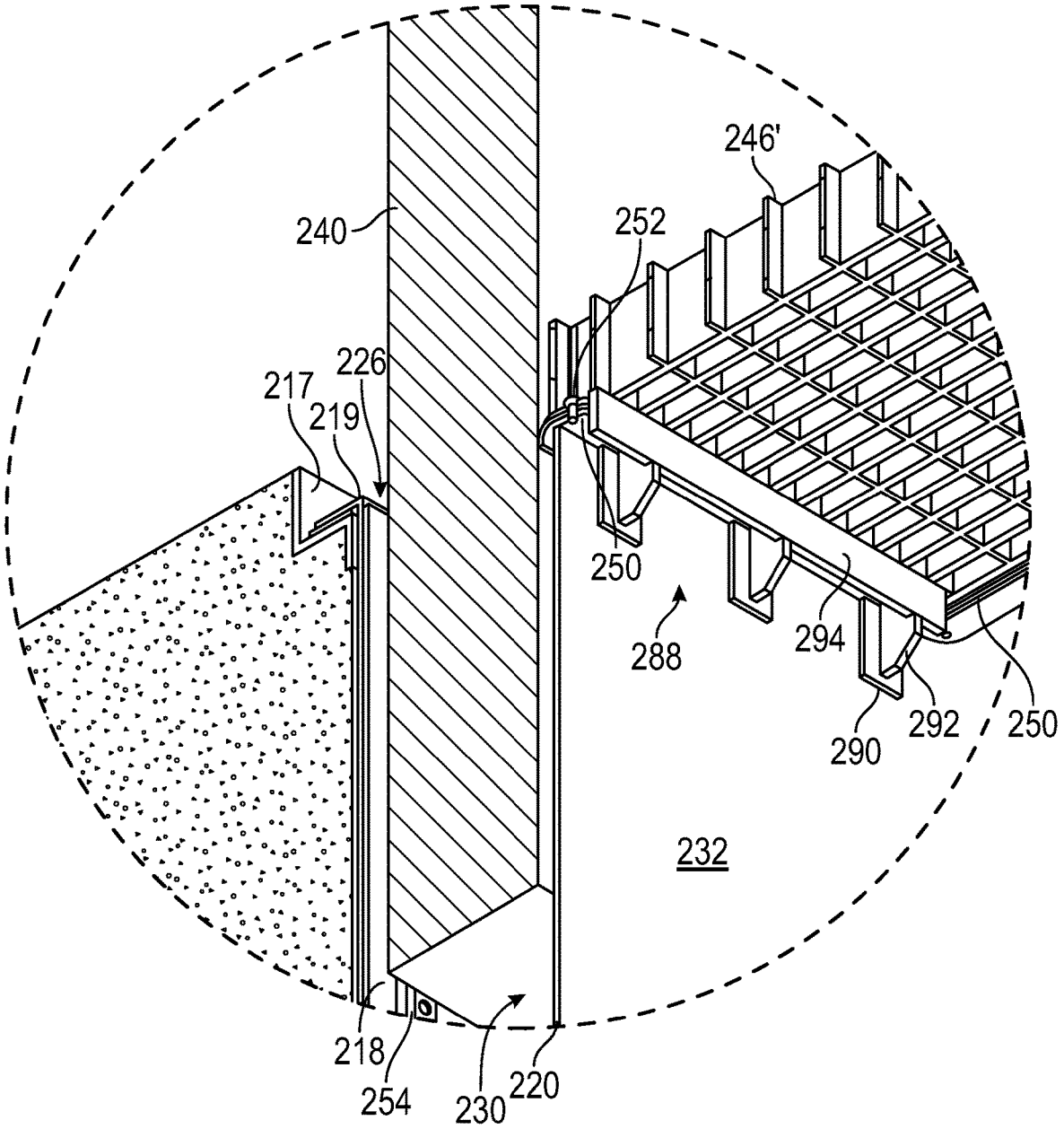

Referring to FIGS. 29-32, a grating 246' covers ventilation passageway 234 allowing fluid communication between atmosphere and ventilation passageway 234. A sectional line 33-33 in FIG. 32 produces FIG. 33, a top cross-sectional view below covering gratings 246, 246' and reveals structure 288 on the east and west interior 232 of inner wall 220 for supporting grating 246' affixed adjacent the top opening of the interior of the inner wall of box support 212. FIG. 34 is a perspective vertical sectional view from a bottom angle of the apparatus of FIGS. 29-33 sectioned along the same sectional lines as FIG. 30. FIG. 35 is a detailed perspective of structure 288. Grating 246' is supported atop a rail 294 supported by ears 292 attached to plates 290 fixed to upper extent 252 of the west interior (inner) side 232 of inner wall 220 of support box 212. Grating 246' is suitably affixed to rail 294 by straps or clips (not shown), and the grating holddowns of U.S. Pat. No. 10,619,884 can be used with a substitution of a horizontal shelf for rail 294. FIG. 31 shows a detail end view of support 288 for grating 246'. FIG. 32 shows a frontal view of support 288 on the west interior (inner) side 232 of inner wall 220. Separate grating 246 is affixed atop float 240 by fasteners 247 (see, e.g., FIG. 29).

In an exemplary embodiment, see FIGS. 30-31, grating 246 affixed atop float 240 extends over the flanges 219 of outer wall 218 on ledge 217 of shaft 214 and suspends float 240 sufficiently spaced above floor 222 that surface water entering chamber 230 from the top opening 226 of outer wall 218 can flow under float 240 and buoy float 240 upwardly in chamber 230. Rise of water in chamber 230 buoying float 240 upward in chamber 230 elevates float 240 and affixed separate grating 246 above the ground surface water, blocking surface water from entering the ventilation passageway 234 through grating 246', ventilation passageway 234 of support box 212 remaining open to atmosphere through grating 246'. FIGS. 34, 38-39 and 41-43 depict float 240 and affixed separate grating 246 in an elevated position that prevents surface water from flowing through grating 246' into ventilation passageway 234 thence though ventilation shaft 214 to an underground ventilation duct while maintaining atmospheric ventilation to the underground ventilation duct through ventilation passage 234 of support box 212.

As was shown in FIGS. 8 and 10 and is shown also in FIG. 29 and particularly in FIG. 31, in an exemplary embodiment an upper extent 252 of inner wall 220 of support box 212 has a gasket 250 affixed to it held in place by holder 251 secured by fasteners 253. Gasket 250 extends over exterior (the outside) 228 of inner wall 220 sealingly against an inner surface 242 of float 240 to prevent water that has entered chamber 230 from the top opening 226 of outer wall 218 from escaping chamber 230 at such upper extent 252. As best seen in FIG. 29, gasket 250 is on all four sides of inner wall 220 of box support 212.

As in the embodiments of FIGS. 1-13, a stop 256 is located on outside 228 of inner wall 220 of box support 212. As in stop 56 of FIG. 10, stop 256 is the end of a release mechanism stopper screw 258 adjustably extending through inner wall 220. In the embodiments of FIGS. 29-43 as shown by the indications of stopper screw 258 in FIGS. 32, 33, 38, 39, 42, 43, stops 256 are located on the north and south outsides of inner wall 220. Referring to FIGS. 32, 38, 39, 42, 43, as in FIG. 9 the inner surface 242 of float 240 has a companion member plate projection 260 for each stop 256 which each stop 256 can contact to prevent rise of float 240 out of chamber 230.

Figure 33:
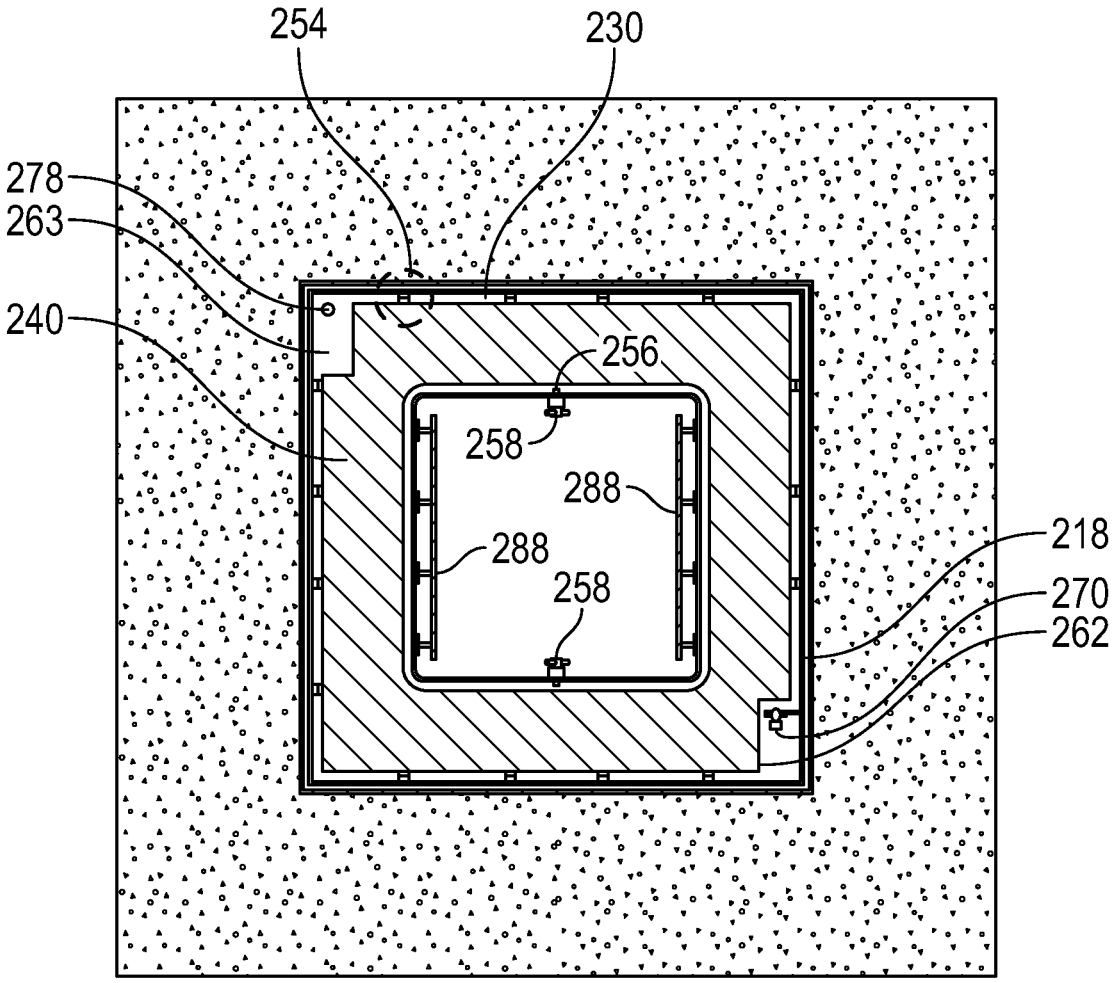
Figure 37:
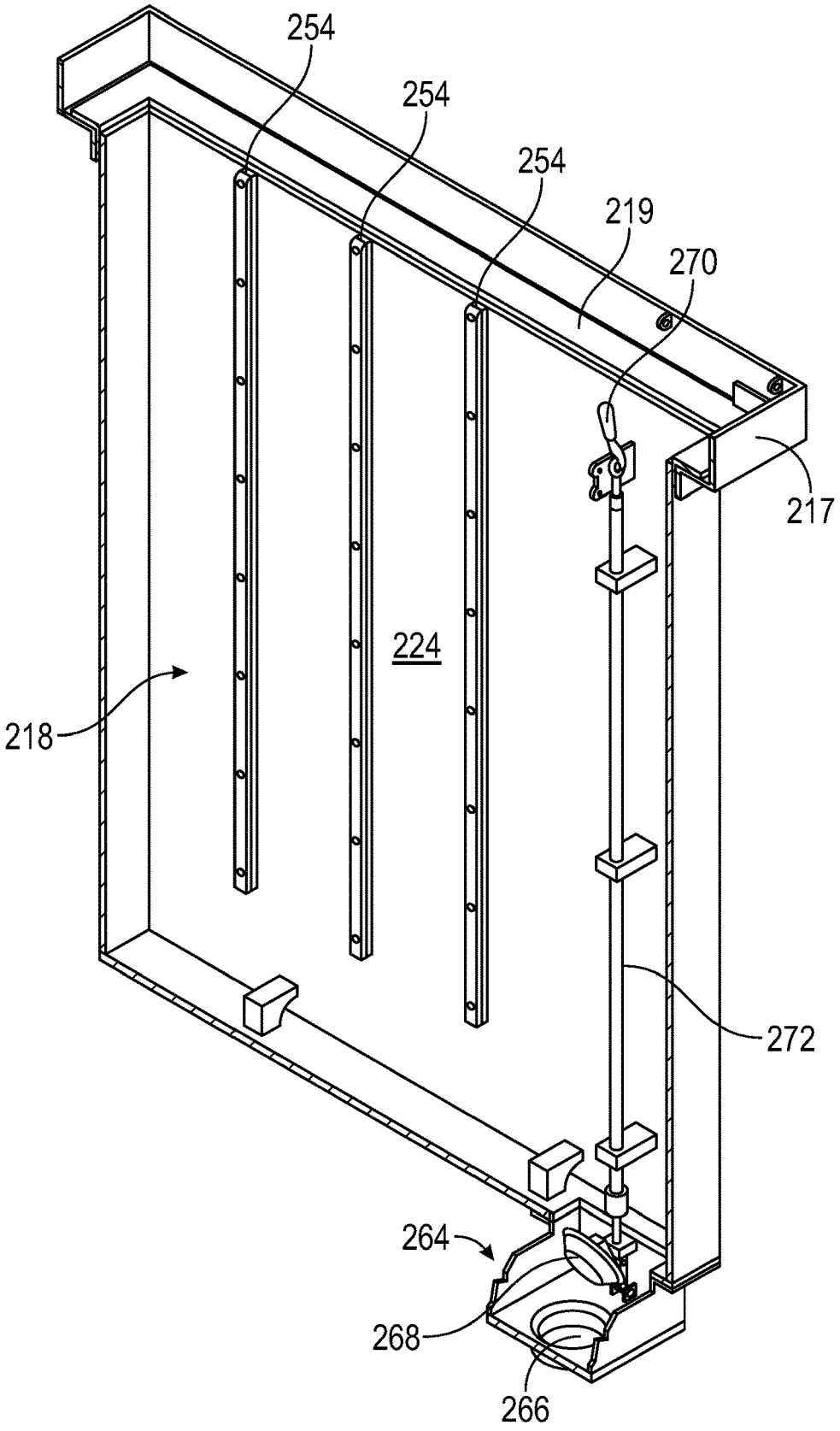

Referring to FIGS. 29, 33, 36 and 41-43, float 240 has a vertical recess 262 along the height of float 240 in a southeastern corner of the float facing the inside 224 of the south and east outer walls 218 in chamber 230. Referring to FIGS. 33, 36, 37, a drain 264 is located in floor 222 of box support 212 at a bottom of vertical recess 262. Drain 264 comprises an aperture 266 and a plug 268 remotely moveable to open or close aperture 266 by actuation of a handle 270 linked by a rod 272 connected to plug 268. Handle 270 is accessible from a top of vertical recess 262 of float 240. Referring to FIG. 29, 40-43, a liftable grating 274 separate from grating 246 is pivotally connected to the top of outer wall 218 of box 212 in the southeastern corner of support 212 above vertical recess 262 of float 240. Lifting liftable grating 274 provides access to handle 270. Plug 268 of drain 264 is shown open in FIGS. 36, 37 to illustrate aperture 266 and plug 268 but the reader will understand that plug 268 is closed in all situations when water is not being drained from chamber 230. Operatively, drain 264 is the same as drain 64 of the embodiments of FIG. 1-13

Surface water admitted into chamber 230 may carry debris. After surface water has receded and water in chamber 230 has been drained using drain 264, the debris can be removed to avoid interference with rise of float 240 in chamber 230. Referring to FIGS. 29, 33 and 41-43, float 240 has a second vertical recess 263 along the height of float 240 in the northwestern corner of the float spaced from vertical recess 262 and facing the inside 224 of the north and west outer walls 218 in chamber 230. Referring to FIG. 29, 40-43, A liftable grating 276 separate from grating 246 and pivotally connected to the top of outer wall 218 in the northwestern corner of support box 212 is liftable to provide access to a flush port 278 for admission of flush water to flush debris from chamber 230 with drain 264 open. As in FIG. 5, A hollow tube has an upper end adjacent flush port 278 and extends into chamber 230 above floor 222 for connection of the upper end to a flush water system to direct flush water into chamber 230 for drainage though drain 264 located in floor 22. Although float 240 has recess 263 in the northwest corner 278 for admission of the flush tube and has recess 262 in the southeast corner 262 for admission of the rod 272 and handle 270, thus placing the flush tube 280 and the rod 272 and handle 270 separated from each other diagonally, the placement of the vertical recesses on the float may be in other locations on the float, for example midway on opposite east and west sides of the surfaces of float 240.

As seen in FIGS. 29, 31-33, 38-39 for the outer walls 218 of support 212, the interior (inside) 224 of outer wall 218 of box 212 is fitted with vertical guiding strips 254, suitably high abrasion and wear resistant ultra-high molecular weight polyethylene strips, for guiding float 240 vertically upward in chamber 30. Alternatively, guiding strips 254 may be placed on the outside 228 of inner walls 220.

Referring now to FIGS. 44-58, exemplary embodiments are depicted that relate to apparatus similar to that of FIGS. 1-13 and 29-43 in which the ventilation shaft, the support, the chamber and the float are rectilinear and four-sided but the embodiments in FIGS. 44-58 differ in that no grating is affixed to the float, grating covering only the ventilation passageway adjacent the top opening of the interior of the inner wall of the support 312 and thus not rising when the float is elevated in the chamber by surface water entering the chamber. This further reduces the weight the float must raise, more so than the exemplary embodiments of FIGS. 29-43, allowing a further reduction in float size, which allows an even larger ventilation passageway airflow area.

The exemplary embodiments of FIGS. 44-58 are essentially the same as the exemplary embodiments FIGS. 29-43 except no grating is affixed to the float. FIGS. 33, 35 and 37 are applicable to the discussion of the embodiments of FIGS. 44-58 and are included by reference imagining a reference number in the 200 series in FIGS. 33, 35 and 37 is transformed into a 300 series number.

Figure 52:
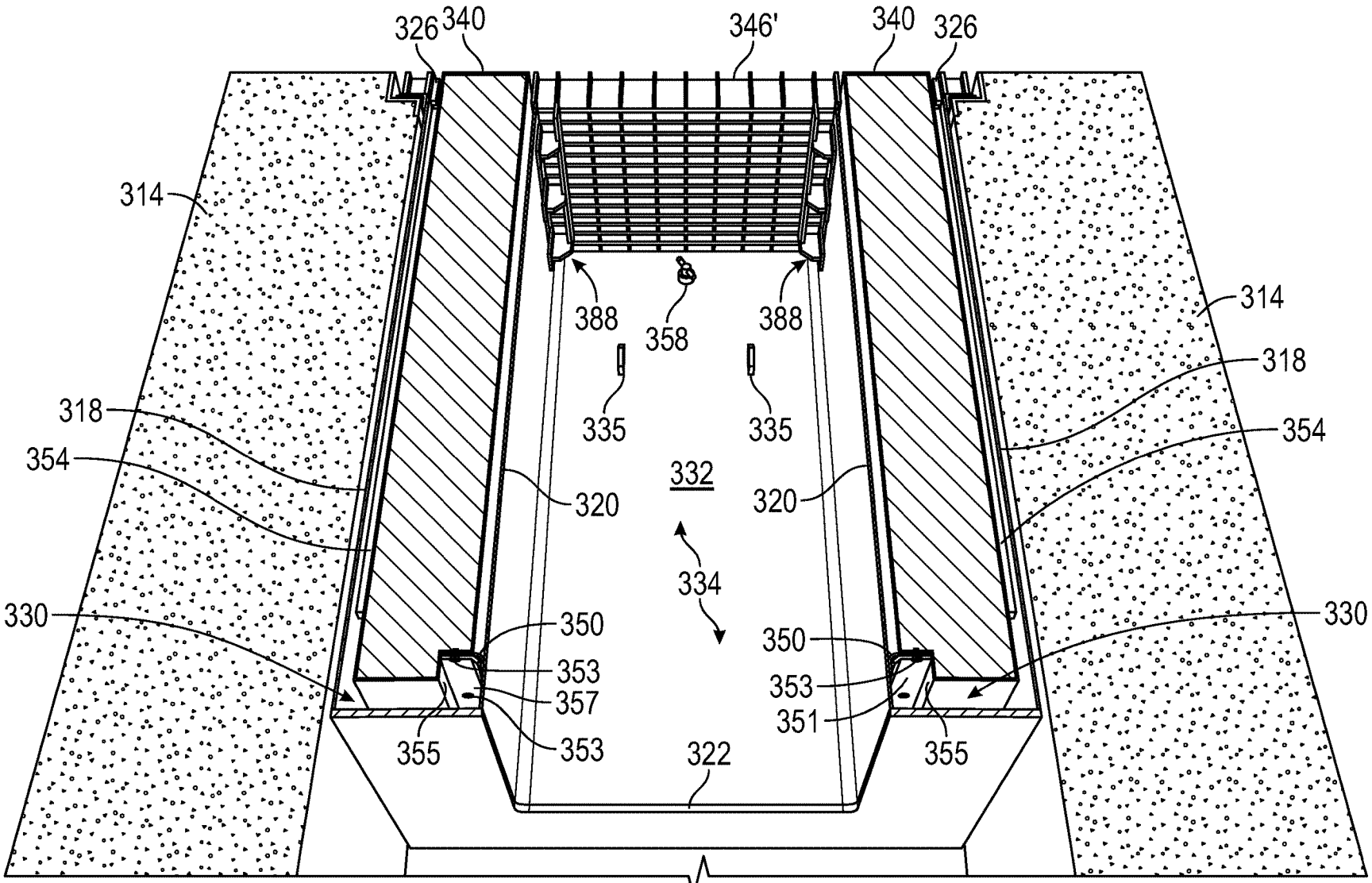

FIG. 44 is a top plan view of an exemplary embodiment of a four-sided rectilinear support vertically suspended within a ventilation shaft similar to FIG. 29, including that for purposes of orientation FIG. 44 has the same orientation as FIG. 29 (thus for convenience the same directional naming of sides as north, south, east, west). FIG. 44 indicates the direction of sectional views for FIGS. 45, 47 and 49. Like FIG. 29, sectional line 45-45 looks north from the middle of support 312. FIG. 52 is a section along the same sectional line as line 45-45, also looking north. Sectional line 47-47 looks from west from the middle of support 312. FIGS. 47, 48, 50, 54 are sectional views along the same sectional line as line 47-47, also looking west. Sectional line 49-49 looks north sectioning the south side of float 340

Figure 45:
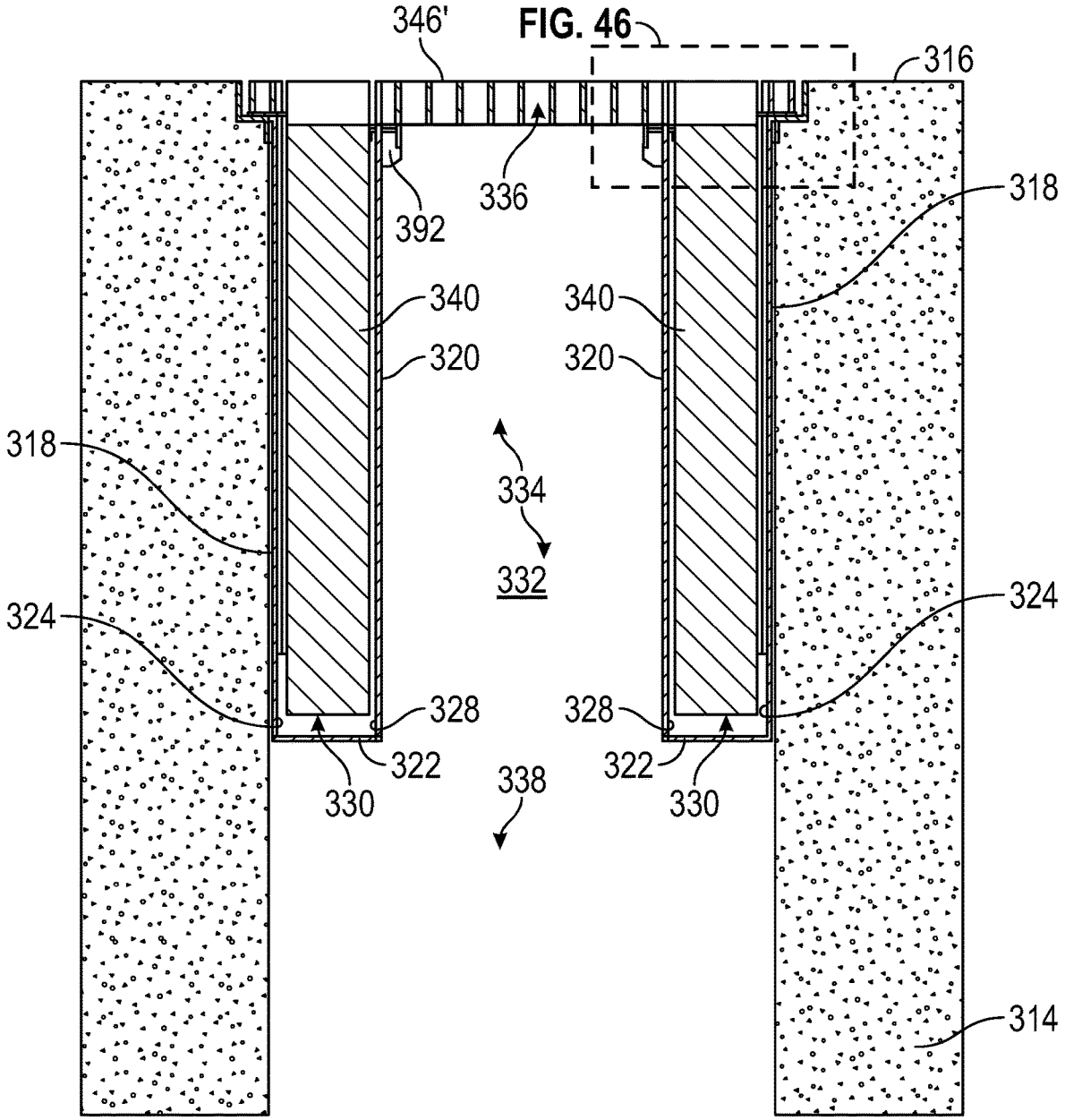

Reference numeral 310 in FIG. 44 indicates apparatus for preventing downward flow of ground surface water into an underground ventilation duct fluidly communicating through a ventilation shaft to an atmospheric opening of the shaft while maintaining atmospheric ventilation to the underground ventilation duct. Apparatus 310 comprises a rectilinear support 312 in the form of a four-sided box for vertical suspension within a vertical rectilinear ventilation shaft 314 from a top 316 of shaft 314. Referring to FIG. 45, box 312 has a rectilinear vertical outer wall 318 adjacent vertical shaft 314 and a rectilinear vertical inner wall 320 spaced from outer wall 318, with a bottom floor 322 connecting a bottom of the outer wall 318 and a bottom of the inner wall 320 of support 312. FIG. 44 differs from FIG. 29 and FIG. 45 differs from FIG. 30 and in that no grating is attached to float 340.

Figure 46:
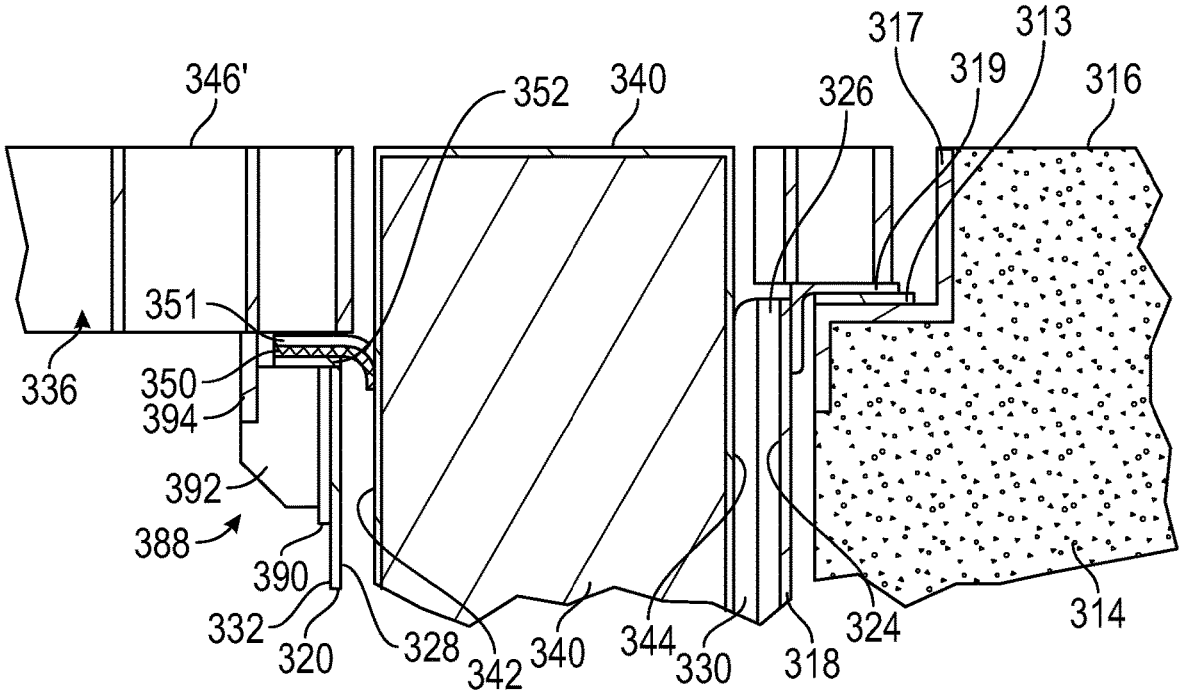

Referring to FIG. 45 and particularly to FIG. 46, the detail enlargement of the encircled portion of FIG. 45, the top of ventilation shaft 314 is an inset ledge 317. Outer wall 318 of support 312 has transverse flanges 319 at an upper extent thereof and flanges 319 rest on ledge 317 to hang support 312 in shaft 314. The interior (inside) 324 of outer wall 318 has a top opening 326 to the atmosphere. Referring to FIG. 45, space between the interior (inside) 324 of outer wall 318 and the exterior (outside) 328 of inner wall 320 defines a rectilinear vertical chamber 330 for receipt of ground surface water entering from the top opening 326 of outer wall 318. Inner wall 320 has a rectilinear vertical interior (inside) 332 defining a ventilation passageway 334 having a top opening 336 to the atmosphere and a bottom opening 338 to ventilation shaft 314 for fluid communication through the ventilation shaft 314 to the underground ventilation duct and the atmospheric opening 336. Floor 322 connecting the bottom of outer wall 318 and the bottom of inner wall 320 of box 312 surrounds bottom opening 338 of ventilation passageway 334.

Referring to FIG. 44, a rectilinear buoyant float 340 is vertically housed within rectilinear chamber 330. Referring to FIG. 45, float 340 has a vertical inner surface 342 adjacent the exterior (outside) 328 of inner wall 320 and a vertical outer surface 344 adjacent the interior (inside) 324 of outer wall 318. Referring to FIGS. 44-48, 50, 52-54, grating 346' covers ventilation passageway 334 allowing fluid communication between atmosphere and ventilation passageway 334. In the embodiments of FIGS. 44-58, the support 388 for grating 346' affixing it adjacent the top opening of the interior of the inner wall of box support 312 is the same as described in connection with FIGS. 33 and 35 and needs no further description here, reference being made back to its description in connection with FIGS. 33 and 35.

Alternatively to suspending float 340 sufficiently above floor 322 as described for the embodiments of FIGS. 1-43, one or more projections 349 either on floor 322 of chamber 330 (see FIGS. 47, 49, 53, 54) or on inside 324 of outer wall 318 above floor 322 or depending from a bottom of float 340 may be used to space float 340 sufficiently above floor 322 that surface water entering 330 chamber from top opening 326 of outer wall 318 can flow under float 340 and buoy float 40 upwardly in chamber. Rise of water in chamber 330 buoys float 340 upward in chamber 330, elevating float 340 above the surface water, blocking surface water from entering the ventilation passageway 334 through grating 346', ventilation passageway 334 of support box 312 remaining open to atmosphere. FIGS. 53-54 and 56-58 depict float 340 in an elevated position that prevents surface water from flowing through grating 346 into ventilation passageway 334 thence though ventilation shaft 314 to an underground ventilation duct while maintaining atmospheric ventilation to the underground ventilation duct through ventilation passage 334 of support box 312.

As in the embodiments of FIGS. 1-13 and 29-41, a stop 356 is located on outside 328 of inner wall 320 of box support 312. As in stop 56 of FIG. 10, stop 356 is the end of a stopper screw 358 adjustably extending through inner wall 320. In the embodiments of FIGS. 44-58, as shown by the indications of stopper screw 358 in FIGS. 47-48 50, 52-54, 57 and 58, stops 256 are located on the north and south outsides of inner wall 220. Referring to FIGS. 47-48, 50-51, 53-54 and 57-58, specifically to FIGS. 51 and 54, as in FIG. 9, the inner surface 342 of float 340 has a companion member projection plate 360 for each stop 356 which each stop 356 can contact to prevent rise of float 340 out of chamber 330.

As was shown in FIGS. 8 and 10 and is shown also in FIGS. 29-32, and again most viewable in FIGS. 44, 46, 48, 54 in an exemplary embodiment, an upper extent 352 of inner wall 320 of support box 312 has a gasket 350 affixed to it held in place by holder 351 secured by fasteners 353 (see e.g. FIG. 44). Gasket 350 extends over exterior (outside) 328 of inner wall 320 sealingly against an inner surface 342 of float 340 to prevent water that has entered chamber 330 from the top opening 326 of outer wall 318 from escaping chamber 330 at such upper extent 352. As best seen in FIG. 44, gasket 350 is on all four sides of inner wall 320 of box support 312.

Figure 50:
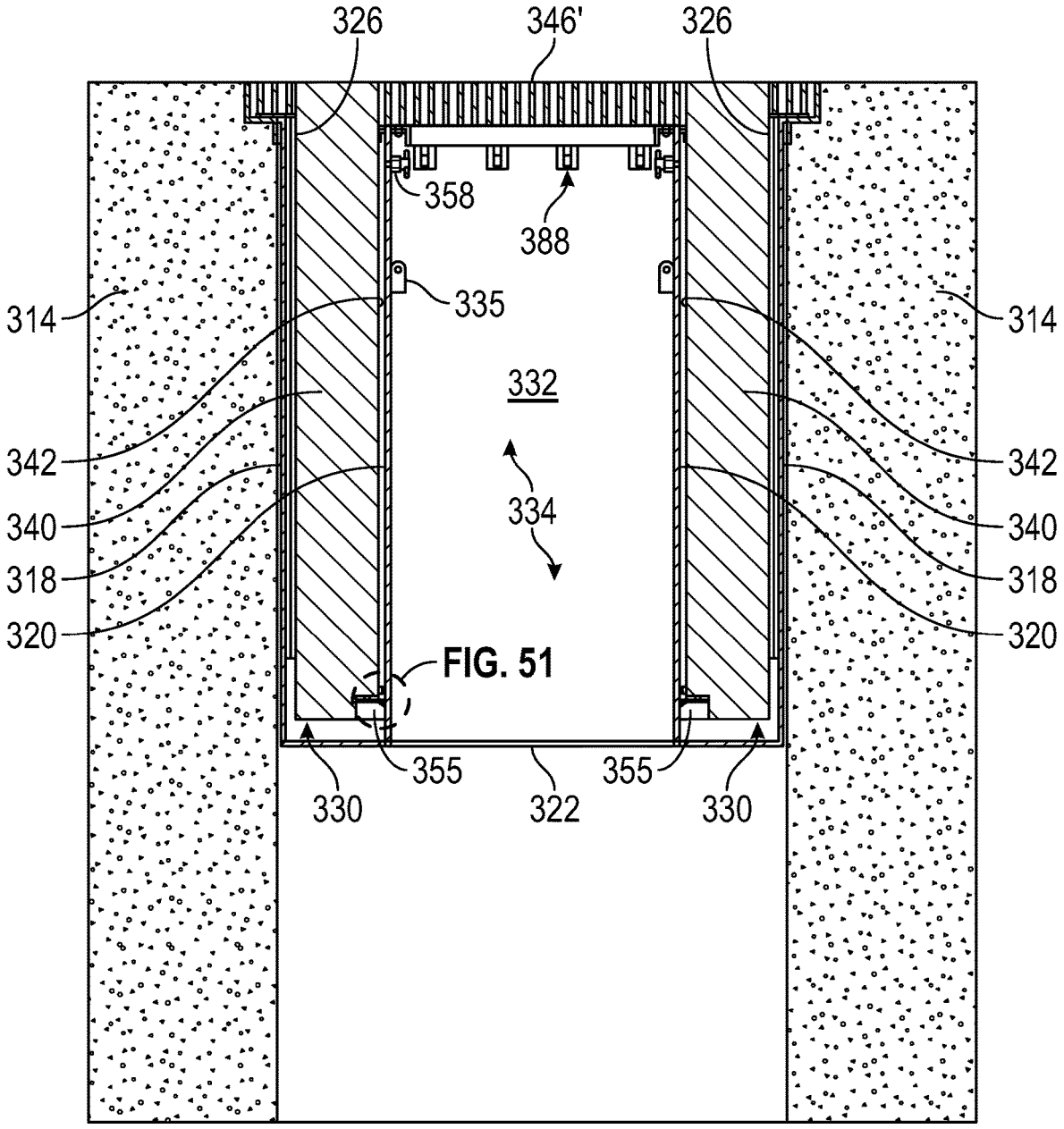
Figure 51:
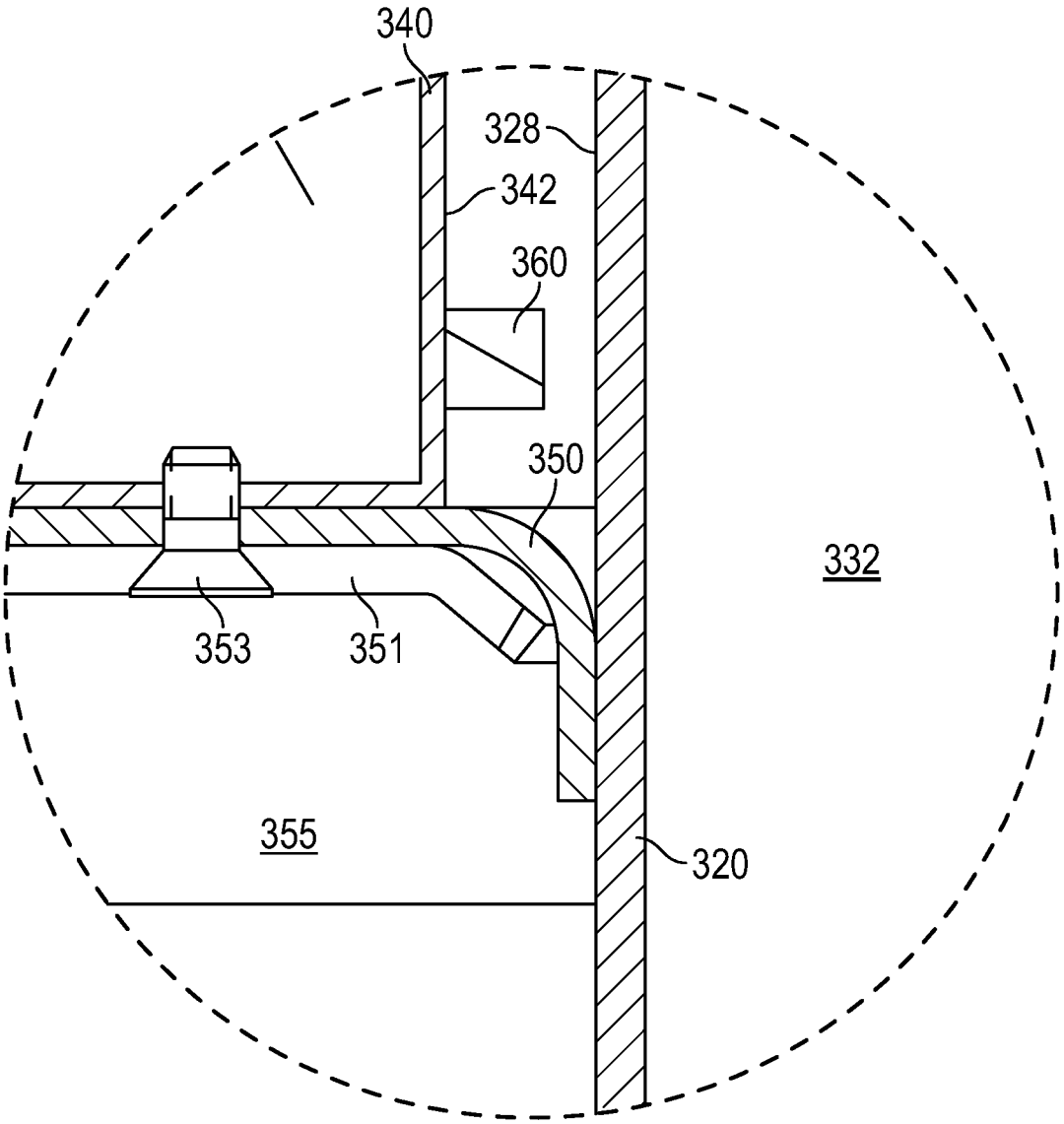

FIGS. 50-52 depict an alternative placement for gasket 350, an alternative placement suitable also for the embodiments depicted in FIGS. 1-49 and 53-58. This placement has gasket 350 affixed to a recess 355 in the inner surface 342 of float 340 below a companion member projection plate 360 for stops 356 in a location indicated by the encircled area indicated in FIG. 50 by reference FIG. 51. FIG. 51 is a detail of the encircled area FIG. 51, showing gasket 350 held in place by holder 351 secured by fasteners 353. FIG. 52 is a bottom angle perspective view of the apparatus 310 showing affixed gaskets 350 in recess 355 and which gasket 350 like the gasket in FIGS. 1-49 and 53-58 is on all four inner surfaces 342 of float 340.

Figure 53:
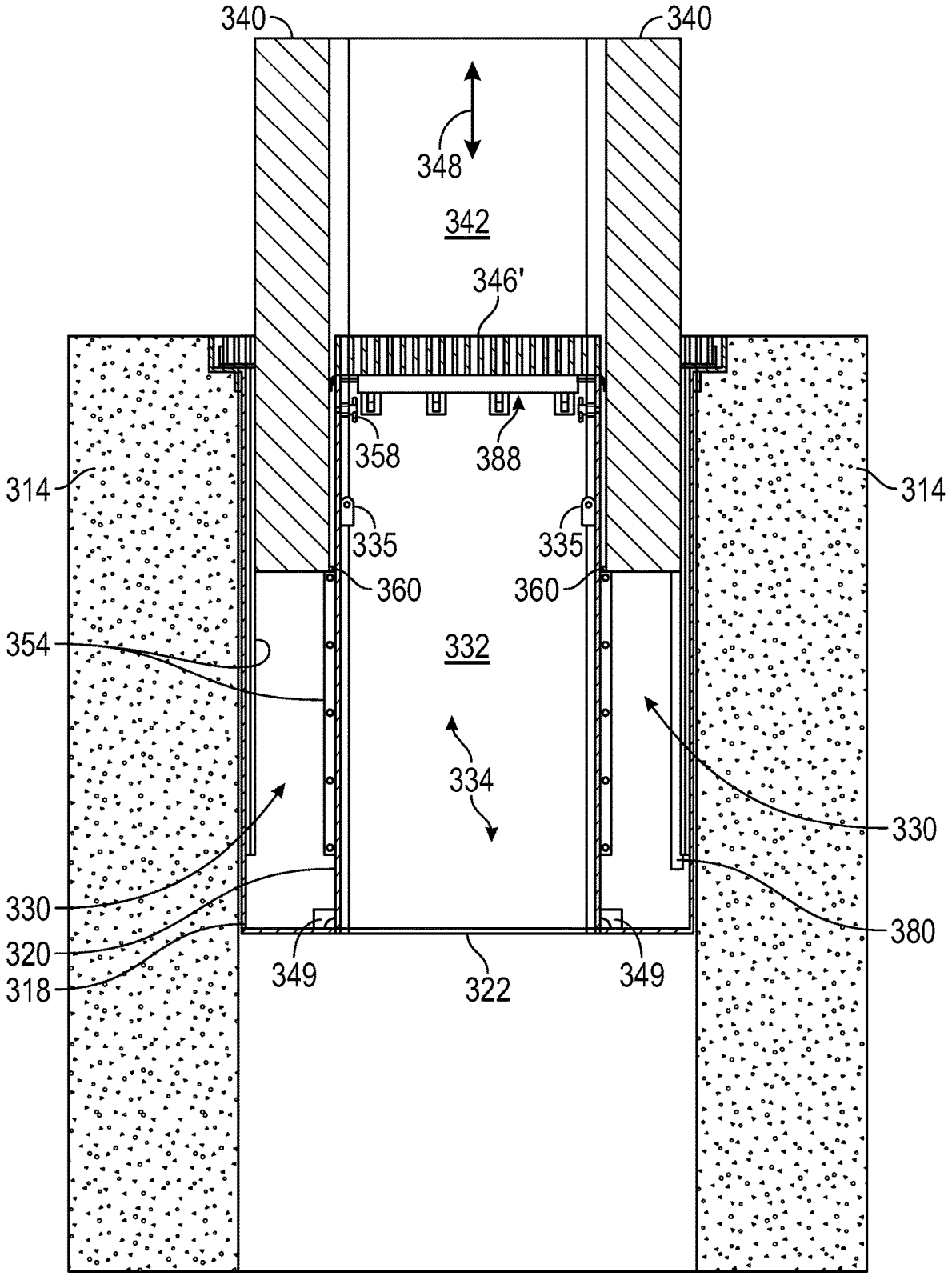
Figure 54:
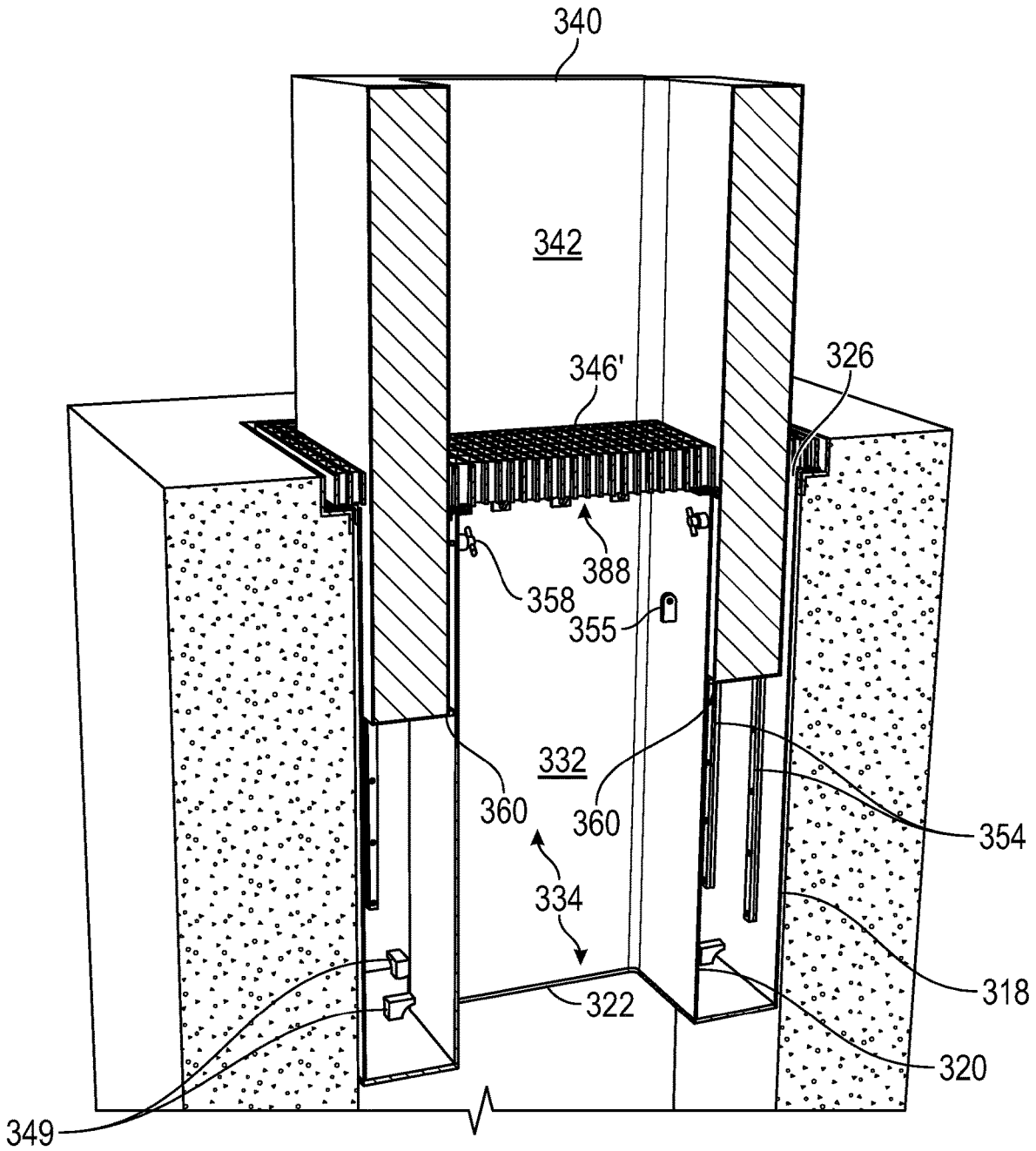
Figure 55:
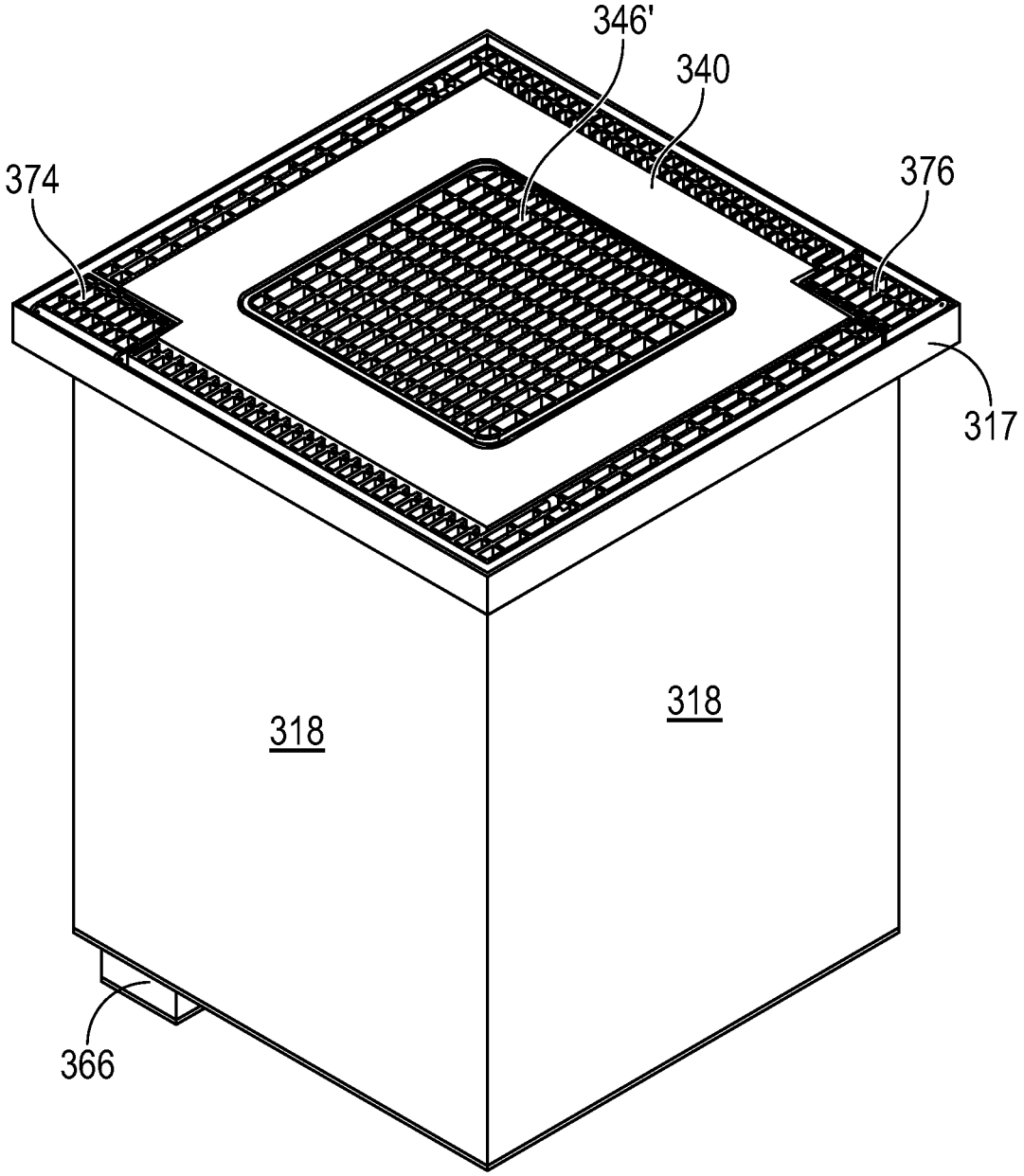
Figure 56:
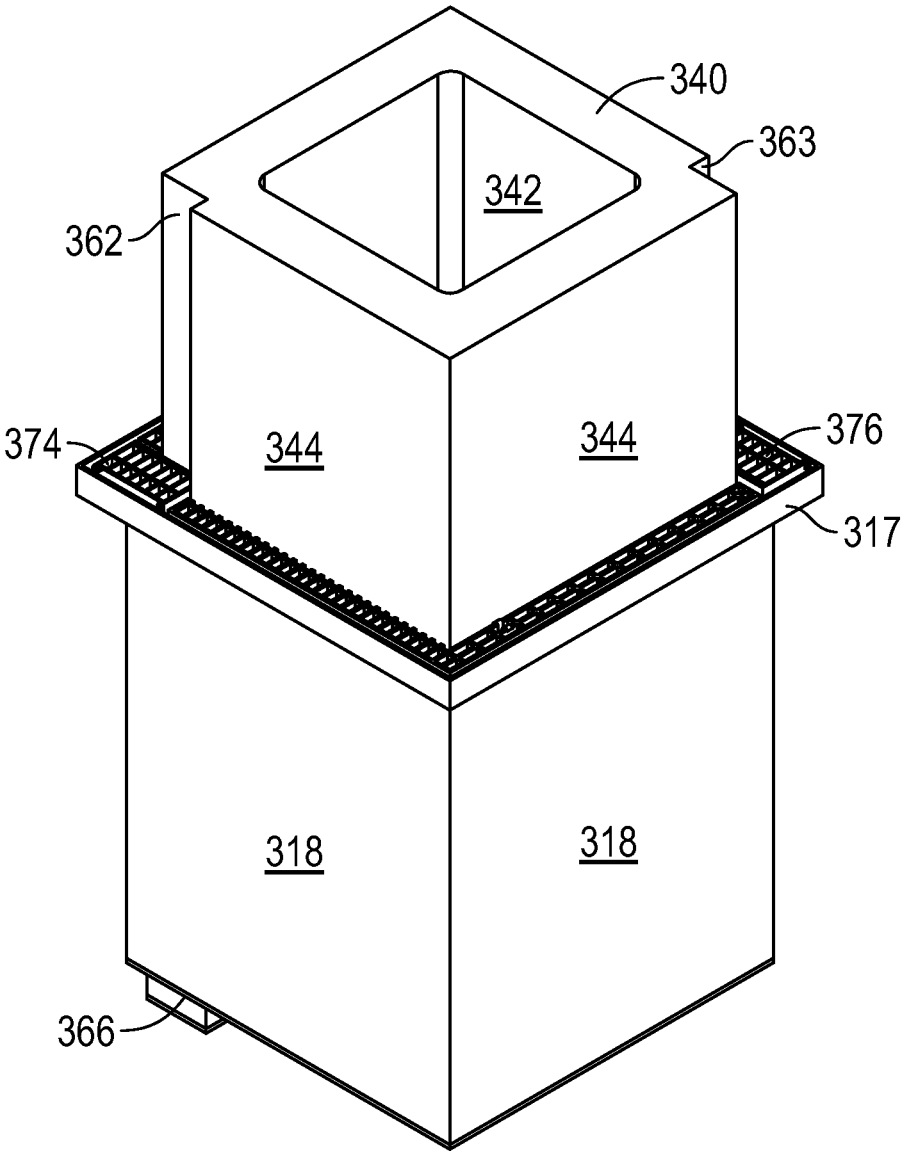
Figure 57:
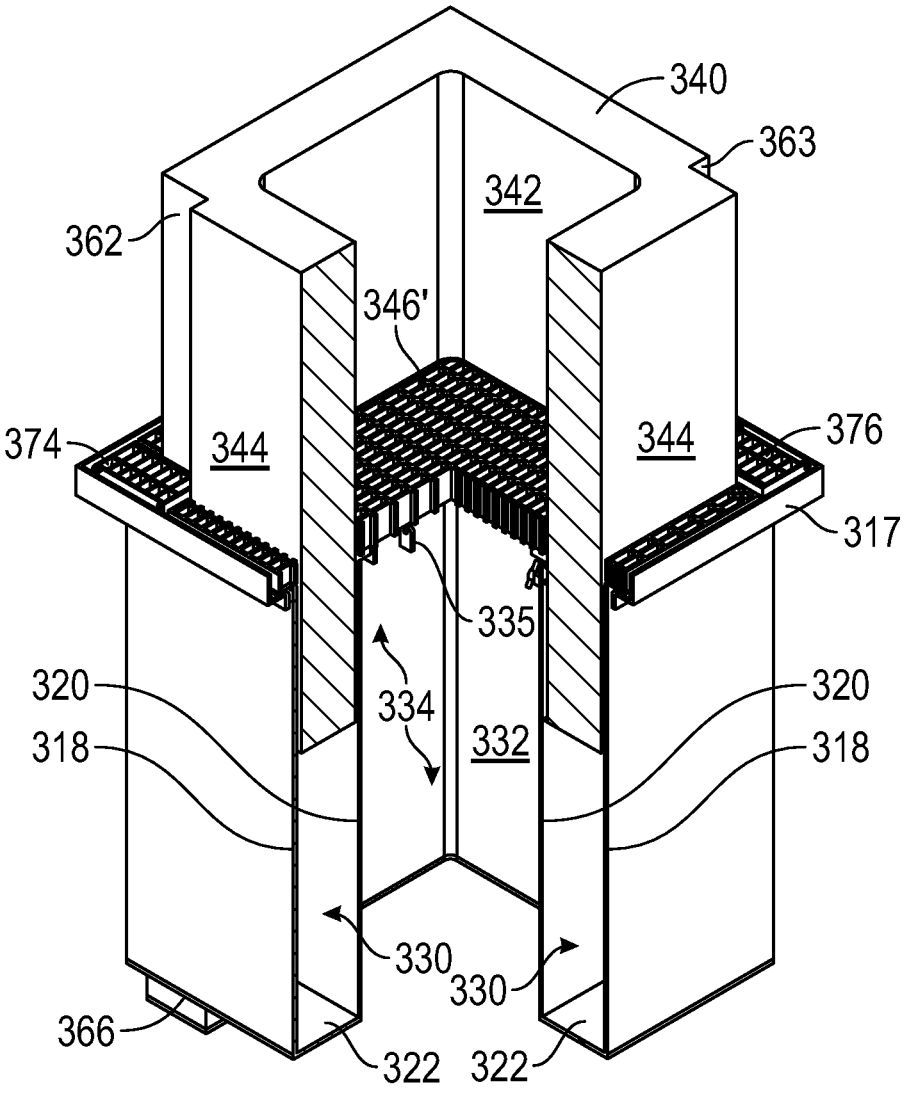
Figure 58:
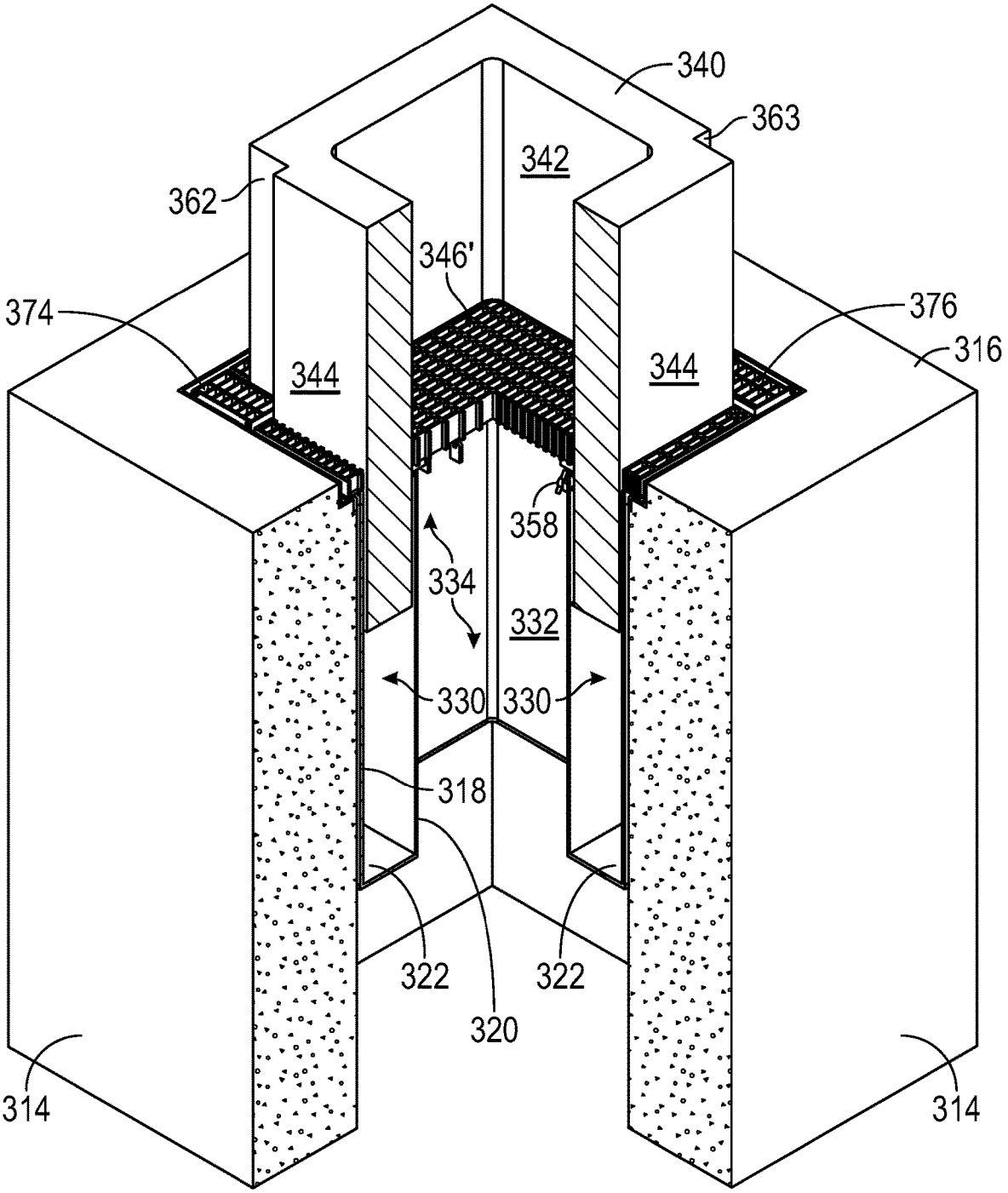

As in the embodiments of FIGS. 29-44, see, e.g. FIGS. 46, 53-54, the interior (inside) 324 of outer wall 318 of box 312 is fitted with vertical guiding strips 354, suitably high abrasion and wear resistant ultra-high molecular weight polyethylene strips, for guiding float 340 vertically upward in chamber 330. Alternatively, guiding strips 354 may be placed on the outside 328 of inner wall 320.

Figure 47:
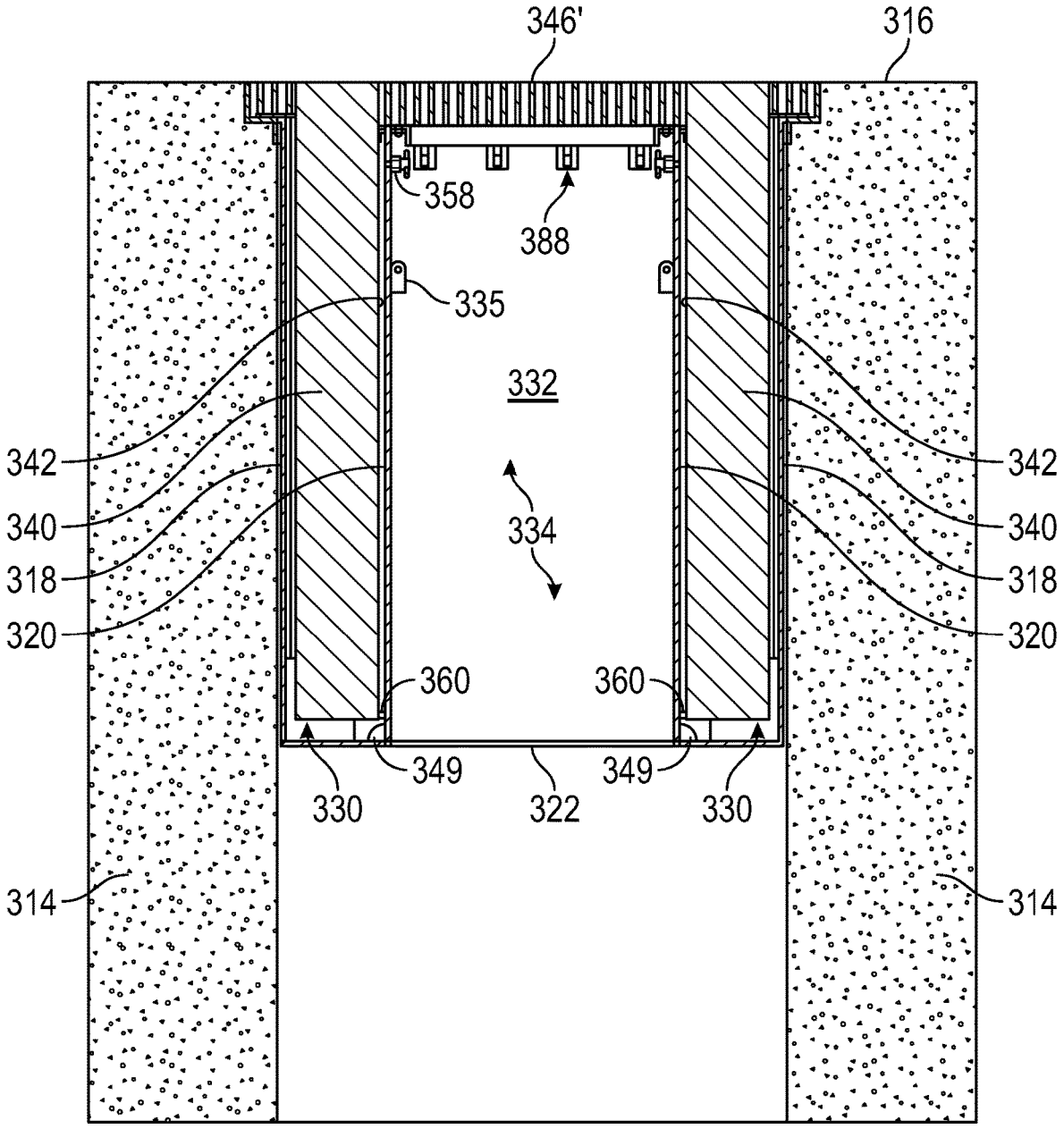
Figure 48:
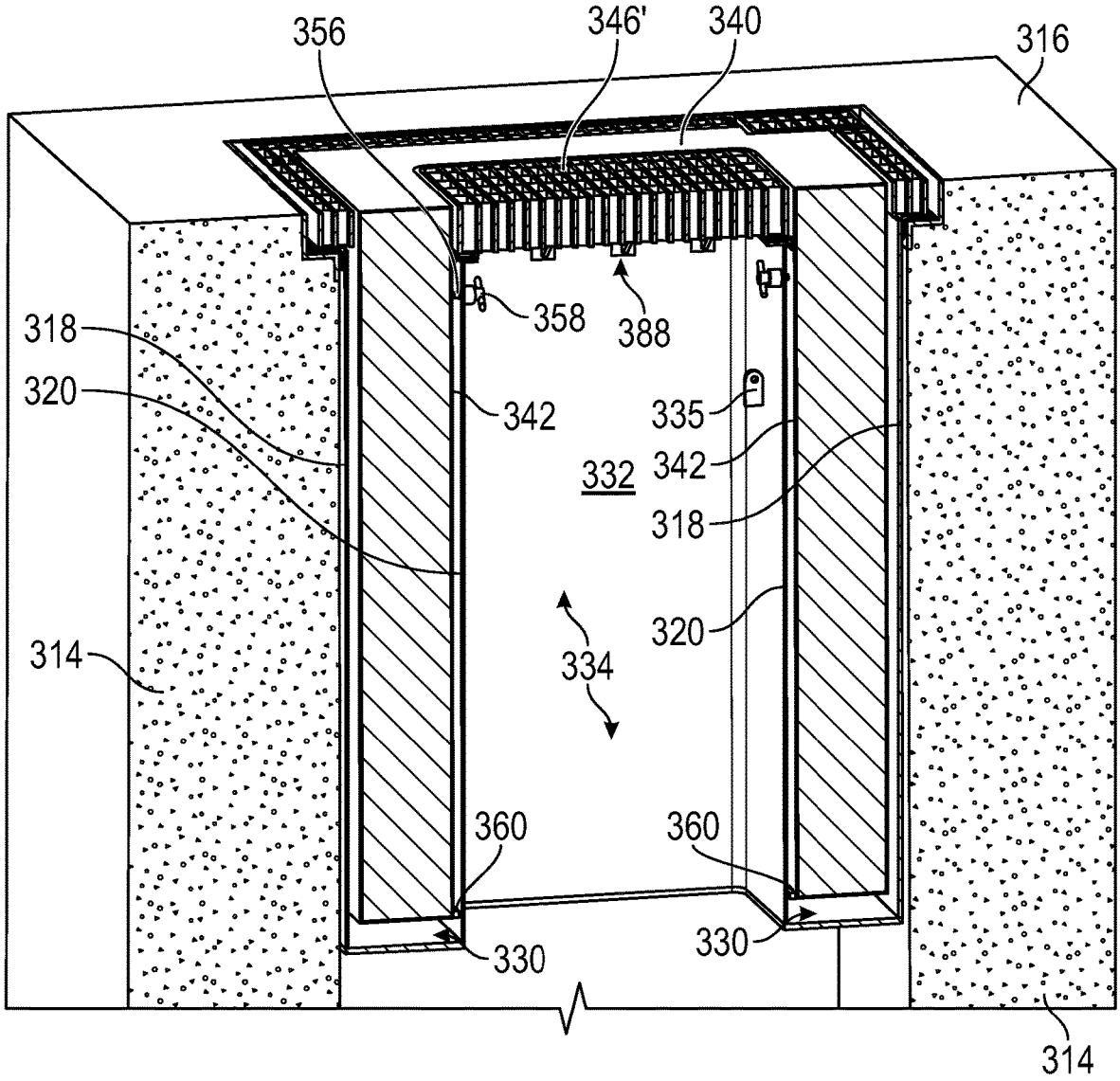
Figure 49:
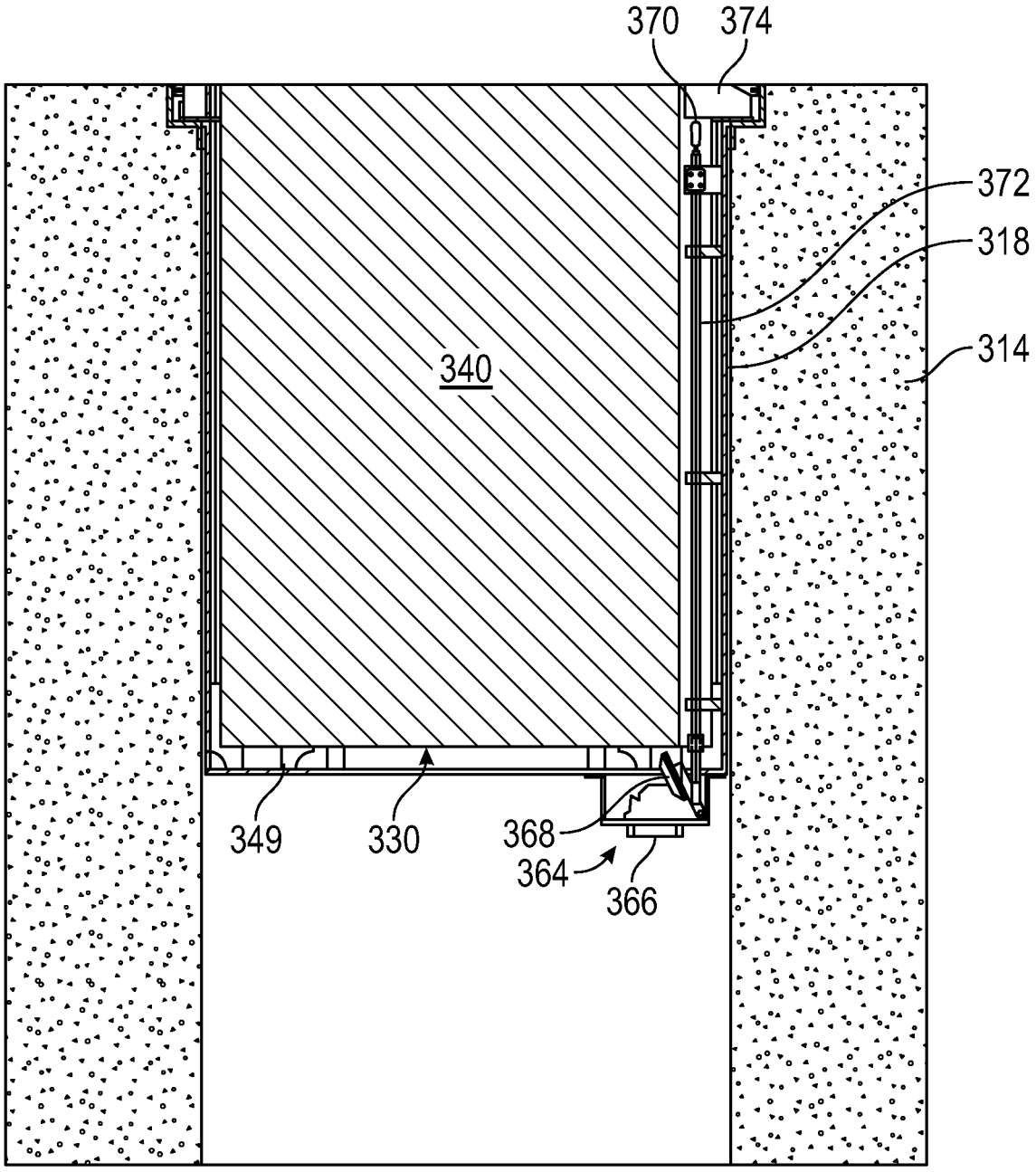

Referring to FIG. 44 and back to FIG. 33, float 340 has a vertical recess 362 along the height of float 340 in a southeastern corner of the float facing the inside 324 of the south and east outer walls 318 in chamber 230. Referring to FIG. 47, a drain 364 is located in floor 322 of box 312 at a bottom of vertical recess 362. Drain 364 comprises an aperture 366 and a plug 368 remotely moveable to open or close aperture 366 by actuation of a handle 370 linked by a rod 372 connected to plug 368. Handle 370 is accessible from a top of vertical recess 362 of float 340. A liftable grating 374 is pivotally connected to the top of outer wall 318 of box 212 above vertical recess 362. Lifting liftable grating 374 provides access to handle 370. Plug 368 of drain 364 is shown open in FIG. 47 to illustrate the plug but the reader will understand that plug 368 is closed in all situations when water is not being drained from chamber 330. Operatively, drain 364 is the same as drain 64 of the embodiments of FIGS. 1-13 and drain 264 of FIGS. 29-43.

Surface water admitted into chamber 330 may carry debris. After surface water has receded and water in chamber 330 has been drained using drain 364, the debris can be removed to avoid interference with rise of float 340 in chamber 230. Referring to FIG. 44 and back to FIG. 33, float 340 has a recess 363 along the height of float 340 in northwestern corner of the float facing the inside 324 of the north and west outer walls 318 in chamber 230. Referring to FIGS. 44 and 55-58, a liftable grating 376 pivotally connected to the top of outer wall 318 of box 312 is liftable to provide access to a flush port 378 for admission of flush water to flush debris from chamber 330 with drain 364 open. The embodiments of FIGS. 44-58 have the same hollow tube described in connection with the embodiments of FIGS. 1-13 and the discussions of same in connection with those other embodiments is incorporated here by reference.

Having described illustrative examples of embodiments that incorporate concepts of the invention, those skilled in the art will be able to use these concepts as guided by these embodiments, and may form alternative variations that nonetheless embrace the concepts herein disclosed and still be within the scope of my invention as claimed in the claims that follow.

I claim:

1. Apparatus for preventing downward flow of ground surface water into an underground ventilation duct fluidly communicating through a vertical ventilation shaft to an atmospheric opening of the shaft while maintaining atmospheric ventilation to said underground ventilation duct, comprising:

a) a support for suspension within the ventilation shaft from a top thereof, said support having 1) a vertical outer wall having an exterior adjacent said ventilation shaft, an interior of said outer wall having a top opening to the atmosphere, 2) a vertical inner wall having an exterior spaced from said interior of said outer wall and an interior defining a ventilation passageway having top and bottom openings for fluid communication between atmosphere and said ventilation shaft, 3) a floor connecting a bottom of said outer wall and a bottom of said inner wall of said support, the spacing between the exterior of said inner wall and the interior of said outer wall forming a vertical chamber over said floor for receipt of ground surface water entering from said top opening of the outer wall;

b) a grating covering said ventilation passageway allowing fluid communication between atmosphere and said ventilation passageway; and c) a buoyant float housed within said chamber and having inner and outer surfaces respectively adjacent said exterior of said inner wall and said interior of said outer wall, said float being sufficiently spaced above said floor that ground surface water entering said chamber from said top opening of said outer wall can flow under said float and buoy the float upwardly in said chamber, rise of water in the chamber elevating the float above ground, blocking surface water from entering the ventilation passageway through said grating, said ventilation passageway of said support remaining open to atmosphere.

2. The apparatus of claim 1 in which said grating is affixed atop said float, spans said top opening of said interior of said inner wall of said support, and rises with the float when the float is elevated in said chamber by surface water entering the chamber.

3. The apparatus of claim 1 in which said grating is affixed adjacent said top opening of said interior of said inner wall of said support and does not rise with said float when the float is elevated in said chamber by surface water entering the chamber.

4. The apparatus of claim 1 in which said grating has portions covering areas both inside and outside said float, one portion covering an area inside said float over said ventilation passageway not rising when said float is elevated in said chamber by surface water entering the chamber, another portion covering said float and extending laterally outside said float and rising with said float when the float is elevated in said chamber by surface water entering the chamber.

5. The apparatus of claim 1 in which at least one of said exterior of said inner wall and said interior of said outer wall of said support is fitted with vertical guide strips for guiding said float vertically upwardly in said chamber.

6. The apparatus of claim 1 in which a gasket is affixed either to a recess in said inner surface of said float or to an upper extent of said exterior of inner wall of said support to seal against said inner surface of said float to prevent water entering said chamber from said opening at the top of said outer wall from escaping from said chamber.

7. The apparatus of claim 1 in which one or more stops are located on said exterior wall of said support, said float having a companion member for each stop which said stop can contact to prevent rise of said float out of said support.

8. The apparatus of claim 1 in which said top of said ventilation shaft has an inset ledge and an upper extent said outer wall of said support comprises transverse flanges for laying over said inset ledge to hang said support in said shaft.

9. The apparatus of claim 1 in which a drain is in said floor of said support.

10. The apparatus of claim 9 in which said drain is configured to allow a controlled flow of water from said chamber.

11. The apparatus of claim 9 in which said float has a vertical recess along the height of the float facing the interior of said outer wall and positioned over said the drain, said drain comprising an aperture and a plug moveable to open or close the aperture by actuation of a handle connected to the plug, said handle being accessible from a top of said recess.

12. The apparatus of claim 11 in which a liftable grating separate from grating covering said top opening of said outer wall is connected to said top of the outer wall of said support over said vertical recess, on lifting providing access to said handle.

13. The apparatus of claim 11 in which said float has a second vertical recess along the height of the float facing the interior of said outer wall and spaced from said recess over said drain for admission of flush water to remove debris from the chamber though said drain.

14. The apparatus of claim 13 further comprising a vertical hollow tube extending into said chamber housed within said second vertical recess and having an upper end adjacent a top of said second vertical recess for connection of the tube upper end to a flush water system to direct flush water into the chamber for drainage though a drain located in said floor.

15. The apparatus of claim 14 in which a liftable grating separate from grating covering said top opening of said outer wall is connected to said top of the outer wall of said support over said second vertical recess, on lifting providing access to said tube upper end.

16. The apparatus of claim 1 in which said shaft, said support, said chamber and said float are rectilinear.

17. The apparatus of claim 16 in which said shaft, said support, said chamber and said float are four-sided.

18. The apparatus of claim 1 in which said shaft has a circular inner wall, and said support, said chamber and said float are circular.

19. Apparatus for preventing downward flow of ground surface water into an underground ventilation duct fluidly communicating through a vertical ventilation shaft to an atmospheric opening of the shaft while maintaining atmospheric ventilation to said underground ventilation duct, comprising:

a) a support for suspension within the ventilation shaft from a top thereof, said support having 1) a vertical outer wall having an exterior adjacent said ventilation shaft, an interior of said outer wall having a top opening to the atmosphere, 2) a vertical inner wall having an exterior spaced from said interior of said outer wall and an interior defining a ventilation passageway having top and bottom openings for fluid communication between atmosphere and said ventilation shaft, 3) a floor connecting a bottom of said outer wall and a bottom of said inner wall of said support, said floor surrounding said ventilation passageway, the spacing between the exterior of said inner wall and the interior of said outer wall forming a vertical chamber over said floor for receipt of ground surface water entering from said top opening of the outer wall;

b) a grating covering said ventilation passageway allowing fluid communication between atmosphere and said ventilation passageway;

c) a buoyant float housed within said chamber and having inner and outer surfaces respectively adjacent said exterior of said inner wall and said interior of said outer wall, said float being sufficiently spaced above said floor that ground surface water entering said chamber from said top opening of said outer wall can flow under said float and buoy the float upwardly in said chamber, rise of water in the chamber elevating the float above ground, blocking surface water from entering the ventilation passageway through said grating, said ventilation passageway of said support remaining open to atmosphere; and d) one or more stops located on said exterior of said inner wall of said support, said float having a companion member for each stop which said stop can contact to prevent rise of said float out of said support, e) a gasket affixed either to a recess in said inner surface of said float or to an upper extent of said exterior of inner wall of said support to seal against said inner surface of said float to prevent water entering said chamber from said opening at the top of said outer wall from escaping from said chamber;

f) a drain located in said floor of said support;

g) said top of said ventilation shaft having an inset ledge and an upper extent said outer wall of said support having transverse flanges for laying over said inset ledge to hang said support in said shaft.

20. The apparatus of claim 19 in which said shaft, said support, said chamber and said float are rectilinear.

21. The apparatus of claim 20 in which said shaft, said support, said chamber and said float are four-sided.

22. The apparatus of claim 20 in which said shaft has a circular inner wall, and said support, said chamber and said float are circular.

* * * * *